US007077047B2

(12) United States Patent
Frasca

(10) Patent No.: US 7,077,047 B2
(45) Date of Patent: Jul. 18, 2006

(54) ELECTROMAGNETIC PROPULSION DEVICES

(76) Inventor: Joseph Franklin Frasca, USPO Box 1686, Elyria, OH (US) 44036-1686

( * ) Notice: Subject to any disclaimer, the term of this patent is extended or adjusted under 35 U.S.C. 154(b) by 0 days.

(21) Appl. No.: 10/710,469

(22) Filed: Jul. 13, 2004

(65) Prior Publication Data

US 2005/0155487 A1 Jul. 21, 2005

Related U.S. Application Data

(63) Continuation-in-part of application No. 10/707,607, filed on Dec. 24, 2003.

(51) Int. Cl.
*F41B 6/00* (2006.01)
*F41F 1/00* (2006.01)

(52) U.S. Cl. ..... 89/8; 124/3

(58) Field of Classification Search ..... 89/8; 124/3

See application file for complete search history.

(56) References Cited

U.S. PATENT DOCUMENTS

| | | | | | |
|---|---|---|---|---|---|
| 1,020,942 | A | | 3/1912 | Bachelet | |
| 1,370,200 | A | | 3/1921 | Fajchon-Villeplee | |
| 4,319,168 | A | | 3/1982 | Kemeny | 89/8 |
| 4,343,223 | A | | 8/1982 | Hawke et al. | 89/8 |
| 4,485,720 | A | | 12/1984 | Kemeny | 89/8 |
| H0148 | H | * | 11/1986 | Thompson | 89/8 |
| 4,625,618 | A | | 12/1986 | Howanick | 89/8 |
| H0237 | H | * | 3/1987 | Levy | 102/517 |
| 4,760,769 | A | | 8/1988 | Jasper, Jr. | 89/8 |
| 4,817,494 | A | | 4/1989 | Cowan | 89/8 |
| 4,852,497 | A | * | 8/1989 | Tsui | 104/138.1 |
| 4,864,911 | A | | 9/1989 | McKee et al. | 89/8 |
| 4,960,760 | A | * | 10/1990 | Wang et al. | 505/164 |
| 4,996,903 | A | | 3/1991 | Arakaki | 89/8 |
| 5,127,308 | A | | 7/1992 | Thompson et al. | 89/8 |
| 5,133,242 | A | * | 7/1992 | Witt | 89/8 |
| 5,183,956 | A | | 2/1993 | Rosenberg | 89/8 |
| 5,189,244 | A | * | 2/1993 | Weldon | 89/8 |
| 5,217,948 | A | * | 6/1993 | Leung et al. | 124/3 |
| 5,297,468 | A | * | 3/1994 | Dreizin | 89/8 |
| 5,375,504 | A | | 12/1994 | Bauer | 89/8 |
| 5,431,083 | A | * | 7/1995 | Vassioukevitch | 89/8 |
| 5,435,225 | A | | 7/1995 | Shahinpoor | 89/8 |
| 5,483,863 | A | * | 1/1996 | Dreizin | 89/8 |
| 5,763,812 | A | | 6/1998 | Collins | 89/8 |
| 5,844,161 | A | * | 12/1998 | Meger | 89/8 |
| 5,856,630 | A | | 1/1999 | Meger | 89/8 |
| 5,869,911 | A | | 2/1999 | Tanaka | 89/8 |
| 6,142,131 | A | | 11/2000 | Wortman et al. | 124/3 |
| 6,374,746 | B1 | * | 4/2002 | Fiske | 104/138.1 |
| 6,696,775 | B1 | * | 2/2004 | Engel | 310/135 |
| 6,725,759 | B1 | * | 4/2004 | Kathe et al. | 89/8 |
| 6,792,335 | B1 | * | 9/2004 | Ross et al. | 700/245 |

* cited by examiner

*Primary Examiner*—Michael J. Carone
*Assistant Examiner*—Bret Hayes

(57) ABSTRACT

Electromagnetic propulsion device as a gun or reversible electric motor having a barrel with a cavity extending its length, an armature in said cavity with a permanent magnetic or energized propulsion bus coil, a plurality of wall conductors orthogonal and circumscribing the cavity distributed between the cavity ends with contact means at the cavity on one end and a bus common with all wall conductors on the other and wherein the magnetic fields of the barrel wall conductor coils immediately before and after the magnetic field source in an armature interacts therewith effecting armature motion. Forward and aft armature current shunts direct current from barrel rails to and from the armature coil with associated propulsion bus-aft shunt circuit means, when extant, and to and from said armature propelling wall conductors via said contacts.

14 Claims, 24 Drawing Sheets

ELECTROMAGNETIC PROPULSION DEVICES

CROSS REFERENCE TO RELATED APPLICATIONS

This utility patent application is directly a Continuation-in-part of pending utility patent application Ser. No. 10/707,607 filed Dec. 24, 2003 by the applicant.

BACKGROUND OF THE INVENTION

1. Field of the Invention

The embodiments of this invention are related to electromagnetic propulsion devices such as rail guns. In rail guns magnetic fields perpendicular to electrical current paths through an armature interacts with the path current creating forces on the armature which are perpendicular to both the current paths and magnetic field. The armature of a rail gun is located between and has moving electrical continuity with the gun's parallel power rails. The armature current flow in a rail gun is resultant a voltage potential between the power rails.

2. Description of Related Art

Devices of this application are improvements to an invention embodiment included in the applicant's patent application: Ser. No. 10/707,607. In said application's embodiment, an armature for the topic embodiment is electromagnetically propelled from breach to muzzle in the barrel cavity by the interaction of the armature's propulsion bus current with the magnetic fields of the currents in barrel wall conductors located immediately forward and aft said bus during armature barrel cavity traverse.

The propulsion bus of armatures for said embodiment is oriented orthogonal to the armature axis and, when in the barrel cavity, to armature direction of barrel cavity traverse and the barrel cavity axis. Said propulsion bus extends around most of the armature's perimeter at its surface proximal the barrel cavity wall surface. An armature for the device also includes a forward current shunt and an aft current shunt in its surface proximal the barrel cavity surface. With an armature in the barrel cavity, the armature forward current shunt is located on the muzzle side of the propulsion bus and is electrically insulated from direct electrical continuity with the rest of the armature and the aft current shunt is located on the breach side of the propulsion bus and is also insulated from direct electrical continuity with the rest of the armature except when the propulsion bus-aft shunt circuit means of the device is a current bus in the armature connecting the aft current shunt with the proximal end of the armature propulsion bus.

The embodiment includes a wall conductor assembly in the barrel cavity wall. The wall conductor assembly is comprised of the multitude of parallel, equal length barrel wall conductors; i.e. wall conductors. The wall conductors are oriented orthogonal the barrel cavity axis and located at or very close to the barrel cavity surface. Said assembly extends the length of the barrel cavity in which the device is extant and includes a barrel bus in the barrel cavity wall. The barrel bus extends parallel the cavity axis its length or has a constant rate of angular displacement at a constant radius about the cavity axis per unite barrel cavity length when the barrel cavity walls have a twist to impart spin to armatures traversing the barrel cavity. Each wall conductor has a contact means at the barrel cavity at one end and electrical continuity with the barrel bus on the other end; i.e. the wall assembly barrel bus has physical and electrical continuity with each wall conductor at the wall conductor's end opposite its contact means at the barrel cavity. The barrel bus is otherwise electrically insulated from the rest of the device.

During an armature's traverse of the barrel cavity, wall conductors that are forward the armature's propulsion bus and which have electrical continuity with the armature's forward current shunt are the forward wall conductor. Said electrical continuity is extant during the forward shunts traverse past the cavity locations of said wall conductors barrel cavity contact means. Wall conductors that are aft the armature propulsion bus and which have electrical continuity with the armature's aft current shunt are aft wall conductor. Said electrical continuity is extant during the aft shunt's traverse past the cavity locations of said wall conductor barrel cavity contact means. The barrel bus maintains electrical continuity between the instant forward and aft wall conductor during an armature's traverse of the barrel cavity.

The topic device also has two barrel power rails connected to the terminals of an outside power supply. During an armature's traverse of the barrel cavity one of the power rails has continuous sliding electrical continuity with the armature's forward current shunt. The second barrel power rail, during an armature's traverse of the barrel cavity, has continuous sliding electrical continuity with the armature propulsion bus at its end opposite the aft shunt-propulsion bus circuit means.

With an armature in the barrel cavity, a series circuit comprised of the barrel power rail that has sliding continuity with the armature forward current shunt, the armature forward current shunt, the forward wall conductor, the wall conductor assembly barrel bus, the aft wall conductor, the armature aft current shunt, the propulsion bus-aft shunt circuit means -said circuit means maintains electrical continuity between the armature aft current shunt and the proximal end of the armature propulsion bus-, the propulsion bus and the second barrel power rail is extant. With power supplied to the device via connections at the breach end of the power rails, the magnetic fields of the forward and aft wall conductor currents interact with the current flow in the armature propulsion bus propelling the armature through the barrel cavity from breach to muzzle.

With the device energized and an armature in the barrel cavity, the magnetic field of a current element at the intersection of an axis plane [i.e.—a plane containing the cavity axis and the cavity axis is also in the boundary of the plane.] with a conducting wall conductor interacts with a current element at the intersection of said plane with the propulsion bus creating forces therein with cavity axis parallel muzzle directed components which propel the armature in the barrel cavity. The axis plane intersects the propulsion bus a second time when it is extant at $\pi$ arc distance about the armature axis from the first intersection and the magnetic field of the topic wall conductor current element interacts with the current element in the second intersection creating forces therein with components parallel the cavity axis and breach directed. The current element at the second intersection is at a significantly greater radius and has a greater deflection angle from the topic wall conductor current element; therefore, the forces produced in the second intersection can usually be ignored. One of the advantages of this embodiment is that it permits with a vast array of symmetric and asymmetric cavity and armature profile designs.

The force in newtons on armatures for the topic device with a cylindrical cavity is given by the general simplified equation with a cross product integrand:

$$\text{Force} = 2\left[.9\int_{\beta_0}^{\beta_1} I_{pb} r_{pb} \cdot d\theta \times (\mu_o I_{wc}/(2\pi))(\text{Cos}\,a/d_{wc\text{-}pb})\right]$$

$I_{pb}$ is the armature propulsion bus current. $I_{wc}$ is the total aft wall conductor current or the total forward wall conductor current; i.e. $I_{pb}=I_{wc}$. The 2 before the bracketed terms accounts for the magnetic fields interaction with the armature propulsion bus current, $I_{pb}$, of both the forward and aft wall conductor currents which create the armature propulsion force. The 0.9 in the bracketed term is an attenuation term compensating for the effect of the magnetic field of a wall conductor current element on the second propulsion bus current element, when extant, located $\pi$ radians arc distance about the armature axis from the primary intersection. The propulsion bus is at the cylindrical surface of the armature and oriented orthogonal the cavity and armature axii at radius $r_{pb}$. The length in meters of the armature propulsion bus current path on which the wall conductors magnetic fields act is the integral of $r_{pb}\,d\theta$ through angle $\beta_1-\beta_0$, where $\beta_0$ is the angular location about the armature axis of the location on the propulsion bus that has electrical continuity with the propulsion bus-aft shunt circuit means, and $\beta_1$ is the angular location about the armature axis of the propulsion bus at its sliding continuity with the barrel power rail. Permeability of free space, $\mu_0$, is $4\pi\times10^{-7}$ Henries/meter. The distance from a current element at an axis plane intersection with a wall conductor and the current element at said axis plane's intersection with armature propulsion bus is $d_{wc\text{-}pb}$ and said radius has deflection angle $\alpha$ from a cavity axis parallel line. The Cos $\alpha$ term is the force component directed parallel the cavity axis. Both $d_{wc\text{-}pb}$ and Cos $\alpha$ in the (Cos $\alpha$)/$d_{wc\text{-}pb}$ term vary for each wall conductor as its contact means are traversed by the armature current shunt and a mean effective value approximation for (Cos $\alpha$)/$d_{wc\text{-}pb}$ may best be achieved by computer iteration.

BRIEF SUMMARY OF THE INVENTION

The improvements herein disclosed increase the armature propulsion force per ampere current and/or simplify the device and/or expand the usefulness of the device as follows.

The armature propulsion bus as a multiple turn coil between its end at the propulsion bus-aft shunt circuit means and its end at the barrel power rail is one said improvement. The propulsion bus coil is about and approximately orthogonal the armature axis and located at the armature surface proximal the cavity surface. With the device energized and an armature in the barrel cavity, the magnetic field of a current element at the intersection of an axis plane with a conducting wall conductor interacts with the current element at the proximal intersection of the axis plane with each turn of the propulsion bus coil creating forces therein with muzzle directed axis parallel components; whereas, in the unimproved embodiment said plane would intersect the proximal propulsion bus only once effect said propulsion. Therefore, given similar dimensions and like currents, the topic improvement—the armature propulsion bus including a coil—significantly increases the force on the armature. Consequent the sum of each said wall conductor current element and its magnetic field interaction with its respective current element in each turn of the propulsion bus, the armature is propelled in the barrel cavity from breach to muzzle.

The wall conductors as multiple turn coils about the barrel cavity and oriented approximately orthogonal the cavity axis in the cavity wall between their ends with contact means at the barrel cavity and their ends with physical and electrical continuity the barrel bus is another improvement. An axis plane through a wall conductor has a magnetic field source current element at the plane's intersection with each turn of the wall conductor coil; therefore, the magnetic field density acting on the current element at the intersection of the axis plane with the propulsion bus is greatly increased. With the device energized and an armature in the barrel cavity, the magnetic field of each current element at the intersection of an axis plane with each coil of a conducting wall conductor interacts with the current element at the intersection of said plane with the armature propulsion bus creating forces therein with cavity axis parallel muzzle directed components. The sum of said magnetic fields throughout the propulsion bus arc extent of the barrel cavity, acting on their respective propulsion bus current elements, combine to propel the armature in the barrel cavity.

In another embodiment of the device, both the armature propulsion bus and the wall conductors are multiple turn coils about the armature axis and cavity axis respectively and approximately orthogonal thereto, this arrangement significantly increases the force per ampere acting on the armature via the enhanced magnetic field density due to the wall conductors as coils acting on the greatly increased length of the armature propulsion bus as a coil. With the device energized and an armature in the barrel cavity, the magnetic fields due to the current element at the intersection of a axis plane with each turn of a wall conductor coil interact collectively with each propulsion bus current element at the axis plane intersection with each turn of the propulsion bus coil to propel the armature in the barrel cavity and the sum of said magnetic fields throughout the $2\pi$ arc extent of the barrel cavity, acting on their respective current element in each turn of the propulsion bus coil, combine to propel the armature in the barrel cavity.

Another embodiment of the device has a separate power supply circuit for the armature propulsion bus and the forward and aft wall conductors; i.e. the armature propulsion bus and wall conductors are no longer elements is the same series circuit. The Electromagnetic propulsion devices have 2 pairs of power rail not both the same; i.e. three or four barrel power rails. Two power rails supply the armature propulsion bus circuit and two power rails supply the wall conductor circuit. With the device energized and an armature in the barrel cavity the wall conductors are permitted much larger currents then the armature propulsion bus and subsequently create greater magnetic field densities acting on the armature propulsion bus current. The propulsion bus, no longer electrically in series with the wall conductors, is permitted smaller currents to reduce its mass and increase the portion of the armature barrel cavity traverse time it remains viable as a conductor.

With the device wall conductors and armature propulsion bus powered by separate and mutually isolated power circuits, useful applications of the device are expanded to include bidirectional electromagnetic motors and actuators. With an isolated power supply circuit for each the armature propulsion bus circuit and the wall conductor circuit and the armature and barrel modified for a low friction long life use as a bidirectional actuator or motor, the powered cavity traverse by the armature in the actuator or motor is reversed by reversing the polarity in one of the two isolated power supply circuits.

Improvements disclosed herein also include embodiments with reduced number of essential elements. In said embodiments the function of the armature propulsion bus and its barrel and armature current supply circuit elements are replaced by a permanent magnet in the armature that is polarized parallel to the armature axis. Said magnet polarity interacts with the polarity of the forward and aft wall conductors (coils) fields propelling the armature in the barrel cavity. E.g. With the armature magnet's north pole towards the muzzle and south pole towards the breach, the current direction in the forward wall conductor coil is ccw -looking from muzzle to breach (LFMTB)- putting the south pole of the forward wall conductor coil proximal the armature magnet north pole, creating forces of attraction there between which propels the armature in the barrel cavity towards the muzzle. The current direction in the aft wall conductor coil is opposite that in the forward wall conductor coil, i.e. cw, and the south pole of the coil is proximal the armature magnet south pole creating forces of repulsion there between which also propels the armature in the barrel cavity towards the muzzle.

The permanent magnet embodiment discussed above can also be used as a bidirectional electromagnetic actuator or motor, with the armature and barrel modified for low friction long life use as such. In the topic device, reversing the direction of the powered traverse of the barrel cavity by the armature at any instant is accomplished by reversing the polarity of the wall conductor power supply circuit.

The equations and examples herein are intended as aides to practitioners of the arts relevant the topic devices and are not part of the claimed devices, and the degree of their veracity is not intended to reflect adversely on the veracity, spirit, intent, merit or scope of this application for letters of patent.

DETAILED DESCRIPTION OF THE INVENTION

Figure 1:
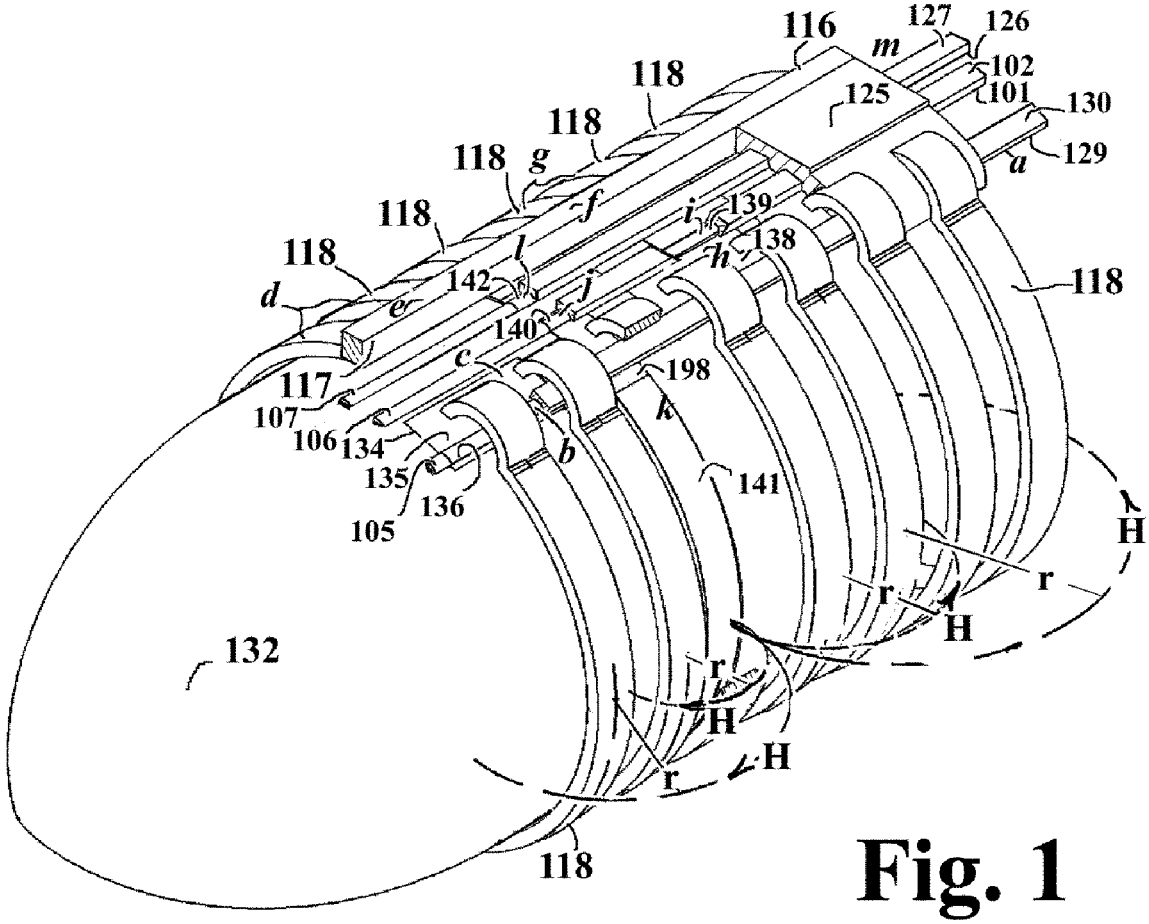
FIG. 1 is an oblique cutaway view of the essential elements in the current path of the embodiment in patent application Ser. No. 10/707/607 the inventions herein improve.

The embodiments herein disclosed increase the force on an armature per ampere current, permits the innovations' use as a bidirectional actuator or motor and in some designs have a reduction in the number of required elements to effect the innovation's function. The topic electromagnetic propulsion device of application Ser. No. Ser. No. 10/707,607 has a barrel and a cavity through the barrel with a breach end and a muzzle end. The cavity profile in right section planes through the barrel cavity throughout the cavity length are uniform (identical within manufacturing limitations); i.e. throughout the length of the cavity, the cavity profile in planes perpendicular the cavity axis are alike. With power supplied to applications that propel armatures as projectiles, armatures in or inserted into the breach end of the cavity are propelled through the cavity towards and out of its muzzle end. The central axis of an armature in the barrel cavity is approximately parallel to and close or coincident with the barrel cavity axis. All armature profiles in right section planes taken to the armature axis are smaller then one and all barrel cavity right section plane profiles and a portion of said armature right section plane profiles are similar to the barrel cavity profile in a right section plane in shape and slightly undersized thereof to permit unobstructed traverse of the barrel cavity by the armature.

The device has two barrel rails, that are power rails. The power rails are of like or similar length, located in the barrel cavity wall along the same length of barrel, parallel the cavity central axis, and proximal and electrically insulated from each other and each power rail has a continuous surface its length that is part of the barrel cavity surface and which extends the length of the barrel through which the device propels an armature. Each power rail has a connection means at its breach end for attachment of circuitry to an outside power source.

The barrel walls also contain a wall conductor assembly; i.e. wall assembly. The wall assembly includes a barrel bus that is located in the barrel wall and parallel to, of similar length and barrel cavity length location as the power rails. The barrel bus is in close proximity one of the power rails and electrically insulated from both power rails. The wall assembly also includes a plurality of equal length parallel wall conductors in the barrel cavity wall which are separated from each other in a distribution along the length of the barrel bus and located at or very near the barrel cavity surface and each wall conductor is physically and electrically continuous with and perpendicular to the barrel bus. Each wall conductor extends from the barrel bus circumscribing, within the barrel cavity wall, most of the cavity to close proximity without contact with the barrel power rail distal the barrel bus. At said power rail proximal location each wall conductor has and is electrically continuous with an electrical contact means at the barrel cavity. Beyond the barrel bus each wall conductor is electrically insulated from its surrounding except at its electrical contact means when an armature current shunt surface is at the barrel cavity location of said means.

An armature for the device has a propulsion bus which when in the barrel cavity is oriented therein to travel in close proximity to the wall conductors of the wall conductor assembly and carry current in a direction perpendicular to the cavity axis and parallel to the wall conductors. During an armature's barrel cavity traverse its propulsion bus current flow is perpendicular to the direction of cavity traverse. With an armature in the barrel cavity, its propulsion bus extends within and very close to or at the armature surface proximal the barrel cavity surface from its end at, with electrical continuity, the barrel power rail proximal the barrel bus to its end at the propulsion bus-aft shunt circuit means with which it also has electrical continuity. When in the barrel cavity, an armature's propulsion bus has continuous electrical continuity with said power rail via the continuous electrical continuity between it surface at the power rail's barrel cavity surface and said cavity surface. With armature cavity motion said continuity is sliding. An armature for the device has a forward current shunt. With an armature in the barrel cavity, its forward current shunt is located on the muzzle side of the propulsion bus and proximal the power barrel rail distal the wall assembly barrel bus. The forward current shunt has surface in the armature that has continuous electrical continuity with the wall conductor assembly via forward wall conductor contact means at the barrel cavity location of said shunt surface. Said forward current shunt also has continuous electrical continuity with the proximal power rail via its barrel cavity surface. With armature movement in the barrel cavity the above said continuous electrical continuities are continuous sliding electrical continuities. During an armature's barrel cavity traverse, surface of its forward current shunt has continuous sliding electrical continuity with the wall conductor assembly from breach to muzzle and said continuity is resultant the continuous sliding electrical continuity said surface has sequentially with successive wall conductors comprising the forward wall conductor of the wall conductor assembly via their contact means as said contact means pass with continuous sliding electrical continuity across the forward current shunt's surface as it passes said contact means barrel cavity location. The forward current shunt of an armature in or traversing the barrel cavity thus maintains continuous electrical continuity between the proximal power rail and the forward wall conductor of the wall conductor assembly. The forward current shunt except for its electrical continuity with the proximal power rail via said rails cavity surface and its electrical continuity with forward wall conductor via their contact means at the barrel cavity, is electrically insulated from the rest of the armature and barrel.

The invention has a propulsion bus-aft shunt circuit means that is either a short current bus in the armature that has physical and electrical continuity with both the aft current shunt and the proximal end of the armature propulsion bus, or a third barrel rail of like length, parallel to, and extending through the same barrel length as the power rails and which also has a continuous barrel cavity surface its length. When the propulsion bus-aft shunt circuit means includes a third barrel rail, and an armature is in the barrel cavity, continuous electrical continuity is maintained between the armature's propulsion bus and aft current shunt by the third rail via the continuous electrical continuity its barrel cavity surface has with aft current shunt surface and surface at the proximal end of the propulsion bus.

The aft current shunt of an armature in or traversing the barrel cavity thus maintains continuous electrical continuity between the propulsion bus-aft shunt circuit means and the aft wall conductor of the wall conductor assembly. The forward current shunt except for its electrical continuity with the proximal power rail via said rails cavity surface and its electrical continuity with forward wall conductor via their contact means at the barrel cavity, is electrically insulated from the rest of the armature and barrel.

The armature also has an aft current shunt located on the breach side of the armature propulsion bus and with the armature in the barrel cavity the aft shunt is located proximal the barrel power rail without electrical continuity the forward current shunt and the aft current shunt has surface in the armature surface proximal the cavity wall and said shunt via said shunt surface has continuous electrical continuity with the wall conductor assembly via the assembly aft wall conductor contact means and during armature movement in the barrel cavity said continuous electrical continuity is sliding and said continuous sliding electrical continuity is extant as said aft wall conductor contact means are passing across said shunt surface. During barrel cavity traverse by the armature, said aft current shunt, via said surface, has continuous sliding electrical continuity with the wall conductor assembly and said continuity is resultant the continuous sequential sliding electrical continuity said aft current shunt surface has with successive wall conductors, via their contact means, comprising aft wall conductor of the wall conductor assembly as said contact means pass across the aft shunt surface with continuous sliding electrical continuity as the aft current shunt passes said contact means barrel cavity location. The invention has a propulsion bus-aft shunt circuit means that is either a short current bus in the armature that has physical and electrical continuity with both the aft current shunt and the proximal end of the armature propulsion bus, or a third barrel rail of like length, parallel to, and extending through the same barrel length as the power rails and which also has a continuous barrel cavity surface its length. When the propulsion bus-aft shunt circuit means includes a third barrel rail, and an armature is in the barrel cavity, continuous electrical continuity is maintained between the armature's propulsion bus and aft current shunt by the third rail via the continuous electrical continuity its barrel cavity surface has with aft current shunt surface and surface at the proximal end of the propulsion bus.

With an armature in the barrel cavity, the armature propulsion bus except for its electrical continuity with the barrel power rail and its electrical continuity with the propulsion bus-aft shunt circuit means is electrically insulated from the rest of the armature and barrel and the armature aft current shunt except for its electrical continuity with aft wall conductor via said conductor contact means and its electrical continuity with the propulsion bus via the propulsion bus-aft shunt circuit means, is electrically insulated from the rest of the armature and barrel.

With an outside power source connected to the terminals of the power rails and an armature in or inserted into the barrel cavity of the device where said barrel rails and wall assembly are extant, the electric current path in the device effecting electromagnetic propulsion of the armature in the barrel cavity towards the muzzle is extant and remains so while the armature is completely in the barrel cavity where said rails and wall assembly are extant. The resultant magnetic fields of the electric current in forward and aft wall conductor of the wall conductor assembly interact with the current flow through the armature propulsion bus creating forces therein with cavity axis parallel, muzzle directed components which propel said armature in the barrel cavity towards the muzzle.

General Design Considerations

With reference now to the present inventions, when the propulsion bus-aft shunt circuit means is a short current bus in the armature between the aft current shunt and the end of the propulsion bus proximal said shunt, the magnetic fields of the barrel power rails interact with the bus current creating forces therein with components orthogonal the barrel cavity axis. When armature current bus is oriented parallel to the armature axis and when in the barrel cavity located in the barrel cavity midway between the barrel power rails, said orthogonal force components collectively resolve into a tangential force about the armature axis at the current bus center line radius. Said tangential force is always directed towards the power rail at the forward current shunt and away from the power rail at the armature propulsion bus. This force might therefore be used to aid armature rotation during traverse of the barrel cavity, rotation which is otherwise effected by the barrel cavity surface. When the propulsion bus-aft shunt circuit means for a barrel cavity traversing armature is comprised of a third barrel rail that has continuous sliding continuity with both the aft current shunt and the armature propulsion bus said tangential force on the armature is eliminated.

Beyond the barrel bus of the wall conductor assembly, wall conductors are isolated from one another throughout their length. Said isolation is effected by insulating barrel material, or insulating coating or sleeves, or less preferably by clearance gaps (air). There can be one wall conductor or the equivalent sum in cross section areas to one wall conductor, or more in contact with the each armature current shunt. Forward and aft wall conductor are each comprised of a group of at least one wall conductor or the equivalent sum in cross section areas to one wall conductor or more wall conductors.

Although the wall conductors of the wall conductor assembles herein illustrated are uniformly distributed along the length of the wall assembly barrel bus and have constant cross section areas, the wall conductor cross section areas and their spacing might vary along the length of the assembly. E.g. In a device where barrel mass and durability is a design constraint, to avoid wall conductor failure due to prohibitive heat and resistance build up, the cross section area of a wall conductor at the breach end of the cavity might be many times a wall conductor cross section area at the muzzle. This area variation compensates for the longer wall conductor conduction time intervals at the cavity breach region and the wall conductors distribution density along the barrel bus might also be greater at the breach then the muzzle end of the barrel cavity and/or when coils, have many more turns near the breach; i.e. the wall conductor would no longer have a uniform distribution along the barrel bus.

For clarity of presentation, the invention embodiments portrayed in the included figures are chemically bonded together in assembly. In practical applications and for quick refurbishment or repair, the embodiments would be assembled using mechanical fastening means well known in the arts.

Molding methods also well known to the arts can be used for barrel, armature and coil fabrication. When the device is intended to propel armatures as projectiles, armature propulsion bus and current shunts whose operational life is measured in milliseconds and fractions thereof can be simple formed pieces of sheet Aluminum or Copper alloy or other conducting alloy, mass restrictions permitting.

As a safety measure in armatures used as projectiles, the propulsion bus should be designed to melt or burst open from heat after the anticipated armature's barrel cavity traverse time has elapsed.

Voids and masses necessary to locate an armature center of mass for in flight stability are not shown in the figures.

The armatures and barrel for the devices are made of electrically non-conducting materials such as SiC or high strength proprietary plastics. The wall conductor assembly and barrel rails are made of good conducting material such as copper, aluminum or iron alloys.

The wall conductors experience rapid field reversal during barrel cavity traverse by an armature and any proximal residual magnetic energy (polarization) stored in proximal structure material will have attenuating effects on the wall conductor magnetic field.

Generally, in regards the various embodiments of the invention, surfaces of elements of the invention having sliding electrical continuity with other elements thereof might be treated and/or machined and/or formed to effect a smooth more effect sliding continuity; e.g. a surface with boundary edges could have those edged rounded and the surface could be treated with low friction conducting substances and/or textured to assure a correct current path when elevated voltages are extant in the invention. The armature may have variations in its surface extruded parallel its axis; e.g. Corrugated surfaces with troughs parallel the armature axis.

The meaning of sliding electrical continuity between elements in the invention is expanded herein to include arrangements to effect electrical continuity between relatively moving elements using conducting rollers or roller balls which are retained in one said element and which have low friction electrically conducting contact with a surface on the second element.

Indication of a coil's current direction and/or winding direction is herein always indicated, unless otherwise noted, when looking from the muzzle end towards the breach end of the coil or part in which the coil is mounted and indicated as cw for clockwise current circulation or direction the coil winding about the coil axis and ccw for counter clockwise current circulation and coil winding about the coil axis.

The barrel and its cavity used by the device may extend at the muzzle and/or breach beyond the electromotive propulsion elements of the invention and in said extensions the armature may or may not be acted on by additional motive, orientation, material modifying or other devices not part of the invention; i.e. the invention may share a common barrel and barrel cavity with other devices not necessary to the invention.

Terminology

Aft Wall Conductor: With an armature for the device in the barrel cavity, the aft wall conductor is the group of one or more consecutive wall conductors which have continuous electrical continuity via their contact means at the barrel cavity with an armature's aft current shunt surface at said contact means barrel cavity location and during armature movement in the barrel cavity, aft wall conductor is the group of one or more consecutive wall conductors which at any instant during said movement have, via their contact means at the barrel cavity, continuous sliding electrical continuity with a surface of the armature's aft current shunt at said contact means barrel cavity location.

Armature: The armatures herein portrayed are either single use projectiles or the motion imparting elements in bidirectional actuators or motors. The profile shape of all right section planes through the armature at the propulsion bus are like but slightly undersized the common barrel cavity profile in a right section plane. Although the armatures illustrated are projectiles or actuator and motor armature elements, alternative uses might also include reusable transport propulsion means wherein the armature of the invention is constructed as a reusable carriage of a transport system utilizing the claimed invention at least partially for propulsion and in which the barrel, barrel cavity, etc, might have turns of various radii and the armature carriage of the system is formed or deformable to negotiate said turns.

Armature Breach End and Muzzle End: When an armature is properly mounted for propulsion in the barrel cavity its breach end is located closest to the cavity's breach end and its muzzle end is located closest the cavity's muzzle end.

Armature Central Axis: The armature central axis is the line through the area centroid centers of the armature profile in right sections taken through that portion of the armature in the barrel cavity whose said profiles have shape like but slightly undersized the barrel cavity's right section profile. The armature central axis in the barrel cavity is approximately parallel and closely proximal the barrel cavity central axis or coincident said axis.

Axis plane: An axis plane contains the cavity axis and the cavity axis is the one and only boundary of said planes. An axis plane's location is determined by the axis and the angular displacement and direction about the axis with reference to given point in space not in the axis. E.g. Looking from the muzzle towards the breach, the line of the axis plane is 0.34 radians clockwise (about the cavity axis) from the barrel bus axis.

Barrel Cavity Wall and Barrel Cavity: The barrel cavity wall is comprised of the barrel from the barrel cavity outer radius outward and in the invention contains the barrel rails and wall assembly and may be a continuous section of a longer barrel and barrel cavity. The longer barrel and barrel cavity might contain sections before and/or after the barrel and barrel cavity of the invention with functions unrelated to the claimed device. E.g. Sections in front of the breach end of the invention barrel might be a simple fixed or expendable cap closing the breach end of the cavity, or part of a rapid breach load mechanism, mount expendable pneumatic armature injection cartridges, or an armature injection means using an embodiment of the invention to inject an armature in to the barrel cavity, and/or may add or modify propellant or explosive payload or a guidance system of the armature, and barrel and barrel cavity sections beyond the muzzle of the invention may include a simple frangible end cap protection from the elements, initiate chemical propulsion of the armature, or include other electromagnetic propulsion means and/or a safe-unsafe trigger mechanism for an explosive payload in the armature.

Barrel Bus and Rail Length and Location: Assembly lengths and locations along the barrel cavity length of barrel rails might vary slightly from one another in a design; i.e. the two power rails extant in embodiments of the invention, along with the barrel rail of the propulsion bus-aft shunt circuit means when extant, and the barrel bus of the wall conductor assembly might have slight variations in length and location along the barrel cavity length. Therefore, the spacial and length relationships between the barrel rails herein are described using the terms 'like' or 'similar' include these minor variations. Examples follow. The power rail with forward current shunt continuity might be shortened at the breach or displace in the muzzle direction by the distance between the breach proximal edges of the forward and aft current shunts. The power rail with propulsion bus continuity might be shortened or displace towards the muzzle the distance between the breach proximal edges of the armature propulsion bus at said continuity and aft current shunt. The barrel rail of the propulsion bus-aft shunt circuit, when extant might be shortened at the muzzle by the distance between the muzzle proximal edges of the forward current shunt and propulsion bus continuity with said rail. The barrel bus length and location along the barrel cavity length might vary slightly, from proximal barrel rails; therefore, 'like' or 'similar' is used to reference the length and location of the wall conductor assembly barrel bus to barrel rail. The barrel bus should extend the length of the barrel and its length might be trimmed at the breach by the distance between the breach proximal edge of the aft current shunt and the breach proximal end of an armature and its length might be trimmed at the muzzle by the distance between the muzzle edge of an armature forward current shunt and the muzzle end of said armature.

Barrel Rail: A barrel rail is a conductor in the barrel cavity wall which is parallel the cavity central axis or has a twist at constant radius about said axis, extends the length of the barrel of the invention and has continuous barrel cavity surface its length. Said barrel rail has electrical continuity via said cavity surface with an element or elements of an armature in the barrel cavity.

Cavity Centra/Axis: The cavity central axis is the line through the centroid center of the cavity area profile in all barrel cavity right sections.

Circumscribes one or more time: Physical encirclement of an object completely one or more times including additional fractions of complete encirclements when extant.

Continuous Electrical Continuity: Continuous electrical continuity is used to indicate low resistance electrical conductivity between electric current conducting elements in the armature and electric current conducting elements in the barrel whether an armature in the barrel cavity is stationary or in motion.

Electrical Isolation: An electrically isolated element is limited in meaning to elements lacking low resistance electrical current paths to or through their neighbors. Magnetic and electric fields couplings are ignored.

Forward Wall Conductor: With an armature for the device in the barrel cavity, the forward wall conductor is the group of one or more consecutive wall conductors which have continuous electrical continuity via their contact means at the barrel cavity with an armature's forward current shunt surface at said contact means barrel cavity location and during armature movement in the barrel cavity, forward wall conductor is the group of one or more consecutive wall conductors which at any instant during said movement have, via their contact means at the barrel cavity, continuous sliding electrical continuity with a surface of the armature's forward current shunt at said contact means barrel cavity location.

LFMTB: With reference to the direction a coil is wound or current path direction in a circuit or coil. Looking From Muzzle Towards Breach.

Permanent Magnet Central Axis: The permanent magnet's central axis is parallel or coincident its direction of magnetic polarization and through the centroid centers of its profile areas in right sections along its dimension that is parallel the direction of magnetic polarization.

Power Rail: A power rail is a barrel rail of a claimed device which has connection means at its breach end for attachment, via outside circuit means, of a terminal of an outside power source providing the required power for operation of the device.

Propulsion Bus: A propulsion bus is a continuous conductor oriented orthogonal to the armature axis between its to ends. The propulsion bus is in the armature, at, or in close proximity the armature surface that is proximal the barrel cavity wall surface when in the barrel cavity. When the propulsion bus is a conventionally wound coil, each turn, is very slightly skewed to a right section plane. e.g. In a very tightly wound coil, when a right section plane of the armature is coincident with the muzzle side of conductor (insulation) at the beginning of a turn it is coincident with the breach side of the conductor (insulation) at the end of the turn and the conductor turn while circumscribing the armature axis passes completely through said plane. When in the barrel cavity, the propulsion bus has at one end continuous electrical continuity with a barrel power rail and with armature movement said continuity is sliding. At its other end, the armature propulsion bus has continuous electrical continuity with the propulsion bus-aft shunt circuit means. The magnetic fields of the forward and aft wall conductor currents interact with the propulsion bus current causing armature propulsion in the barrel cavity.

Propulsion Bus Coil: An armature propulsion bus coil functions as a propulsion bus and is a continuous insulated conductor located in the armature between the armature's forward current shunt and aft current shunt. The conductor coil as a propulsion bus has a central axis about which it was wound that in the armature is approximately close and parallel or coincident to the armature axis. The propulsion bus coil is comprised of one or more turns about the armature axis which circumscribe the central portion of the armature body and each turn is in or proximal armature surface that is proximal the barrel cavity wall surface when in the barrel cavity. In designs utilizing an armature current bus as the propulsion bus-aft shunt circuit means, part of the last turn on the end of the armature propulsion bus coil is bent to extend to the armature aft current shunt and fastened thereto for continuous electrical continuity; i.e. forms the armature current bus of the propulsion bus-aft shunt circuit means. Said last turn in other designs may be fastened for electrical continuity to an extension of the aft current shunt acting as the armature current bus, or a separate conductor acting as said current bus. When the propulsion bus-aft shunt circuit means includes a third barrel rail and its electrical continuity with both the aft current shunt and propulsion bus of an armature in the barrel cavity, the second end of the armature propulsion bus coil, [i.e. the final turn, a part of which may diverge from circumscribing the armature] has a surface, (with insulation removed) or is electrically continuous with a conducting surface which has electrical continuity with the barrel rail of the propulsion bus-aft shunt circuit means.

Right section. A right section or right section plane is a plane which is perpendicular to [i.e. oriented orthogonal to] the central axis of a body or cavity.

Sliding Electrical Continuity. The meaning of sliding electrical continuity between elements in the invention is expanded herein to include arrangements to effect electrical continuity which use sets of conducting rollers or roller balls which are retained in and electrically continuous with one element and have low friction electrically conducting contact with a surface on the second element.

Twist: The cavity profile in right sections of a barrel cavity with twist taken at equal increments along the cavity axis length from breach to muzzle have increasing angular displacement about the cavity axis at a constant angular rate; i.e. $(\alpha_i-\alpha_0)(d_i-d_0)=\text{constant}_{barrel}$, where $\alpha_0$ and $d_0$ are the initial an and distance, respectively, at the breach and both are 0. Angle $\alpha_i$ is the collective angular displacement the cavity profile at cavity distance $d_i$ from the breach.

In right sections profiles of the barrel cavity with twist, the angular displacement of increment area elements at their fixed radii about the cavity axis of the barrel rails and the various elements of the wall conductor assembly, or elements of said rails and assembly, at, in or through the cavity surface, taken with reference a cavity right section at their end or boundary closest the breach increases with distance towards the muzzle from the reference section at constant rate: $\text{constant}_{barrel}$.

In an armature used in a barrel with twist, profiles of consecutive right sections taken at equal increments from breach end to muzzle end have increasing angular displacement about the armature axis at a constant rate; i.e. $(\theta_j-\theta_0)/(L_i-L_0)=\text{constant}_{armature}=\text{constant}_{barrel}$ where $\theta_0$ and $L_0$ are angle and distance, respectively, at the armature breach end and both are 0. Angle $\theta_i$ is the collective angular displacement the armature profile at distance $L_i$ from the armature breach end.

In right sections profiles of an armature with twist, the angular displacement of increment area elements at their fixed radii about the armature axis of the current shunts, propulsion bus and, when extant the current bus of the aft shunt-propulsion bus circuit means, or at least elements of said shunts, and buses, at, in or through the armature surface at the cavity surface when in the barrel, taken with reference an armature right sections at their respective ends or boundaries closest the armature breach end increases with distance towards the armature muzzle end from the reference section at a constant rate: $\text{constant}_{armature}$.

Wall Conductor: A wall conductor is a continuous conductor with barrel cavity axis orthogonal orientation in the barrel cavity wall where it is at, in or proximal the surface of the barrel cavity throughout its length except where contoured to pass across a barrel rail with isolation therefrom. A wall conductor has at one end electrical continuity with the barrel bus of the wall conductor assembly and at its other end contact means at the barrel cavity which has electrical continuity with an armature current shunt when said shunt is at the contact means barrel cavity location. The wall conductor is either a single insulated conductor which nearly completely circumscribes the barrel cavity between its ends or a coil of one or more turns which circumscribe the barrel cavity between ends at the barrel bus and barrel cavity. When the wall conductor is a coil (or winding), each turn is very slightly skewed to a right section plane; e.g. In a very tightly wound coil, when a right section plane of the barrel cavity is coincident with the muzzle side of the conductor (insulation) at the beginning of a turn it is coincident with the breach side of the conductor (insulation) at the end of the turn and the conductor turn, and while circumscribing the barrel cavity, passes completely through said plane. The magnetic field of a conducting wall conductor interacts with the armature propulsion bus current causing armature propulsion in the barrel cavity.

Wall Conductor Coil: An wall conductor coil functions as a wall conductor and is a continuous insulated conductor located in the barrel cavity wall at, in or proximal the barrel cavity wall surface except where contoured to pass across a barrel rail with isolation therefrom. Each turn of a wall conductor coil completely circumscribes the barrel cavity. The conductor coil as a wall conductor has a central axis (about which it was wound) that with the coil in the barrel cavity wall is close and parallel or coincident to the barrel cavity axis. The wail conductor coil is comprised of one or more turns circumscribing the barrel cavity with each turn in or proximal the barrel cavity surface.

With reference now to the drawings, FIG. 1 is a cutaway section view of an embodiment of patent application Ser. No. 10/707,607 and improvements thereof are the topic of this application. Shown are armature 132 mounted in the barrel cavity 133 with the barrel cavity shell removed to illustrate the current path and various elements essential to the propulsion of the armature through the barrel cavity.

Shown is a section of the wall conductor assembly 116 with its barrel bus 117 oriented parallel the cavity axis. A plurality of wall conductors 118 extend from the barrel bus 117 whereat they have physical and electrical continuity and orthogonal orientation. The plurality of wall conductors 118 of the wall assembly in the assembled device are spaced apart from each other in a distribution from breach to muzzle in the barrel cavity 133 wall. Each wall conductor 118 is in, at or in close proximity the barrel cavity wall surface except where it is formed or deformed to avoid continuity with barrel rails and circumscribes most of the barrel cavity 133. Each wall conductor 118 has its end distal the barrel bus 117 a contact means 119 at the barrel cavity 133.

The forward current shunt 134 surface 136 of an armature 132 in the barrel cavity 133, whether stationary or in motion, has continuous electrical continuity with surface 129 of barrel power rail 130 and thereby the forward current shunt 134 has continuous electrical continuity with power rail 130.

Forward current shunt 134 surface 136 is at and whereat supplants armature guide 105. The armature 132 in the barrel cavity 133 has guide 105 and forward current shunt surface 136 in the mating channel in the cavity wall surface 129 of barrel power rail 130 whereby the armature's proper angular orientation about its axis in the barrel cavity is maintained.

Forward current shunt 134 surface 135 has continuous electrical continuity with the contact means 119 (end surface) of wall conductors 118 at the barrel cavity location of shunt surface 135. The one or more wall conductors 118 whose contact means 119 at the barrel cavity have electrical continuity with forward current shunt 134 surface 135 are the forward wall conductor.

Propulsion bus 141 is at the surface of the armature with an electrical insulting element 198 protecting it from electrically shorting to wall conductor contact means 119 at its armature location. Propulsion bus 141 is oriented orthogonal the armature axis and circumscribes most of the armature body at its surface proximal the cavity wall surface and wall conductors therein. At one end of propulsion bus 141 is surface 140 which is at and whereat supplants the armature guide 106. Surface 140 has continuous electrical continuity with the barrel cavity surface 101 of the barrel rail 102 of the propulsion bus-aft shunt circuit means. At the other end of propulsion bus 141 is surface 142 which is at and whereat supplants the armature guide 107. Armature propulsion bus 141 surface 142 has continuous electrical continuity with barrel cavity surface 126 of armature power rail 127.

The guide 107 and propulsion bus surface 142 of an armature 132 in the barrel cavity 133 is in and with armature movement travels in a mating channel in the barrel cavity wall surface 126 of barrel power rail 127 to maintain proper armature orientation in the barrel cavity.

The aft current shunt 137 surface 139 of an armature 132 in the barrel cavity 133, is at and whereat supplants guide 106. Whether an armature in the barrel cavity is stationary or in motion, its aft current shunt 137 surface 139 has continuous electrical continuity with cavity surface 101 of barrel rail 102 and thereby the aft current shunt 137 has continuous electrical continuity with barrel rail 102 of the propulsion bus-aft shunt circuit means. Aft current shunt 137 surface 138 has continuous electrical continuity with the contact means 119 (end surface) of wall conductors 118 at the barrel cavity location of shunt surface 138. The one or more wall conductors 118 whose contact means 119 at the barrel cavity have electrical continuity with aft current shunt 137 surface 138 are the aft wall conductor.

The continuous electrical continuity of the propulsion bus 141 surface 140 with cavity surface 101 of barrel rail 102, the barrel rail 102, and the continuous electrical continuity of surface 139 of aft shunt 137 with surface 101 of barrel rail 102 comprise the propulsion bus-aft shunt circuit means in the device.

The guide 106 of an armature 132 in the barrel cavity 133, and propulsion bus surface 140, and aft current shunt 137 surface 139 which are at and whereat supplant armature guide 106, are in and with armature movement travel in a mating channel in the barrel cavity wall surface 101 of barrel rail 102 to maintain proper armature orientation in the barrel cavity.

Barrel rails 102, 127 and 130 mount in rail subassembly 125 which is then mounted in the barrel in assembly.

The current path in FIG. 1 with the power rail 130 attached to the positive terminal of an outside power supply and power rail 127 attached to the return terminal of said power is indicated by letters 'a' through 'm' and the magnetic fields H resultant current in forward and aft wall conductor through the armature propulsion bus 141 are indicated at their radii 'r'.

The current path from 'a' to 'b' is in the muzzle direction via the barrel power rail 130 and at 'b' the path is from power rail 130 to forward current shunt 134 via the rail cavity surface 129 continuity with surface 136 of the forward current shunt 134, the current path continues in the forward shunt 134 from 'b' to 'c' at the electrical continuity of contact means of 119 of forward wall conductor 118 with forward current shunt surface 135.

The current path continues in forward wall conductor from 'c' at forward wall conductor contact means 119 to 'd' at said wall conductor physical and electrical continuity with wall conductor assembly 116 barrel bus 117 at 'e'.

The magnetic fields of the current in forward wall conductor interact with the current in the armature propulsion bus 141 creating forces therein which have muzzle directed cavity axis parallel components which propel the armature in the barrel cavity towards the barrel muzzle; i.e. the magnetic fields of the forward wall conductor currents interact with the propulsion bus current creating apparent forces of attraction there between.

The current path in barrel bus 117 is breach directed from 'e' to 'f'. The current path at barrel bus 117 continues at 'f' on to aft wall conductor at 'g' via wall conductors 118 electrical and physical continuity with the barrel bus.

The current path continues in the aft wall conductor from 'g' to 'h' at the electrical continuity of the contact means of aft wall conductor with surface 138 of the aft current shunt.

The magnetic fields of the current in the aft wall conductor interact with the current in the armature propulsion bus 141 creating forces therein which have muzzle directed cavity axis parallel components which propel the armature in the barrel cavity towards the muzzle; i.e. the magnetic fields of the aft wall conductor currents interact with the propulsion bus current creating apparent forces of repulsion there between.

The current path in the aft current shunt 137, 'h' to 'i', is from surface 138 to surface 139 which has continuous electrical continuity with cavity surface 101 of barrel rail 102 of the propulsion bus-aft shunt circuit means.

The current path continues in the barrel rail 102 from said continuity at 'i', towards the muzzle, and to the continuity of barrel rail 102 surface 101 with the armature propulsion bus 141 surface 140 at 'j'.

The current path continues in the propulsion bus 141 from its surface 140 continuity with the barrel rail 102 of the propulsion bus-aft current shunt at 'j' under the insulator 198 to 'k' and therefrom in the propulsion bus to 'l' at the continuity of propulsion bus surface 142 with return power rail 127 surface 126.

The current in the armature propulsion bus 141, acted on by the magnetic fields of forward wall conductor currents (immediately forward said propulsion bus cavity location) and aft wall conductor currents (immediately aft said propulsion bus cavity location) creates forces in the propulsion bus with cavity axis parallel, muzzle directed components that propel the armature in the barrel cavity towards the muzzle.

The current path at the electrical continuity between propulsion bus 141 surface 142 and the return power rail 127 surface 126 continues in power rail 127 in the breach direction; i.e. from 'l' to 'm'. Power rail 127 is connected to the return terminal of the outside power supply. The current flow in forward wall conductor and propulsion bus are always like directed about the armature axis and the current flow in aft wall conductor is always oppositely directed the current flow in the armature propulsion bus; regardless the instant polarity of the barrel power rails; i.e. whether the current path is from 'a' to 'm' or 'm' to 'a' the forces created in the propulsion bus by the magnetic fields of the currents in the forward and aft wall conductor always have cavity axis parallel muzzle directed components.

FIGS. 2 through 7 are of an embodiment of the invention for armatures using coils as their propulsion bus and a current bus as the device's propulsion bus-aft shunt circuit means. The device has a wall conductor assembly similar that in FIG. 1 and the armature propulsion bus is in a series electrical circuit which includes the forward and aft wall conductor of the wall conductor assembly.

With reference to the above force equation, the magnetic field of the current element I r dθ at the intersection of an axis plane with a conducting wall conductor acts at distance d in the axis plane deflected angle α to an cavity axis parallel ray through said current element in the axis plane and the magnetic field acts on an equal current element I in the intersection of said plane with a turn of the armature propulsion bus coil. If the propulsion bus coil is wound in the conventional manner the values of distance, d, and cos α between the wall conductor current element at an axis plane and a propulsion bus coil turn current element at the intersection of said axis plane vary from one coil turn to the next and vary in each coil turn with incremental displacement of said axis plane through the arc θ extent of the wall conductor.

The magnetic field element at said axis plane intersection with a turn of the propulsion bus coil is resolved into parallel and normal components to the armature axis in said axis plane and the normal component of the magnetic field of a wall conductor current interacts with the propulsion bus current element creating a force in said propulsion bus turn with a cavity axis parallel muzzle directed component. The current element in a turn of the propulsion bus is resolved into normal and parallel components to the axis plane and ΔI, is the element component with which the magnetic field interacts:

$$\Delta I_x=[(TL^2-CW^2)^{1/2}/TLJ=\Delta I$$

Where TL is the length of a propulsion bus turn and CW is the thickness of the insulated conductor comprising the propulsion bus.

Figure 2:
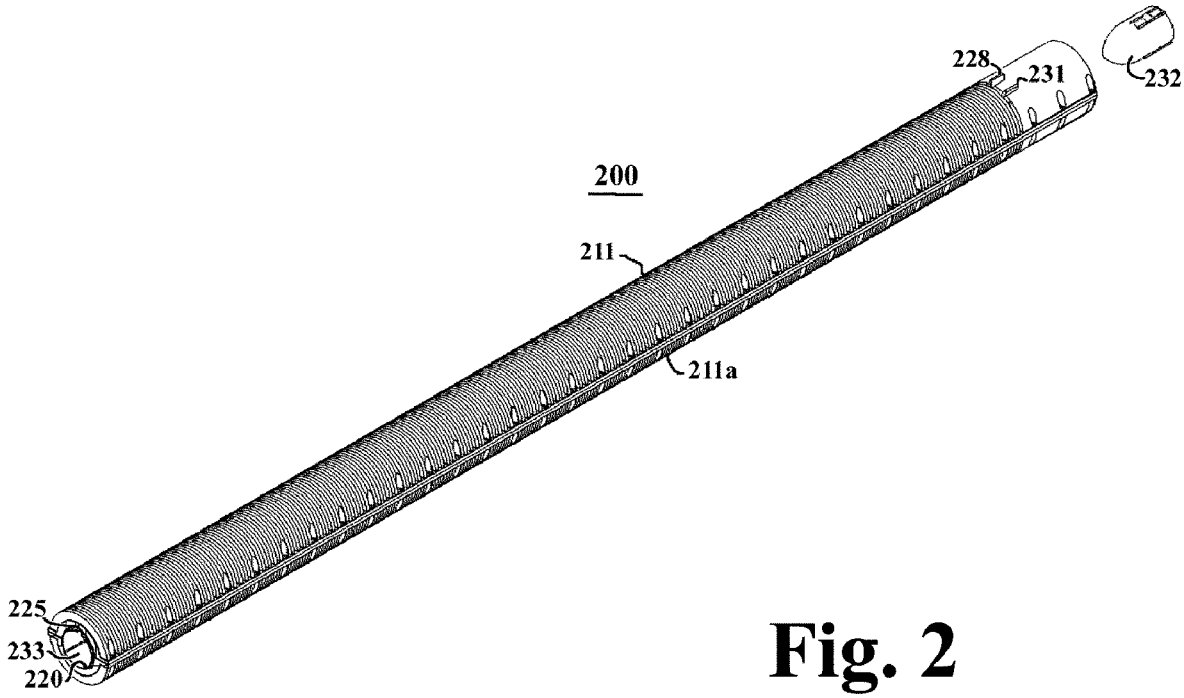
FIG. 2 is an oblique view of an assembled embodiment of the invention which uses armatures that have propulsion bus coils and an armature bus as the propulsion bus-aft shunt circuit means.

FIG. 2 is a view of an assembled shortened electromagnetic propulsion device, 200, with an armature, 232, for use therein proximal its breach end. The barrel has two structural sections, 211 and 211*a*, and at the foreshortened barrel muzzle, the barrel cavity 233 and its barrel cavity shell 220 along with the barrel rail subassembly 225 are indicated. Indicated near the breach end of the accelerator are the connection lugs 228 and 231 of power rails 227 and 230, respectively. Accelerator 200 is shortened at its muzzle by three closely proximal right section planes through the barrel, one of which passes through the barrel sections 211 and 211*a*, the second through the wall conductor assembly 216, and the third through the barrel cavity, 233, shell 220, to permit a more distinct definition of the parts relationship in FIG. 3 of accelerator 200.

Figure 3:
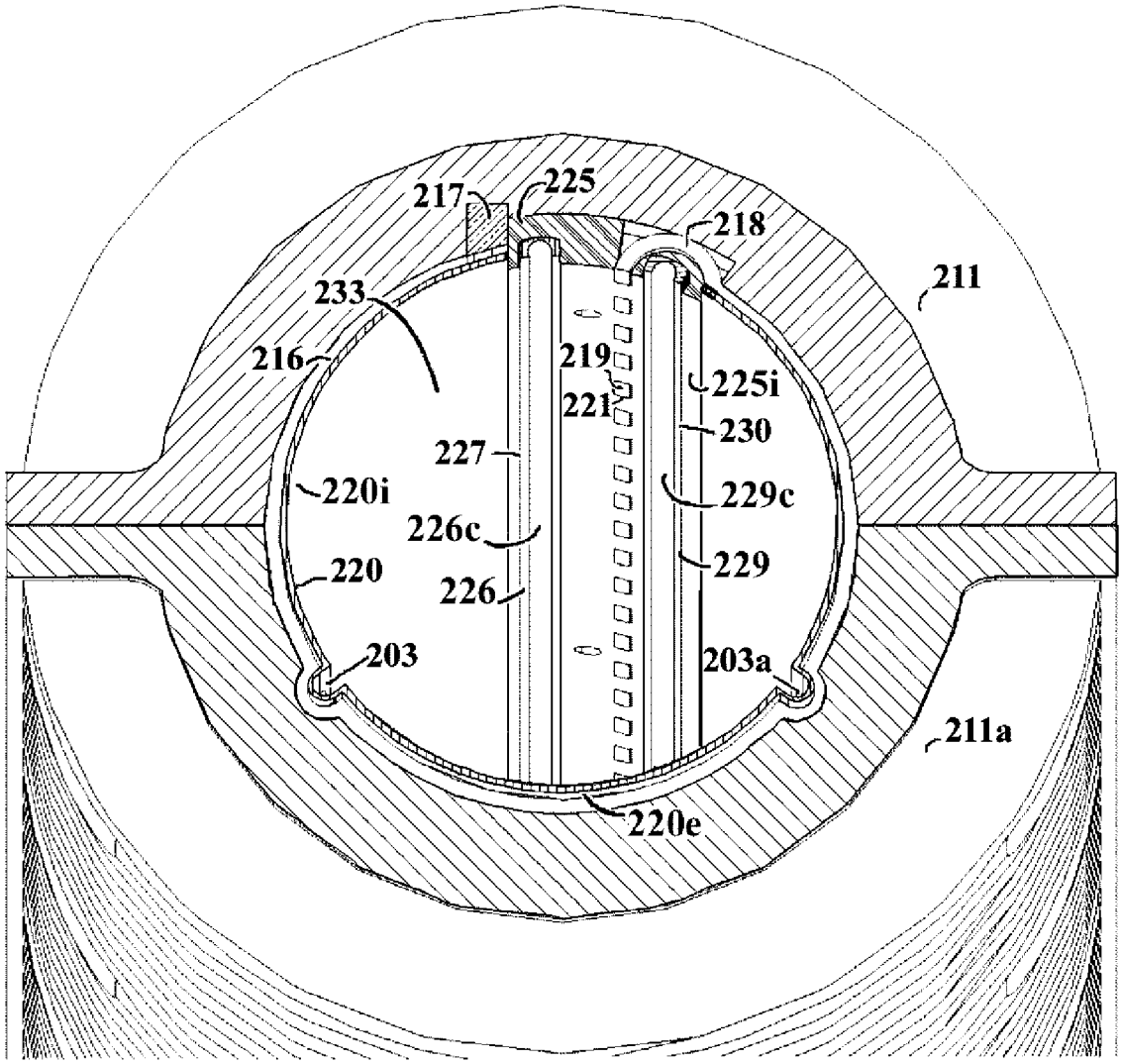
FIG. 3 portrays a view of FIG. 2 up into the muzzle end of the barrel cavity at a 15° angle to the barrel cavity axis.

FIG. 3 is a view at a 15° angle up into the muzzle of accelerator 200. Barrel bus 217 of wall conductor assembly 216 is shown sectioned and a wall conductor 218 is shown in its barrel cavity orthogonal extension from the barrel bus 217 circumscribing most of the barrel cavity 233 at the outer surface 220*e* of barrel cavity shell 220 and terminating in the barrel rail subassembly 225 whereat its contact means 219 extends to the barrel cavity through mating opening 221 in the cavity surface 225*i* continuation of cavity shell 220 surface 220*i* in the rail subassembly 225. Shown are the plurality of wall conductor 218 contact means 219 in their respective openings 221 through barrel cavity 233 surface 225*i* of the rail subassembly 225. The barrel power rail 227, its cavity surface 226 with the its open guide way channel 226*c* its length along with barrel power rail 230, its cavity surface 229 with its open guide way channel 229*c* its length are indicated in their rail subassembly mounting 225. Also shown in figure three are armature guide ways 203 and 203*a* that extend the length of the barrel cavity 233 in its shell 220 for location and traverse therein of armature guides 247 and 247*a*.

Figure 5:
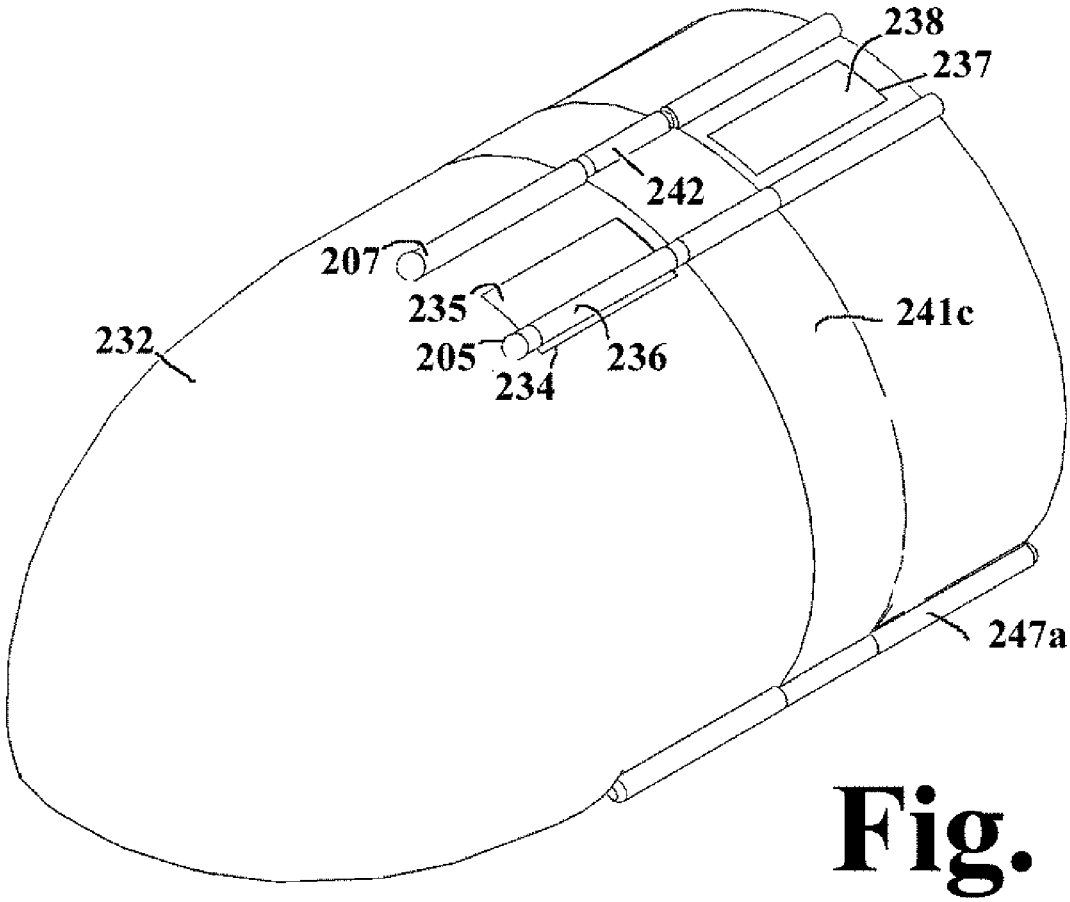
FIG. 5 is an oblique view of an assembled armature for the invention embodiment in FIG. 2.
Figure 6:
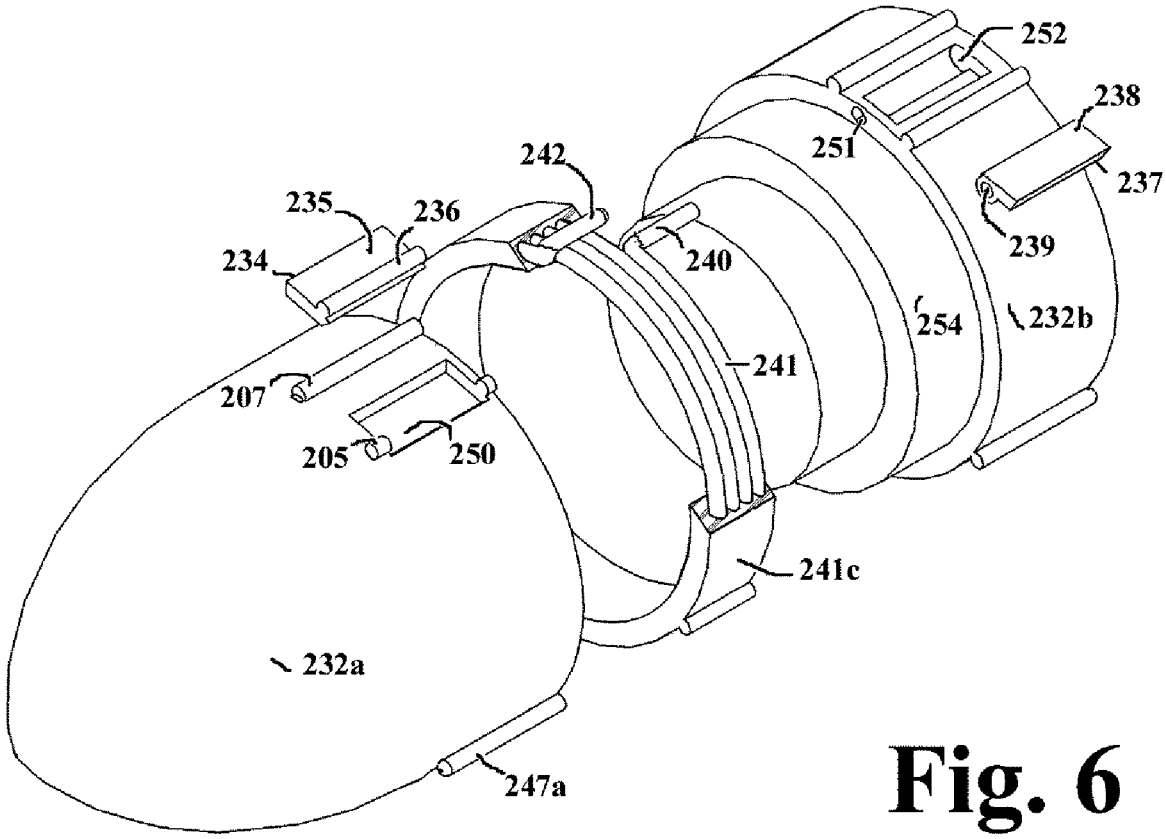
FIG. 6 is an oblique view of the armature in FIGS. 5 disassembled.

Discussing figure three with reference also to armature FIGS. 5 and 6 and with an armature 232 in the barrel cavity, contact means 219 at the armature's location in the barrel cavity 233 have contact with the armature surface proximal the barrel cavity surface 225*i* of the rail subassembly. The wall conductors 218 with contact means 219 on the muzzle side of the propulsion bus coil 241 that have continuous electrical continuity with surface 235 of the armature forward current shunt 234 are forward wall conductor. The wall conductors 218 with contact means 219 on the breach side of the propulsion bus coil 241 that have continuous electrical continuity with surface 238 of the armature aft current shunt 237 are aft wall conductor. Barrel rail subassembly 225 is shown in section along with its mounted barrel power rails 227 and 230 and their respective continuous barrel cavity surfaces 226 with channel 226*c* and 229 with channel 229*c*. which extend the length of the rails and, depending on the design, channels 226*c* and 229*c* extend beyond the barrel power rails. Channels 226*c* and 229*c* along with channels 203 and 203*a* extend the length of the barrel. With an armature in the barrel cavity its guides 207 and 205 travel in open channel 226*c* in power rail 227 cavity surface 226 and open channel 229*c* in power rail 230 cavity surface 229, respectively, to maintain armature orientation. Also, armature forward current shunt 234 surface 236 has continuous electrical continuity with barrel cavity surface 229 of power rail 230 and propulsion bus coil 241 surface 242 has continuous electrical continuity with barrel cavity surface 226 of power rail 227.

Figure 4:
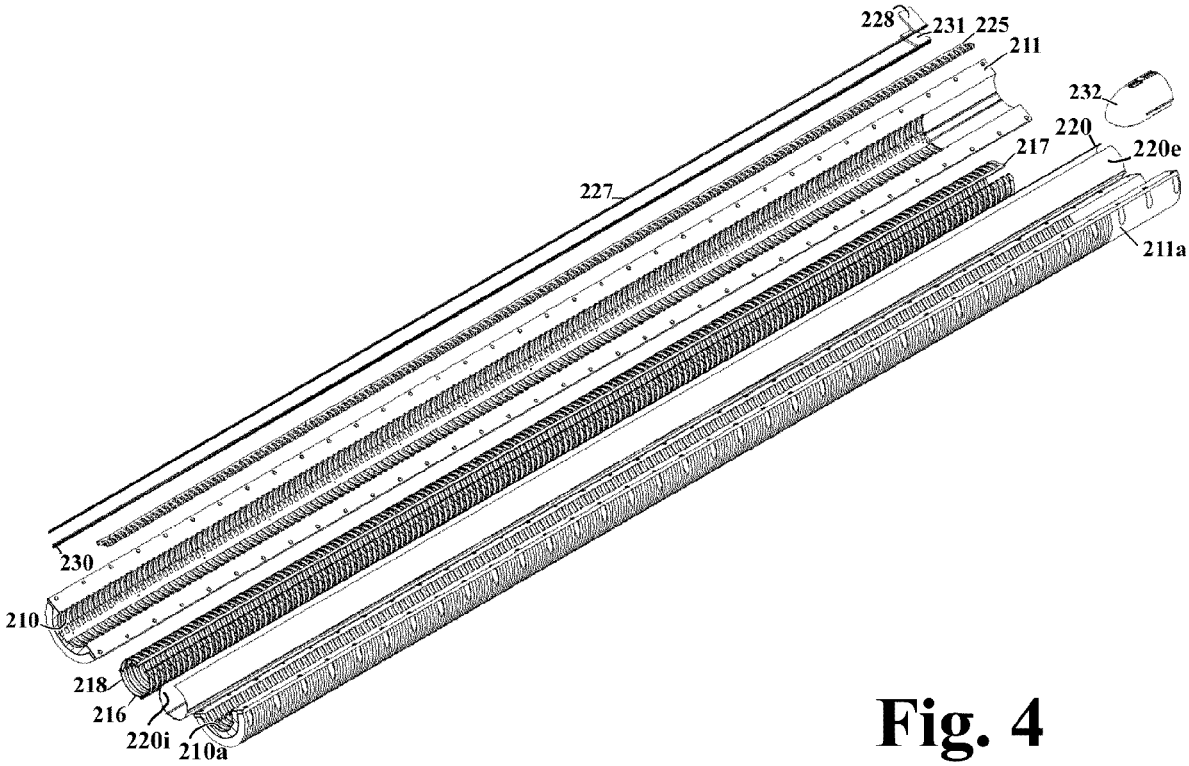
FIG. 4 is an oblique view of the invention embodiment in FIG. 2, disassembled.

FIG. 4 is a view of the magnetic propulsion device 200 in FIG. 4, disassembled. Shown are the two halves of the barrel structure 211 and 211*a* which have at their interior surface channeling 210 and 210*a*, respectively. Rigidly retained in the barrel section 211 channeling 210 is barrel rail subassembly 225 with barrel power rails 227 and 230 therein retained. Channeling 210 in barrel section 211 and channeling 210*a* in barrel section 211*a* in the assembly rigidly retains wall conductor assembly 216 and barrel cavity shell 220. Shown are the wall conductor assembly 216 with it distribution of wall conductors 218 spaced along the barrel bus 217 from breach to muzzle. Also shown are the barrel rail subassembly 225 which has a plurality of spaced openings 221 distributed along its barrel cavity surface length so that in the assembly each opening 221 has a mating wall conductor 218 through it with its contact means 219 at the barrel cavity. Barrel subassembly 225 retains power rails 227 and 230 in the assembly. Said power rails with their connection lugs 228 and 231, respectively, are shown. Shown also is barrel cavity surface shell 220 which is rigidly retained in the assembly within the wall conductor assembly 216 and the interior surfaces of channeling 210 and 210*a* the barrel wall sections 211 and 211*a*, respectively. Also shown in FIG. 4 at the breach end of the disassembly is an armature 232 for the device.

FIG. 5 is a view of an armature 232 for the propulsion device 200. The armature forward current shunt 234 and its surfaces 235 and 236 are indicated and forward current shunt 234 surface 236 is at armature guide 205 whereat it supplants the guide surface. The armature aft current shunt 237 with it surfaces 238 in the armature surface is shown along with the electrically insulating encasement 241*c* of armature propulsion bus 241. Surface 242 of the propulsion coil 241 is shown supplanting armature guide 207 surface. Armature guide 247*a* is also shown. With an armature 232 mounted for propulsion through the barrel cavity 233, partition guide 205 is in mating channel 229*c* in the barrel cavity surface 229 of power rail 230, armature guide 207 is in mating channel 226*c* in the barrel cavity surface 226 of power rail 227, and partition guides 247 and 247*a* are in barrel cavity guide ways, 203 and 203*a*, respectively.

Whether an armature 232 in the barrel cavity 233 is stationary or traversing the cavity, when the armature forward current shunt 234 surface 235 is at the barrel cavity location of the contact means 219 of wall conductor 218 the forward current shunt 234 has continuous electrical continuity with said wall conductor via the continuous electrical continuity of the wall conductor contact means 219 through its barrel cavity opening 221 with surface 235 of the forward current shunt 234 and said wall conductor is among the forward wall conductor while said continuity is extant. When said armature's aft current shunt 237 is at the barrel cavity location of wall conductor 218 contact means 219 through its barrel cavity opening 221, the aft current shunt 237 has electrical continuity with said wall conductor via said contact means 219 electrical continuity with surface 238 of said shunt and said wall conductor is among the aft wall conductor while said continuity is extant. Whether an armature 232 is stationary or traversing a barrel cavity 233, its forward current shunt 234 has continuous electrical continuity with barrel power rail 230 via the continuous electrical continuity of forward shunt 234 surface 236 with cavity surface 229 of power rail 230, and it propulsion bus coil 241 in incasement 241*c* has continuous electrical continuity with barrel power rail 227 via the continuous electrical continuity of propulsion bus 241 surface 242 with the cavity surface 226 of power rail 227.

Figure Six is a view of the armature 232 in FIG. 5 disassembled. Shown is the forward armature section 232*a* which has in its surface open channel 250 in which mounts forward current shunt 234 with its armature surfaces 235 and 236 to provide electrical continuity between power rail 230 and forward wall conductor of the wall conductor assembly. Also the leading ends in the barrel cavity of guides 205 and 207 are indicated. The aft armature section 232*b* has in its surface open channel 252 in which mounts aft armature current shunt 237. Aft armature section 252*b* also has open channel 254 on which in the assembled armature propulsion bus coil 241 in insulating encasement 241*c* mounts. Aft current shunt 237 mounts in open channel 252 and channel 252 has opening 251 to open channel 254 which aligns, when the aft current shunt 237 is mounted in channel 252 with aft current shunt opening 239. Partially shown is the armature propulsion bus coil in its sectioned away insulating casing 241*c*. One end of propulsion coil 241 indicated as 240 is bent parallel the armature axis so that in the assembled armature it extend through aft armature section 232*b* channel 251 into -insulation is removed from this point on-opening 239 of the aft current shunt whereat it is fastened for electrical continuity with the aft current shunt 237. Said bent propulsion coil end 240 functions as the propulsion bus-aft shunt circuit means in the topic device. The other end of the propulsion bus coil 241 in its casing 241*c* is bent up and over the casing to continue in the guide 207 which it supplants and the coil surface insulation is removed thereat revealing propulsion bus surface 242. With an armature in or traversing the barrel cavity 233, the propulsion bus coil via its surface 242 has continuous electrical continuity with the barrel cavity surface 226 of power rail 227.

Figure 7:
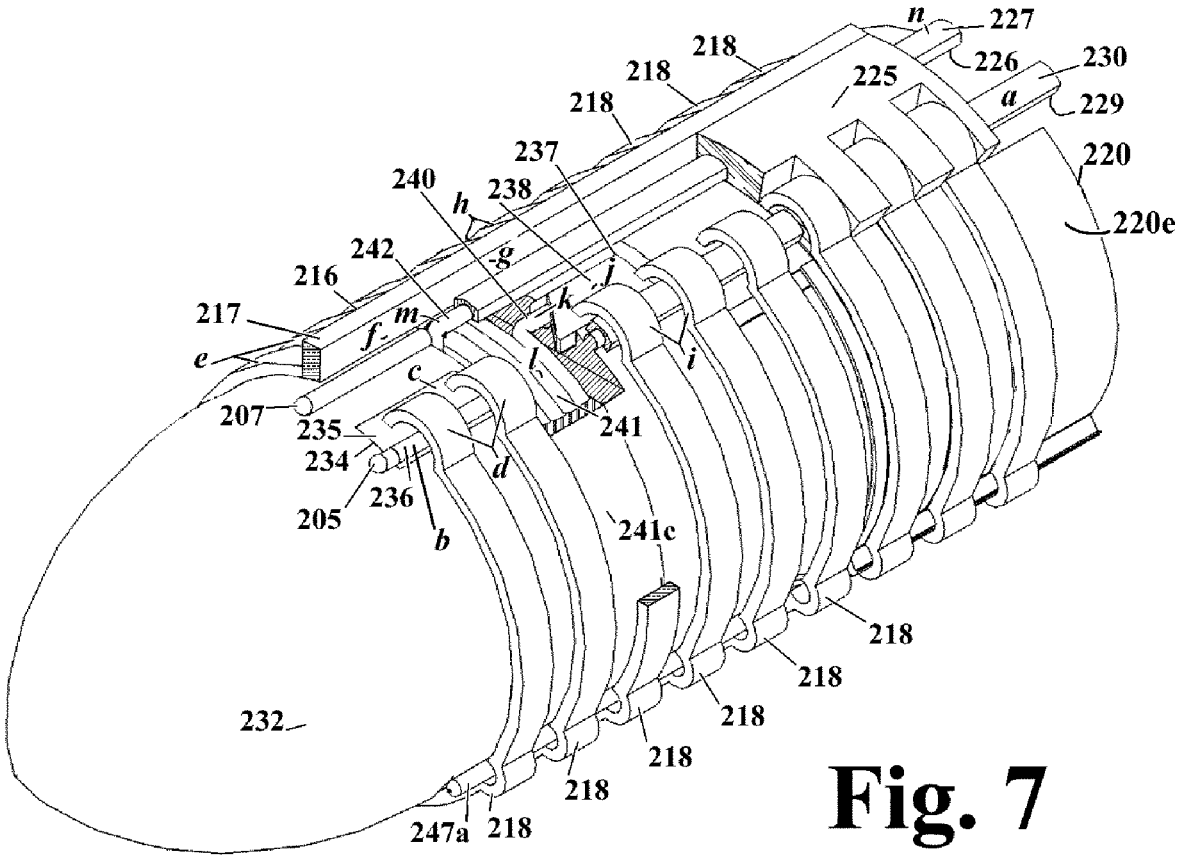
FIG. 7 is an oblique cutaway view of the invention embodiment in FIG. 2 to illustrate the current path.

FIG. 7 is a cutaway sectioned view of the embodiment in FIG. 2, to illustrate the current path therein. Shown are the armature 232 circumscribed by a section of the wall conductor assembly 216 its barrel bus 217 and wall conductors 218 extending therefrom. The wall cavity shell 220 is cut away except at the breach end of the figure. The barrel rail subassembly 225 is shown sectioned away and has barrel power rails 227 and 230 mounted therein and sectioned away. A part of the armature 232 and propulsion bus coil 241 encasement 241*c* is shown cut away (i.e. sectioned away). The armature propulsion bus coil 241 is shown along with its armature current bus end 240 of the propulsion bus-aft shunt circuit means at its continuity with the aft current shunt 237. Also shown is armature propulsion bus 241 surface 242 at its continuity with cavity surface 226 of the barrel power rail 227.

With barrel power rail 230 connected via its connection lug at the breach of the barrel to the positive terminal of an outside power supply, current direction in barrel rail is towards the barrel muzzle; i.e. from 'a' to 'b' in the drawing. The forward current shunt 234 surface 236 at its continuous electrical continuity with cavity surface 229 of power rail 230 is at 'b' in the drawings and the path from 'b' to 'c' is the current path in the forward current shunt 234 from surface 236 to surface 235 and the current path from 'c' to 'd' is from forward current shunt 234 to forward wall conductor via the continuous electrical continuity of surface 235 with the contact means 219 of forward wall conductor which are located at the armature forward current shunt barrel cavity location. The current path in forward wall conductor has a clockwise direction about the barrel cavity and armature and circumscribes a large part of the barrel cavity 233 and armature 232 therein while immediately forward the propulsion bus coil 441 in its encasement 241*c*. The forward wall conductor current path is from 'd' to 'e' in the figure. Current path point 'e' is at the juncture of the forward wall conductor with the barrel bus 217 of wall conductor assembly 216. The magnetic fields of the currents in forward wall conductor interacts with an equal current in each turn of the propulsion bus coil creating forces therein with cavity axis parallel, muzzle directed components. The current path is from 'e' at the forward wall conductor juncture with the barrel bus 217 to the barrel bus current path point 'f' thereat. The current path is breach directed in the barrel bus 217, from 'f' to 'g' in the figure. The current exits the barrel bus to aft wall conductor 218 at said conductor juncture 'h' with the with the barrel bus at 'g'. The current path in aft wall conductor is directed counter clockwise about the barrel cavity and armature therein; i.e. from 'h' to 'i' in the figure. The magnetic fields of the current in aft wall conductor interacts with an equal current in each turn of the armature propulsion bus coil 241 in its encasement 241*c* creating forces therein with cavity axis parallel muzzle directed components. The current path from the aft wall conductor is from 'i' to 'j' at the aft current shunt 237 via the continuous electrical continuity between contact means 219 of aft wall conductor and the aft current shunt 237 surface 238 at its barrel cavity location. Current path in the armature aft current shunt is from 'j' to 'k' where 'k' is at the armature current bus 240 of the propulsion bus-aft shunt circuit means and its continuous electrical continuity with the aft current shunt. Current bus 240 is continuous with the armature propulsion bus coil 241 and indicated at 'l' in the drawing. The propulsion bus coil current path is clockwise; i.e. in the same direction as forward wall conductor current path and opposite the current path direction in the aft wall conductor. The propulsion bus current path is from 'k' to 'l' to 'm' in the figure, where 'm' is at the continuous electrical continuity of propulsion bus coil 241 surface 242 with surface 226 of power rail 227. The current path in power rail 227 is breach directed from 'm' to 'n' in the figure. Barrel power rail 227 is connected via its breach end lug 228 to the return terminal of the outside power supply.

With the polarity of the power rails reversed the current path in power rail 227 is muzzle directed from 'n' to 'm' whereat at said rail's cavity surface 226 has continuous electrical continuity with surface 242 of the propulsion bus coil 241. The current path in the propulsion bus coil is counter clockwise and continues from the propulsion bus coil 'l' to 'k' at the armature current bus 240 of the propulsion bus-aft shunt circuit means and from 'k' to 'j' at the surface 238 of aft current shunt 237 and its continuous electrical continuity with contact means 219 of aft wall conductor 218. The current path in the aft wall conductor is in a clockwise direction about the barrel cavity and the armature therein; i.e. from 'i' to 'h' in the figure. The magnetic fields of the current in aft wall conductor 1<interact with the equal currents in each turn of the armature propulsion bus coil 241 in its encasement 241 creating forces therein with muzzle directed cavity axis parallel components which propel the armature in the barrel cavity towards muzzle. The current path is from aft wall conductors 218 in the figure to the wall assembly barrel bus 217 wherein it muzzle directed; i.e. the current path is from 'h' in the at the aft wall conductor juncture with the barrel bus to 'g' in the barrel bus at said juncture and from 'g' to 'f' in the barrel bus. The current path continues from the barrel bus to forward wall conductor; i.e. the current path passes from the barrel bus at 'f' to the bus juncture with forward wall conductor at 'e'. The current path direction in forward wall conductor is as in the propulsion bus coil, counter clockwise; i.e. in the figure from 'e' to 'c'. The magnetic fields of the current in forward wall conductor also interact with the equal currents in each turn of the armature propulsion bus creating therein forces with cavity axis parallel muzzle directed components that propel the armature in the barrel cavity towards the muzzle. The current path continues from the forward wall conductor through wall conductor 218 contact means 219 at the barrel cavity to forward current shunt 234 surface 235; i.e. from 'd' to 'c' in the figure. The current path in the forward current shunt 234 is from surface 235 to surface 236 at the continuous electrical continuity said surface has with cavity surface 229 of barrel power rail 230; i.e. from 'c' to 'b' in the figure. The current path in power rail 230 is breach directed; i.e. from 'b' to 'a' in the figure. The path exits the power rail 230 to the external power supply return terminal via said rail's lug 231. Regardless the direction of current flow in the circuitry of the device the armature is propelled in the barrel cavity from breach to muzzle.

Figure 8:
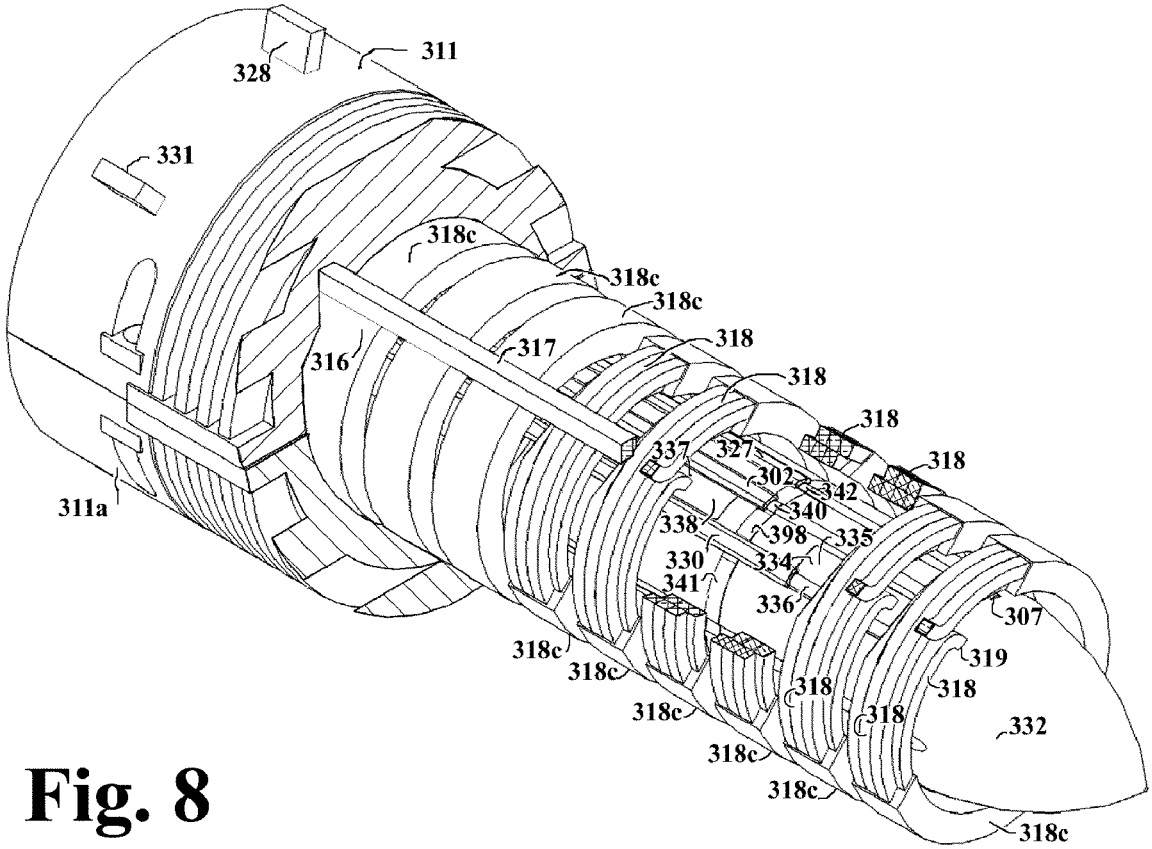
FIG. 8 is an oblique cutaway view of an embodiment of the invention with wall conductor coils, a third barrel rail as part of the propulsion bus-aft shunt circuit means and that uses single conductor propulsion bus armatures.

FIG. 8 is a cutaway section view of an embodiment of the invention which uses wall conductors which are coils. Wall conductor coils 318 have one or more turns about the barrel cavity 333 and its axis and in the assembly the wall conductor coils 318 are mounted in the barrel cavity wall sections 311 and 311*a* channeling 310 and 310*a* with surface in and/or closely proximal the barrel cavity surface. The topic embodiment has an armature 332 similar to the armature in FIG. 1 which has a propulsion bus 341 comprised of a continuous insulated conductor in the armature at its surface and oriented orthogonal the armature axis. With an armature in the barrel cavity 333, its propulsion bus 341 circumscribes most of the armature between its end surface 340 at cavity surface 301 of the third barrel rail 302 whereat it has continuous electrical continuity and it surface 342 at the cavity surface 326 of the barrel power rail 327 where it also has continuous electrical continuity. An auxiliary insulating element 398 is indicated in the figure and affords the propulsion bus further protection from continuity with wall conductor contact means 319 at their path across the surface of the cavity traversing armature. The continuous electrical continuity of rail 302 cavity surface 301 with surface 339 of the aft current shunt 337, the barrel rail 302, and the continuous electrical continuity of propulsion bus 341 end surface 340 with the cavity surface 301 of the barrel rail 302 comprise the propulsion bus-aft shunt circuit means in the device. Between its end at the barrel bus 317 of the wall conductor assembly 316 and its end with contact means 319 at the barrel cavity each wall conductor coil 318 is in an optional rigid insulating encasement 318*c*. The conductors of the coils in the devices discussed-herein; i.e. the magnetic wire of a coil, is itself insulated with non-bonding or self bonding material. The coils when without encasement, are kept closely wound by self bonding insulation, the structure in which they mount, chemical binding or other methods known to practitioner of the relevant arts. The wall conductor coils in the figure are wound counter clockwise from their contact means end 319. Shown in the breach end of the figure are power rail 330 lug 331 and power rail 327 lug 328 to which circuitry from the terminals of an outside power supply connect.

With an outside power supply positive terminal connected to lug 331 and its return terminal connected to lug 328, the current path is muzzle directed in power rail 330 to the forward current shunt 334 where its cavity surface 329 has continuous electrical continuity with surface 336 of said shunt. The path through shunt 334 is from its surface 336 to its surface 335 where the contact means 319 of forward wall conductor 318 has continuous electrical continuity. The path continues in forward wall coil in a counter clockwise direction, around the barrel cavity in each turn of the coil and the magnetic field of the current element at the intersection of an axis plane within the arc extent of the propulsion bus 341 with each turn of forward wall conductor 318 coil interacts with the current element at the intersection of said axis plane with the propulsion bus creating forces therein with cavity axis parallel muzzle directed component. The current path continues from the forward wall conductor coil to the wall conductor assembly 316 barrel bus 317 wherein its direction is towards the breach. The current path diverges from the barrel rail 317 to aft wall conductor 318 and continues in a clockwise direction through each turn of aft wall conductor coil about the barrel cavity and the magnetic field of the current element at the intersection of an axis plane within the arc extent of the propulsion bus with each turn of the aft wall conductor coil interacts with the current element at the intersection of said plane with the propulsion bus creating therein forces with cavity axis parallel muzzle directed components. The current path passes through the continuous electrical continuity of contact means 319 of aft wall conductor with surface 338 of the aft current shunt 337 and therein to surface 339 and its continuous electrical continuity with the cavity surface 301 of barrel rail 302 of the propulsion bus-aft shunt circuit means. The current path in barrel rail 302 is muzzle directed. The current path passes from barrel rail 302 to the armature propulsion bus via the continuous electrical continuity surface 301 of barrel rail 302 has with the end surface 340 of the propulsion bus 341. The third rail 302 and its barrel cavity surface 301 electrical continuities with the aft current shunt surface 339 and the propulsion bus surface 340 comprise the propulsion bus-aft shunt circuit in the device. The current path continues in the propulsion bus 341 in a counter clockwise direction through the arc extent of the propulsion bus 341 to its end surface 342. The magnetic fields of the forward and aft wall conductor (coils) interact with the current in the propulsion bus creating forces in the propulsion bus with axis parallel muzzle directed components that propel the armature 332 through the barrel cavity 333 towards the muzzle. The current path continues from the armature propulsion bus 341 to the barrel power rail 327 via the continuous electrical continuity propulsion bus 341 surface 342 has with the barrel cavity surface 326 of power rail 327. The current path in barrel power rail 327 is breach directed ending at power rail 327 connection lug 328 in the breach end of the barrel. Power rail 327 connection lug 328 is connected to the return terminal of the outside power supply.

When the current direction is reversed; i.e. the positive terminal of the power supply is connected lug 328 and the power supply return terminal is connected to lug 331, current direction in power rail 327 is towards the muzzle. The current passes from barrel rail 327 to the armature propulsion bus 341 wherein it has a clockwise direction about the armature and wherein the magnetic fields of forward and aft wall conductor interact with the current creating forces in the armature propulsion bus with axis parallel muzzle directed components which propel the armature in the cavity towards the muzzle. The current flow is then on to the aft current shunt 337 via the third barrel rail 302 wherein it has a breach direction. The current passes from the armature aft current shunt 337 to aft wall conductor 318 traversing the coil thereof in a counter clockwise direction about the barrel cavity -opposite the propulsion bus current direction- and is one of the two sources of magnetic fields interacting with the propulsion bus current as discussed above. Current flow is from aft wall conductor 318 coil to the wall conductor assembly 316 barrel bus 317 and therein towards the barrel muzzle to forward wall conductor. The current in forward wall conductor coil is clockwise about the barrel cavity -the same direction as the current in the propulsion bus- and the current traversing forward wall conductor coil is the second source of magnetic fields interacting with the propulsion bus current. The current exits forward wall conductor coil to the return power rail 330 via forward current shunt 334, and exits the device via terminal lug 331 which is connected to the return terminal of the outside power supply.

FIGS. 9 through 12 are an embodiment of the invention with cylindrical barrel cavity 433 and armatures 432 which are cylindrical, at least in part, for propulsion therein. In the topic design, wall conductor assembly 416 includes in its plurality of spaced wall conductors 418 distributed along its barrel bus from breach to muzzle, one or more wall conductor which between its end with contact means 419 at the barrel cavity and its ends with physical and electrical continuity barrel bus 417 includes a coil which circumscribes the barrel cavity one or more time. Each wall conductor 418 coils of the wall conductor assembly 417 is in optional rigid insulating material encasement 418*c* for mounting in mating channeling 410 and 410*a* of the barrel sections 411 and 411*a*, respectively.

The armature propulsion bus 441 in the armature 432 is at the armature cylindrical surface that in the barrel cavity 433 is proximal the cavity surface 420*i* of barrel cavity shell 420. The armature propulsion bus 441 between its surface 440 proximal one end and its surface 442 proximal its second end, includes a coil about the armature axis which circumscribes the armature body interior the propulsion bus one or more times. With an armature in the barrel cavity 433, propulsion bus 441 was continuous electrical continuity with the third barrel rail 424 of the propulsion bus-aft shunt circuit means via the continuous electrical continuity of its surface 440 with cavity surface 423 of barrel rail 424 and propulsion bus 441 also has continuous electrical continuity with the barrel power rail 427 via the continuous electrical continuity of its surface 442 with the cavity surface 426 of said rail.

Figure 9:
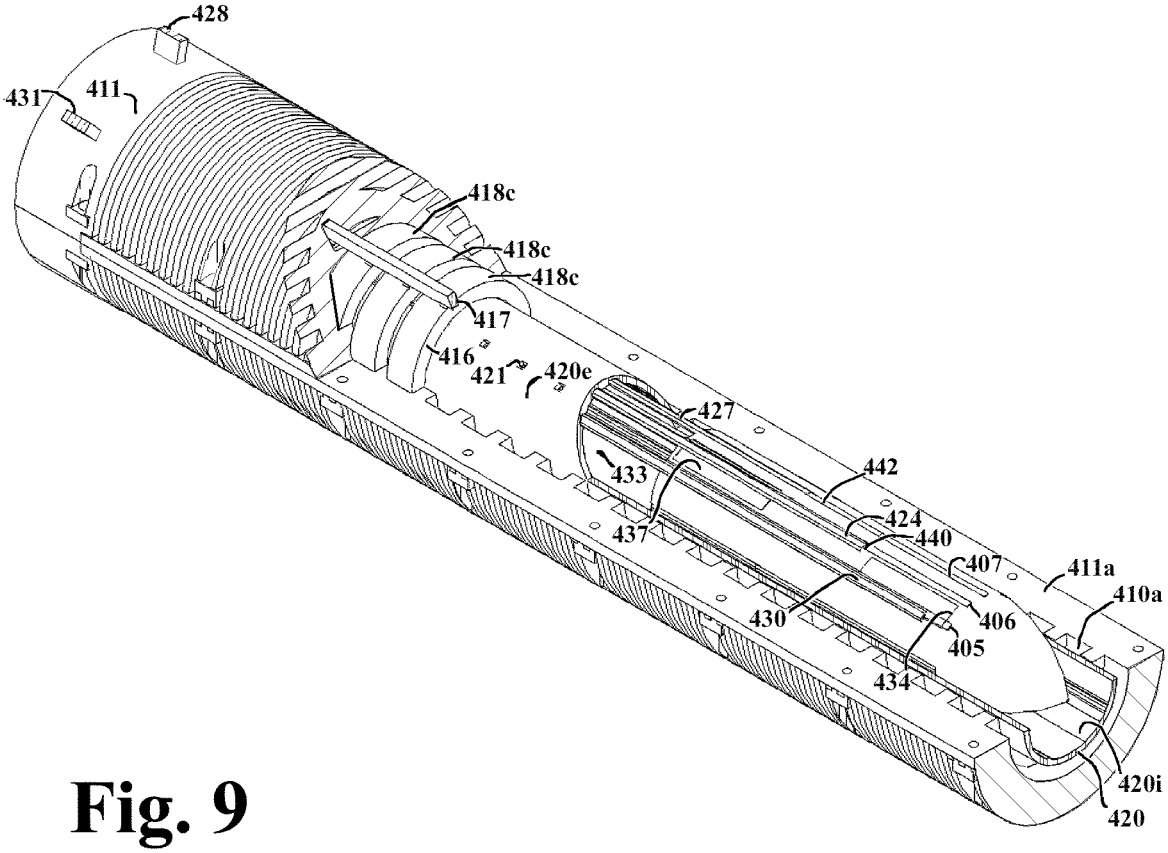
FIG. 9 is an oblique cutaway view of an embodiment of the invention with wall conductor coils, a third barrel rail as part of the propulsion bus-aft shunt circuit means, and that uses armatures with propulsion bus coils.

FIG. 9 is a breach section view of the topic electromagnetic propulsion device, with barrel casing part 411 further sectioned away, most of the wall conductor assembly 416 removed and the cavity shell 420 sectioned away to show an armature 432 in the barrel cavity 433. Shown are the two barrel cavity sections 411 and 411*a* with channeling 410 and 410*a* which in the assembly rigidly retain the wall conductor assembly 416, its wall conductors 418 coils in their encasements 418*c* and barrel cavity shell 420. The wall conductors 418 coils in their encasement 418*c* mount on barrel cavity shell exterior surface 420*e* in their spaced distribution along the length of the barrel cavity. The cavity shell 420 has an opening 421 through it into the barrel cavity 433 at each wall conductor 418 through which the wall conductors contact means 419 extends to the barrel cavity. The power rails 427 and 430, with their connection means 428 and 431, respectively, extending through and out the cylindrical surface at the breach end of barrel section 411 along with third barrel rail 424 of the propulsion bus-aft shunt circuit means, are mounted and retained in the barrel cavity shell 420 and their continuous barrel cavity surfaces, 426, 429, and 423, respectively are in and part of the barrel cavity shell inner surface 220*i*. The barrel cavity surface also has guides extending its length for partition guide ways 447 and 447*a* used to maintain proper armature orientation about the cavity axis while traversing the cavity. In the barrel cavity 433 the armature guides, 405, 406 and 407, in the armature surface are located in the mating open channel 429*c* in cavity surface 429 of power rail 430, open channel 423*c* in cavity surface 423 of barrel third rail 424, and open channel 426*c* of cavity surface 426 of barrel power rail 427, respectively, also to maintain proper armature orientation about the cavity axis. Open channels 429*c*, 423*c* and 426*c* extend the length of the barrel cavity; i.e. depending on design said open channels extend beyond the breach and muzzle end of the barrel rails. The forward and aft current shunts, 434 and 437 at their location in armature 432 barrel cavity proximal cylindrical surface and the propulsion bus surfaces 440 and 442 are indicated in FIG. 9.

Figure 10:
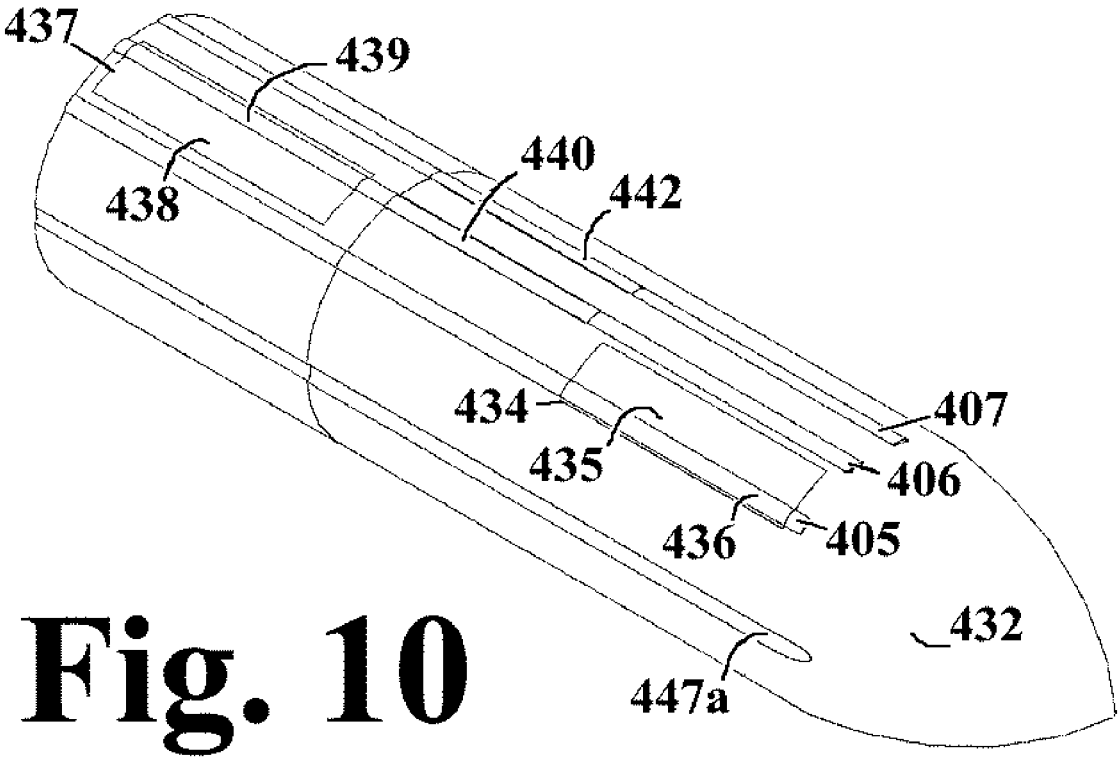
FIG. 10 is an oblique view of a assembled armature for the invention embodiment in FIG. 9.

FIG. 10 is an assembled armature 432 for the electromagnetic propulsion device in FIG. 9. Indicated in the figure are the forward current shunt 434 with its surfaces 435 and 436 in the armature surface. Surface 436, with right section profile like guide 405's, is at and thereat supplants armature guide 405. Therefore, as does partition guide 405, shunt 434 surface 436 is in and travels in mating channel 429*c* in cavity surface 429 of power rail 430 and therein has continuous electrical continuity with power rail 430.

While the forward current shunt's surface 435 is at the contact means 419 at the barrel cavity 433 of a wall conductor 418, the wall conductor is forward wall conductor and there is continuous electrical continuity between said contact means 419 and forward current shunt 434 surface 435. Forward current shunt 434 has, via said continuity, continuous electrical continuity with forward wall conductor and there through with the wall conductor assembly 416. The armature propulsion bus 441 surface 440 in the armature surface at and thereat supplanting guide 406 has like right section profile said guide. With an armature 432 in the barrel cavity 433, armature guide 406 along with propulsion bus surface 440 is in and travels in mating channel 423*c* in the cavity surface 423 of barrel rail 424 of the propulsion bus-aft shunt means and the armature propulsion bus 441 has continuous electrical continuity with barrel rail 424 via the continuous electrical continuity of it cavity surface 423 with the propulsion bus surface 440. The armature propulsion bus 441 surface 442 in the armature surface at and thereat supplanting guide 407 has like right section profile said guide. With an armature 432 in the barrel cavity 433, armature guide 407 along with propulsion bus 441 surface 442 is in and travels in mating channel 426*d* in the cavity surface 426 of barrel power rail 427. The armature propulsion bus 441 has continuous electrical continuity with barrel power rail 427 via the continuous electrical continuity of its cavity surface 426 with propulsion bus surface 442.

Also Indicated in the figure are the aft current shunt 437 with its surfaces 438 and 439 in the armature surface. Surface 439 at and whereat supplanting guide 406 has a right section profile like said guide. In the barrel cavity 433, guide 406 along with aft current shunt 437 surface 439, is in and travels in mating channel 423*c* in cavity surface 423 of the third rail 424 where aft shunt surface 439 has continuous electrical continuity. While the aft current shunt's surface 438 is at a wall conductor contact means 419 location in the barrel cavity the wall conductor is an aft wall conductor and its contact means 419 has continuous electrical continuity with shunt surface 438. The aft current shunt 437, via said continuity, has continuous electrical continuity with aft wall conductor and there through with the wall conductor assembly 416.

Figure 11:
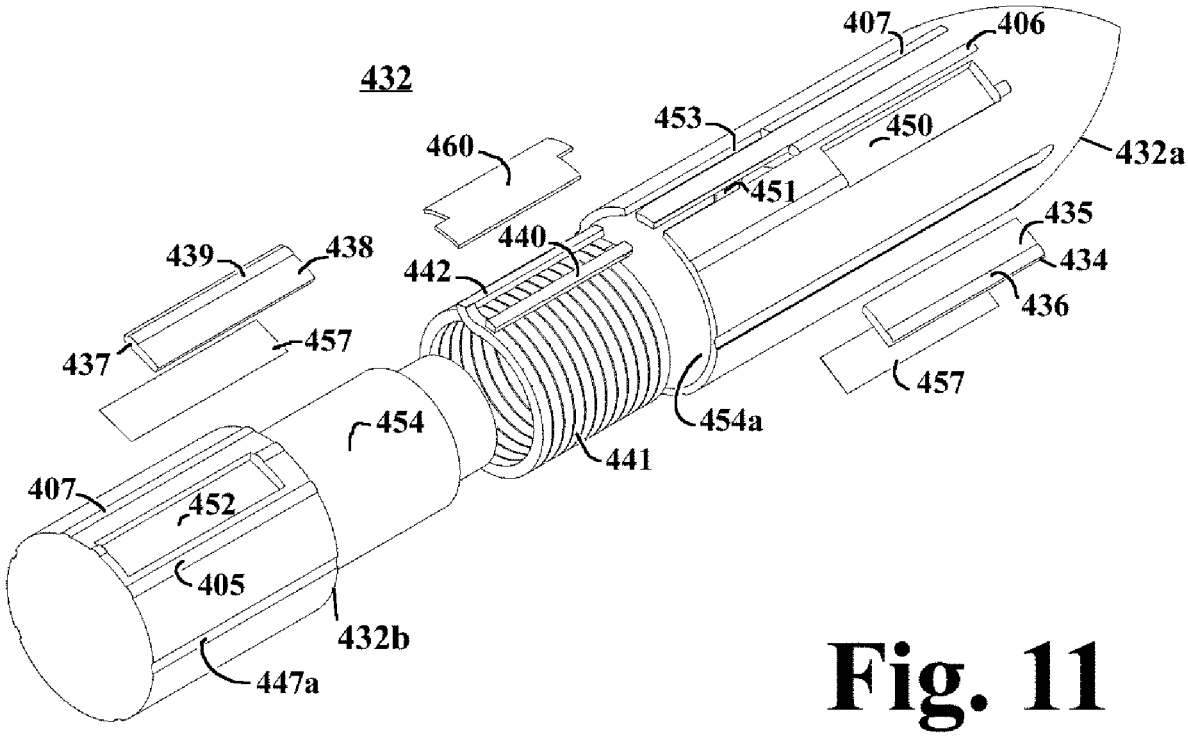
FIG. 11 is an oblique view of the armature in FIG. 10 disassembled.

FIG. 11 is the armature in FIG. 11 disassembled. The aft part 432*b* of the armature 432 has open channel 452 in which aft current shunt 437 mounts and is retained in the assembled armature, and resilient insulating membrane 457 when located in open channel 452 under the aft current shunt provides resilient loading of the shunt surfaces 438 to wall conductor contact means 419 at its barrel cavity location and shunt surface 439 to barrel cavity surface 423 of barrel third rail 424. The coil of propulsion bus 441 mounts on shank 454 of aft armature section 432*b* and the aft portion of the armature 432*b* with propulsion bus mounted on shank 454 fits tightly into open channel 454*a* in the forward armature part 432*a* and is rigidly retained therein. The armature, the propulsion bus coil in wound in a clockwise direction; i.e. the propulsion bus 441 current path winds clockwise about armature shank 454 between surface 440 and 442. Both propulsion bus ends with surface 440 and 442 extend approximately the axial length of the propulsion bus coil in the armature and in the assembled armature are located in open channels 451 and 453, respectively, of the forward armature section 432*a* wherein their surfaces 440 and 442 with like right section profiles at and whereat supplant guides 406 and 407 respectively. The propulsion bus conductor insulation is removed at surfaces 440 and 442. Also shown is auxiliary resilient insulating membrane 460 which when located between the propulsion bus 441 ends with surfaces 440 and 442 and the body of the propulsion bus coil effect an increased loading of said surfaces to the barrel cavity surfaces 423 of third rail 424 and 426 of power rail 427, respectively. The forward part 432*a* of the armature 432 has open channel 450 in which forward current shunt 434 mounts and is retained in the assembled armature, and an auxiliary resilient insulating membrane 457 when located in open channel 450 under the forward current shunt provides resilient loading of the shunt surfaces 435 to forward wall conductor contact means 419 at its barrel cavity location and shunt surface 436 to barrel cavity surface 429 of the barrel power rail 430.

Figure 12:
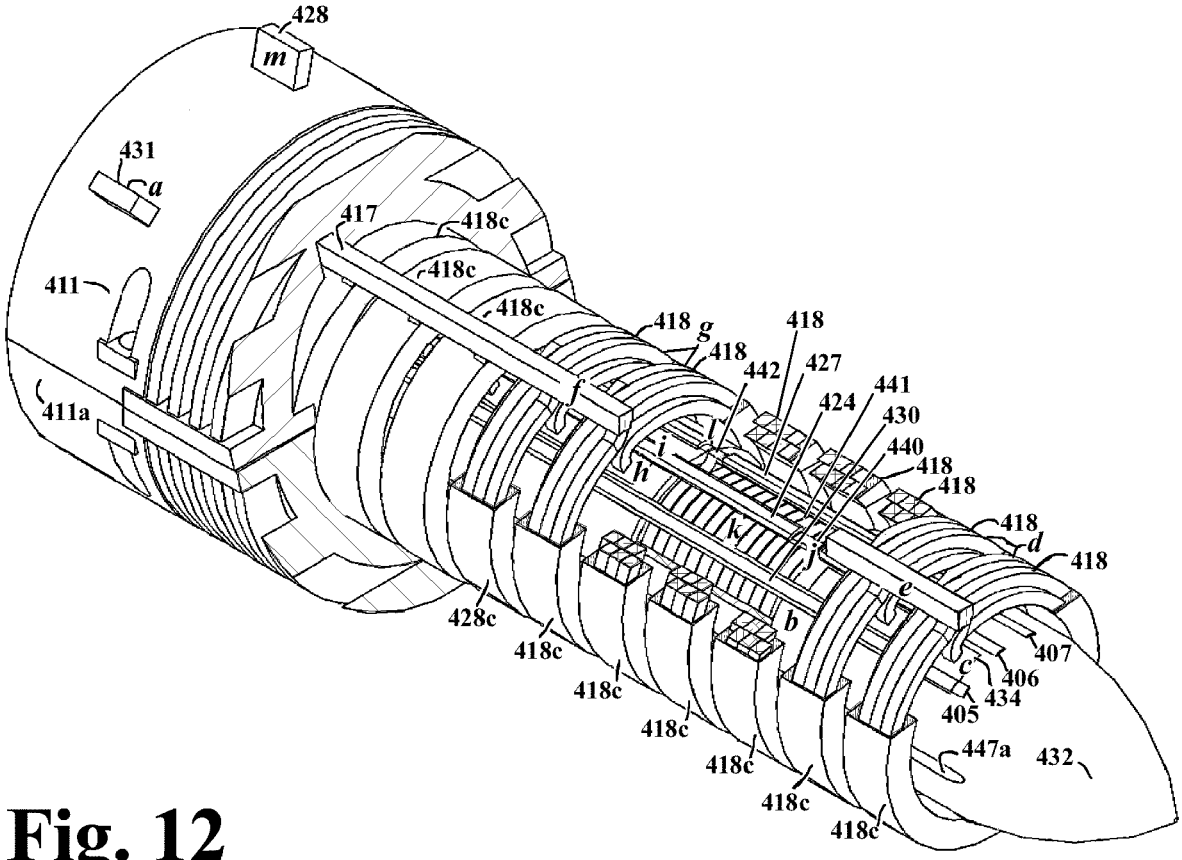
FIG. 12 is an oblique cutaway view of the invention embodiment in FIG. 9 to illustrate the current path.

FIG. 12 is another cutaway sectioned view of the electromagnetic propulsion device in FIG. 9 to indicate the current path. In the figure, barrel cavity shell 420 is removed. Both the coils of the wall conductors 418 and the coil of the armature propulsion bus 441, are wound in a clockwise direction from their contact means 419 and propulsion bus surface 440, respectively. With connection lug 431 of barrel power rail 430 connected to the positive terminal of an outside power supply and connection lug 428 of barrel power rail 427 connected to the return or negative terminal of said power supply, the current path in the device is indicated in the drawing by the italic letters: a, b, c, d, e, f, g, h, i, j, k, l and m. With power supplied to the device the current path is muzzle directed from 'a', the lug 431, to 'b', at the continuous electrical continuity of barrel power rail 430 with forward current shunt 434, via the continuous electrical continuity of said rail's barrel cavity surface 429 with surface 436 of said shunt. The current path continues from 'b' to 'c', at the continuous electrical continuity of forward current shunt 434 surface 435 with the contact means 419 of wall conductors 418, the forward wall conductor, at the instant barrel cavity location of said forward shunt. The current path continues from 'c' through 'd' the forward wall conductor coil wherein the path circumscribes the barrel cavity and armature therein a number of times in a clockwise direction and terminates at 'e' the juncture of forward wall conductor with the wall conductor assembly 416 barrel bus 417. The magnetic fields of the current elements at the intersection of an axis plane with each turn -or fraction thereof- of a forward wall conductor coil act on each current element at said axis plane's interception with each turn -or fraction thereof- of the armature propulsion bus 441 coil, creating forces therein with muzzle directed, cavity axis parallel components; i.e. apparent forces of attraction there between. The current path in the wall conductor assembly 416 barrel bus 417 is in the breach direction from 'e' to 'f'. Current path diverges at 'f', the juncture of aft wall conductor 418 with the barrel bus 417, and continues in aft wall conductor 418 coil, 'g', and therein circumscribes the barrel cavity 433 and armature 432 therein a number of times in a counter clockwise direction before exiting to the armature aft current shunt 437 at 'h' via aft wall conductor contact means 419 continuous electrical continuity with said shunt's surface 438 at said contact means barrel cavity location. The magnetic fields of the current elements at the intersection of an axis plane with each turn -or fraction thereof- of an aft wall conductor coil act on each current element at said axis plane's interception with each turn -or fraction thereof- of the armature propulsion bus 441 coil, creating forces therein with muzzle directed, cavity axis parallel components; i.e. apparent forces of repulsion there between. The current path continues in the aft current shunt 437 from 'h' to 'i' at the continuous electrical continuity of said shunts surface 439 with the cavity surface 423 of barrel rail 424, also referred to as the third rail, of the propulsion bus-aft shunt circuit means. The current path in barrel rail 424 is muzzle directed from 'i' to 'j' whereat rail surface 423 has continuous electrical continuity with surface 440 of the armature propulsion bus. The current path continues in the propulsion bus through the coil of the propulsion bus, 'k', in which it circumscribes the central body of the armature and the armature axis a number of times clockwise and from there on to the propulsion bus surface 442, at 'l'. The magnetic fields of the forward and aft wall conductors interact with the propulsion bus current circumscribing the armature propelling the armature in the barrel cavity from breach toward muzzle. Propulsion bus surface 442 has continuous electrical continuity with the cavity surface 426 of barrel power rail 427. The current path continues in power rail 427 towards the breach and thereat out of the device via lug 428, at 'm'.

With the power connection to the power rail lugs reversed, current flows towards the muzzle in power rail 427 from 'm' at lug 428 to 'l' at surface 442 of armature propulsion bus 441 wherein it continues in the propulsion bus coil, 'k', in a counter clockwise direction wherein the magnetic fields of the forward and aft wall conductor interact with the current creating forces therein which propel the armature in the barrel cavity 433 towards the muzzle. The current path exits the propulsion bus to the barrel rail 424 at 'j' where it continues in the breach direction to 'i' at the armature aft current shunt 437 wherein it continues to 'h' at the contact means end 419 of aft wall conductor 418 with surface 438. The path continues from 'h' at the contact means of aft wall conductor, through 'g', the aft wall conductor coil, wherein it circles the barrel cavity and armature therein a number of times in a clock wise direction and then exits to the aft wall conductor juncture at 'f' with the wall assembly barrel bus 417. The magnetic fields of the current elements at the intersection of an axis plane with each turn -or fraction thereof- of an aft wall conductor coil act on each current element at said axis plane's interception with each turn -or fraction thereof- of the armature propulsion bus 441 coil, creating forces therein with muzzle directed, cavity axis parallel components; i.e. creating apparent forces of repulsion there between. The current path in the barrel bus 417 is towards the muzzle from 'f' to 'e' at the juncture of the barrel bus with the forward wall conductors, in whose coil 'd' the current path continues in a counter clockwise direction and arrives at 'c', the forward wall conductor contact means 419 electrical continuity with the forward current shunt 434 surface 435. The magnetic fields of the current elements at the intersection of an axis plane with each turn -or fraction thereof- of a forward wall conductor coil act on each current element at said axis plane's interception with each turn -or fraction thereof- of the armature propulsion bus 441 coil, creating forces therein with muzzle directed, cavity axis parallel components; i.e. creating apparent forces of attraction there between. The current path continues in the forward current shunt 434 from 'c' to 'b' where it enters barrel power rail 430 and therein is breach directed exiting the device at 'a', the power rail lug 431 connected to the return terminal of the outside power supply.

The electromagnetic propulsion designs discussed to this point have had the armature propulsion bus and the wall conductor assembly forward and aft wall conductors as elements in a series circuit; therefore, wall conductor current therein is limited to the maximum current that can pass through an armature's propulsion bus with its limitations on mass and volume by the armature design constraints such as payload, mass, muzzle velocity, etc. Except when the barrel mass is limited by a requirement for high portability such as in a hand held rifle gun type embodiment of the inventions, the wall conductor current capacities alone could be many times that of an armature for the device. To take advantage of the possibility for much larger current in the barrel wall conductors and the resultant greater magnetic fields densities interacting with armature propulsion bus current to propel the armature in the barrel cavity, the propulsion device has separate power supply circuits for the armature and the wall conductors in the following embodiments and the power is supplied to the two circuits in the assemblies by 2 pairs of barrel power rails not both the same; i.e. three or four power rails.

Figure 13:
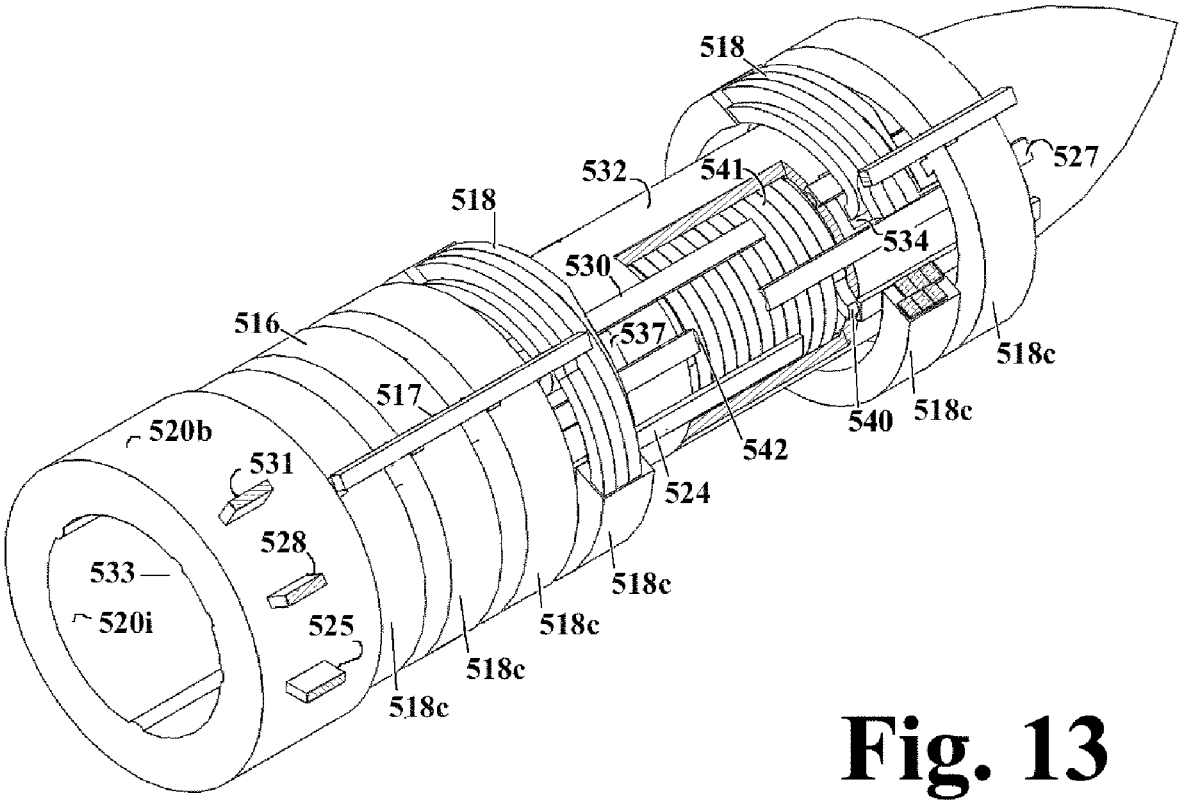
FIG. 13 is an oblique cutaway view of an embodiment of the invention wherein the armature propulsion bus and wall conductors are in separate circuits comprised of two pairs of power rails not both the same which include a third barrel power rail in common and are supplied by separate power supply outputs.

FIG. 13 electromagnetic propulsion device has its barrel casing removed along with the barrel cavity shell 520 and wall conductors 518 in their insulating encasements 518*c*, at armature 532 barrel cavity 533 location. The cavity shell 520 has at its breach end base 520*b* of enlarged radius which mounts in the breach end of the barrel casing and through which extend radially connection lugs 531, 528 and 525 of barrel power rails 530, 527 and 524, respectively. Said lugs are shown cut short and also extend radially through the barrel casing to outside the device in the assembled device for connection to outside power sources. Both the armature propulsion bus 541 coil and the wall conductors 518 are wound clockwise from surface 540 and 519, respectively.

When power rail 530 lug 531 is connected to the positive terminal of an outside high current power source and power rail 524 lug 525 is connected to the positive terminal of a low current power source, and the lug 528 of the barrel power rail 527 which is common to both circuits is connected to both return terminals of said power sources, the wall conductor circuit and the armature propulsion bus circuit are complete. With the power sources on, the current path through the armature propulsion bus 541 is from lug 525 to power rail 524 wherein its direction is towards the muzzle, the current path continues from the power rail 524 to the armature propulsion bus 541 via the continuous electrical continuity of power rail 524 cavity surface 523 with armature propulsion bus surface 540 at the power rail 524. The current path continues in the armature propulsion bus 541 coil circumscribing the armature body and axis in a clockwise direction, and the current therein interacts with the magnetic fields of the current in the forward and aft wall conductor creating forces on the armature with cavity axis parallel, muzzle directed components. The current path continues from the propulsion bus 541 to the barrel power rail 527 via the continuous electrical continuity of surface 542 of propulsion bus 541 with the cavity surface 526 of power rail 527. The current path in barrel power rail 527 is breach directed and exits the devices via connection lug 528 connected to the return terminal of the armature circuit power source. The current path through the forward and aft wall conductors is in power rail 530 from its connection lug 531 at the breach towards the muzzle. The path continues from power rail 530 to the armature's forward current shunt 534, via the continuous electrical continuity of forward current shunt 534 surface 536 with cavity surface 529 of barrel power rail 530. The current path continues in the forward current shunt from surface 536 to surface 535 and therefrom to forward wall conductor 518, via the continuous electrical continuity forward current shunt surface 535 has with contact means 519 at the barrel cavity of wall conductors 518 of forward wall conductor. The current path in forward wall conductor continues from contact means 519 at the barrel cavity, through the wall conductor coil which circumscribes the barrel cavity and armature therein a number of times in a clockwise direction, before merging with the barrel bus 517 of the wall conductor assembly 516. As noted above, the magnetic fields of the current in forward wall conductor 518 coil interacts with the current in the propulsion bus 541 coil creating forces in the propulsion bus with cavity axis parallel, muzzle directed components that propel the armature in the barrel cavity towards the muzzle; i.e. creates apparent forces of attraction between the propulsion bus and forward wall conductor. The current path in the barrel bus 517 continues towards the breach and diverges therefrom into aft wall conductor 518, the current path continues in aft wall conductor coil turns about the barrel cavity 533 and the armature 532 therein in a counter clockwise direction and continues therefrom to the armature aft current shunt 537 via the continuous electrical continuity of the aft wall conductor 518 contact means 519 with surface 538 of said aft current shunt at said contact means barrel cavity location. The magnetic fields of the current in aft wall conductor 518 coil interacts with the current in the propulsion bus 541 coil creating forces in the propulsion bus with cavity axis parallel, muzzle directed components that propel the armature in the barrel cavity towards the muzzle; i.e. creates apparent forces of repulsion between the propulsion bus and aft wall conductor. The current path in the armature's aft current shunt, 538 continues from shunt surface 538 to shunt surface 539 and therefrom to barrel power rail 527 via the continuous electrical continuity of shunt surface 539 with cavity surface 526 of power rail 527. The current path in power rail 527 is breach directed and through power rail 527 lug connection 528 to the return terminal of the circuits external high current power source.

When the outside power sources have their positive terminal connected to the common power rail 527 of the device, current supply to the armature is from the power source supply for the armature through lug 528 into power rail 527. The current path in power rail 527 is muzzle directed and therefrom continues into the armature propulsion bus 541 via power rail 527 cavity surface 526 continuous electrical continuity with the propulsion bus surface 542. The current path in armature 541 coil circumscribes the armature axis a number of times in a counter clockwise direction and therein the magnetic fields of the current circulating in the current paths in the forward and aft wall conductor interact with the current in said propulsion bus path creating forces therein with muzzle directed, cavity axis parallel components. The current path exits the propulsion bus 541 coil to barrel power rail 524 via the continuous electrical continuity its surface 540 has with cavity surface 523 of barrel power rail 524. The current path continues in Power rail 524 towards the breach and therefrom through lug 525 to the negative terminal of the armature outside power source. The current path for the wall conductor circuit is from the positive terminal of the outside power source for said circuit through lug 528 to the power rail 527 and therein muzzle directed. The current path continues from power rail 527 to aft current shunt 537 via the continuous electrical continuity of barrel rail 527 cavity surface 526 with aft shunt surface 539. The current path continues from the aft current shunt 537 to aft wall conductor via the continuous electrical continuity of aft current shunt surface 538 with the contact means 519 of aft wall conductor at the barrel cavity location of said aft current shunt surface. The current path continues in the aft wall conductor coil in a clockwise direction about the barrel cavity and armature therein and exits therefrom to the barrel bus 517 of the wall conductor assembly 516. The magnetic fields of the current in said path in aft wall conductor 518 coil interacts with the current in armature propulsion bus 541 coil creating forces therein with cavity axis parallel muzzle directed components. The current path continues in the barrel bus towards the muzzle and diverges therefrom into the forward wall conductor 518 coil wherein it continues in a counter clockwise direction about the barrel cavity and armature therein. The current in said path in the forward wall conductor interacts with the current in the armature propulsion bus coil creating forces therein with cavity axis parallel muzzle directed components. The current path continues from the forward wall conductor coil to the armature forward current shunt 534, via the continuous electric continuity of forward wall conductor 518 contact means 519 with forward current shunt 534 surface 535 at said contact means cavity location. The current path continues from the forward current shunt 534 to barrel power rail 530 via the continuous electrical continuity of forward current shunt surface 536 with the cavity surface 529 of power rail 530. The current path in the power rail 530 is towards the breach and from there out via power rail lug 531 to the negative terminal of the power supply for the wall conductor circuit.

Figure 14:
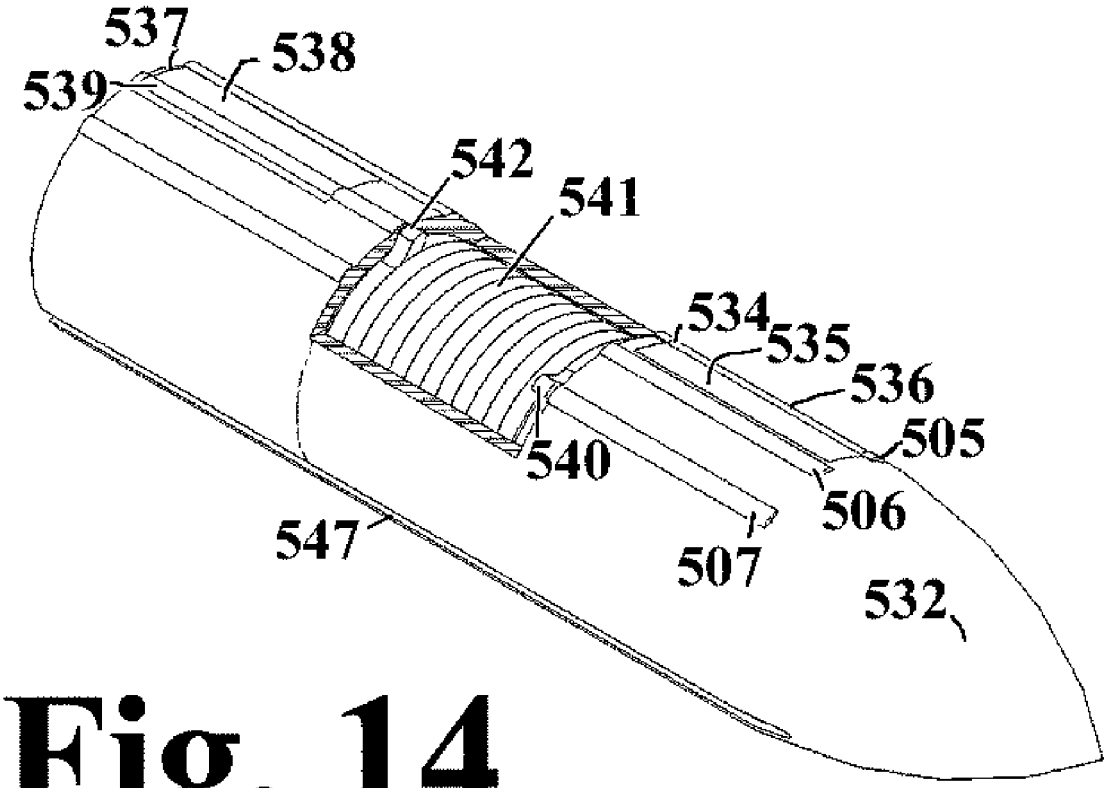
FIG. 14 is an oblique cutaway view of an armature for the invention embodiment in FIG. 13.

FIG. 14 is an armature 532 for the embodiment in FIG. 13 with the armature surface at the armature propulsion 541 bus coil partially cutaway. Indicated are the propulsion bus 541 surfaces 540 and 542 at and whereat supplanting the armature guides 507 and 506, respectively. Forward current shunt 534 with surface 535 that in the barrel cavity has continuous electrical continuity with contact means 519 of forward wall conductor 518 at said shunt barrel cavity 533 location along with forward current shunt surface 536 at and whereat supplanting armature guide 505. Forward current shunt surface 536 has continuous electrical continuity in the barrel cavity 533 with cavity surface 529 of barrel power rail 530. Also indicated are the armature's aft current shunt 537 with surface 538 that in the barrel cavity has continuous electrical continuity with contact means 519 of aft wall conductor 518 at said shunt's barrel cavity location. The aft shunt's surface 539 at and whereat supplanting armature guide 506 is indicated. In the barrel cavity 533, aft current shunt 537 surface 539 has continuous electrical continuity with cavity surface 526 of barrel power rail 527.

Figure 15:
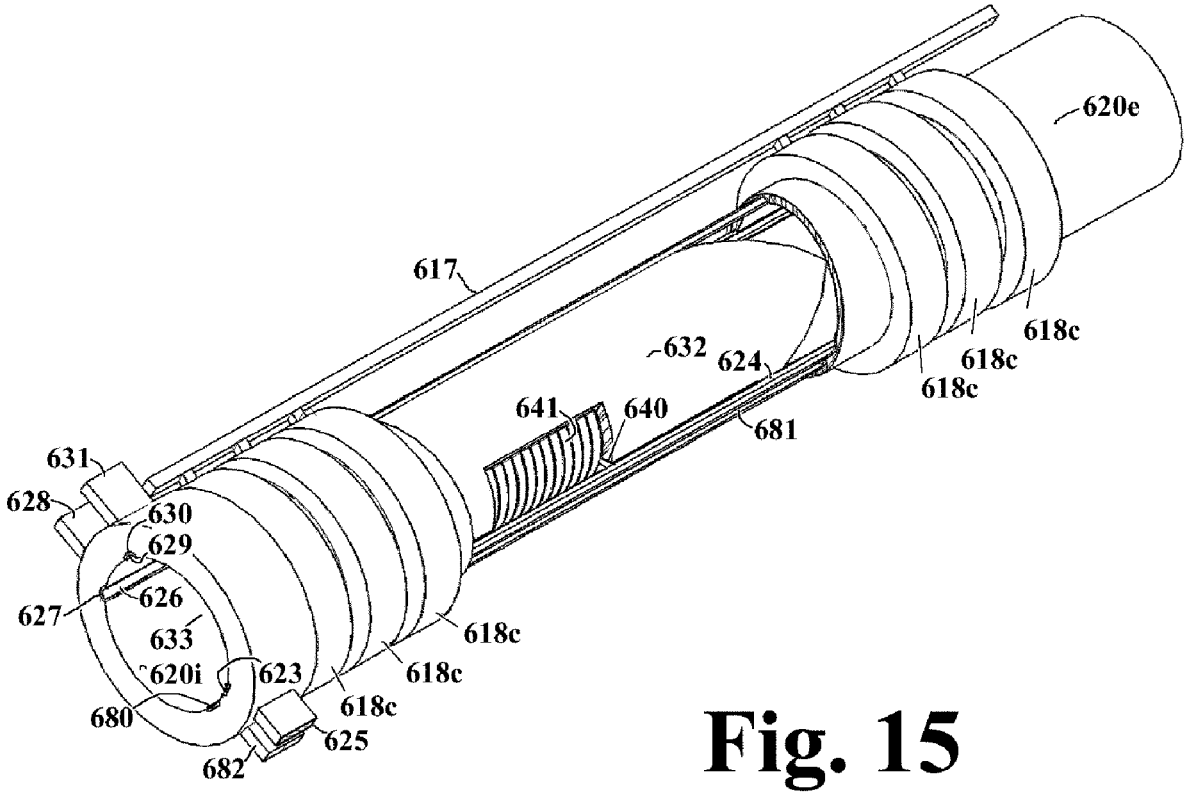
FIG. 15 is an oblique cutaway view of an embodiment as in FIG. 13, but wherein the wall conductor circuit is supplied power by two barrel power rails and the armature propulsion bus circuit is supplied by to two additional barrel power rails.

FIG. 15 is another embodiment of the invention with separate current supply circuits for the armature propulsion bus and wall conductors. Although the embodiment has a fourth power rail, it has the advantage of permitting greater isolation between the two power circuits and less complex power supplies and circuits therefrom. Shown is a breach section the barrel cavity shell 620 with outer shell surface 620*e* and inner shell surface 620*i*, the barrel cavity surface. The barrel casing sections 611 and 611*a* have been removed, and the barrel cavity shell 620 along with wall conductors 618 in their insulating structural encasement 618*c* mounted on the outer cavity shell surface 620*e* have been sectioned away at the armature 532 location in the barrel cavity, 633. Two pairs of power rails, one pair 627 and 630 with outside power source connection lugs 628 and 631, respectively, and the second pair 681 and 624 with outside power source connection lugs 682 and 625 respectively, with the barrel cavity surfaces 626 and 629 of the first power rail pair, respectively, located approximately diametric across the barrel cavity 633 from the cavity surfaces 624 and 680 of the second power rail pair, respectively, supply power to the wall conductor circuit and the armature propulsion bus circuit, respectively. The power rails are so located to reduce the possibility of arcing between conducting elements of the two circuits due to dirt and/or moisture in the barrel cavity. Armature surface at the armature propulsion bus coil is sectioned away to indicate the propulsion bus coil location and its surface 640 continuity with power rail 624.

Figure 16:
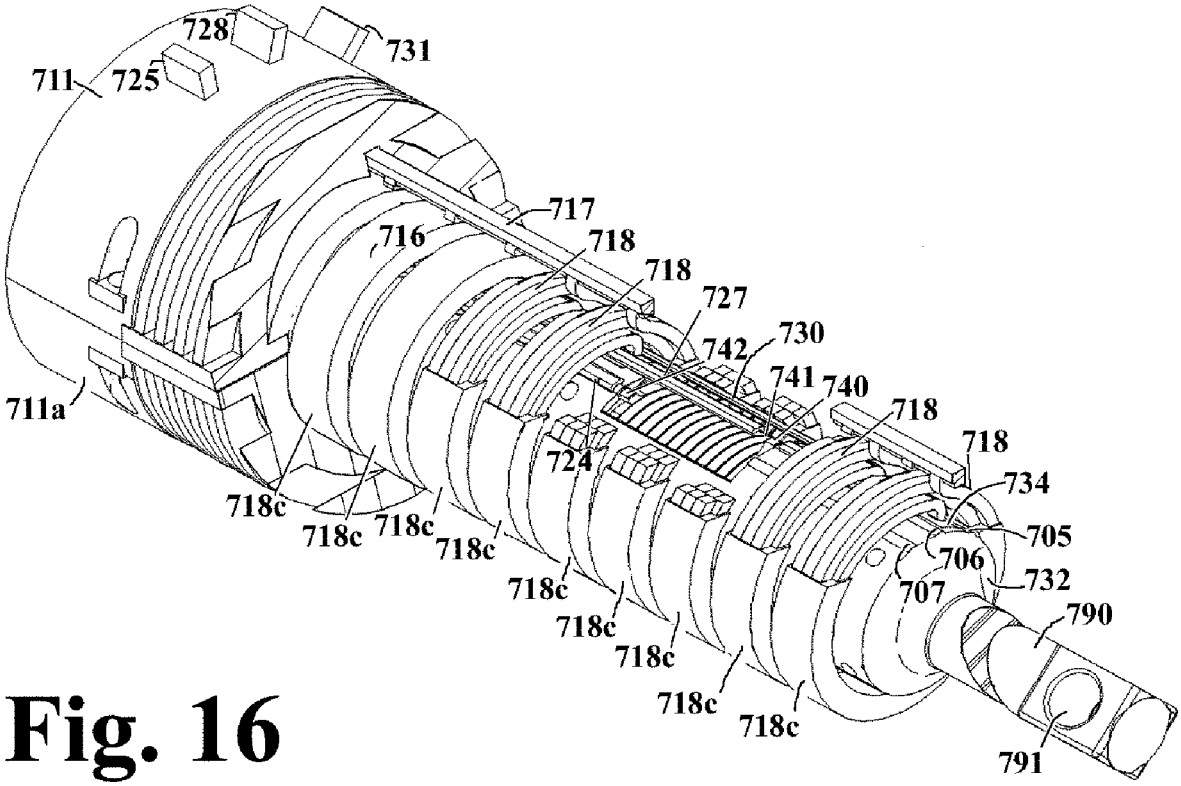
FIG. 16 is an oblique cutaway view of the embodiment of the invention portrayed in FIG. 13 but wherein the armature and barrel have been modified for repetitive low friction use as a bidirectional electromagnetic motor or actuator.
Figure 17:
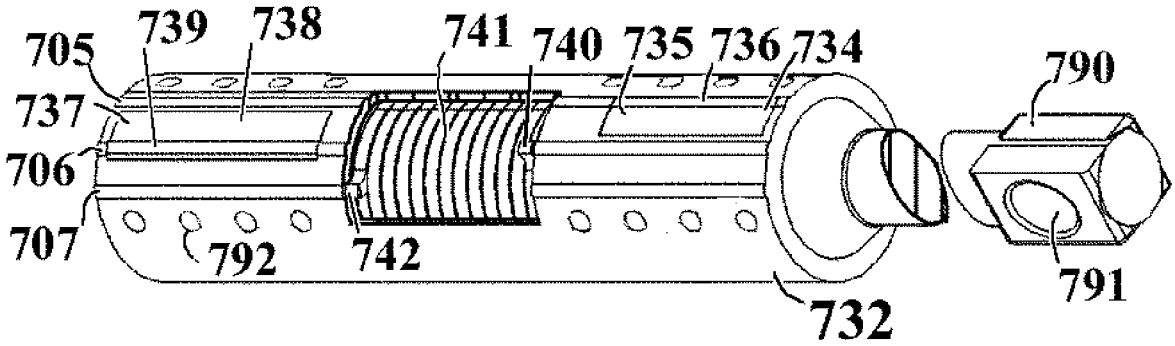
FIG. 17 is an oblique cutaway view of the armature for the invention embodiment in FIG. 16.
Figure 18:
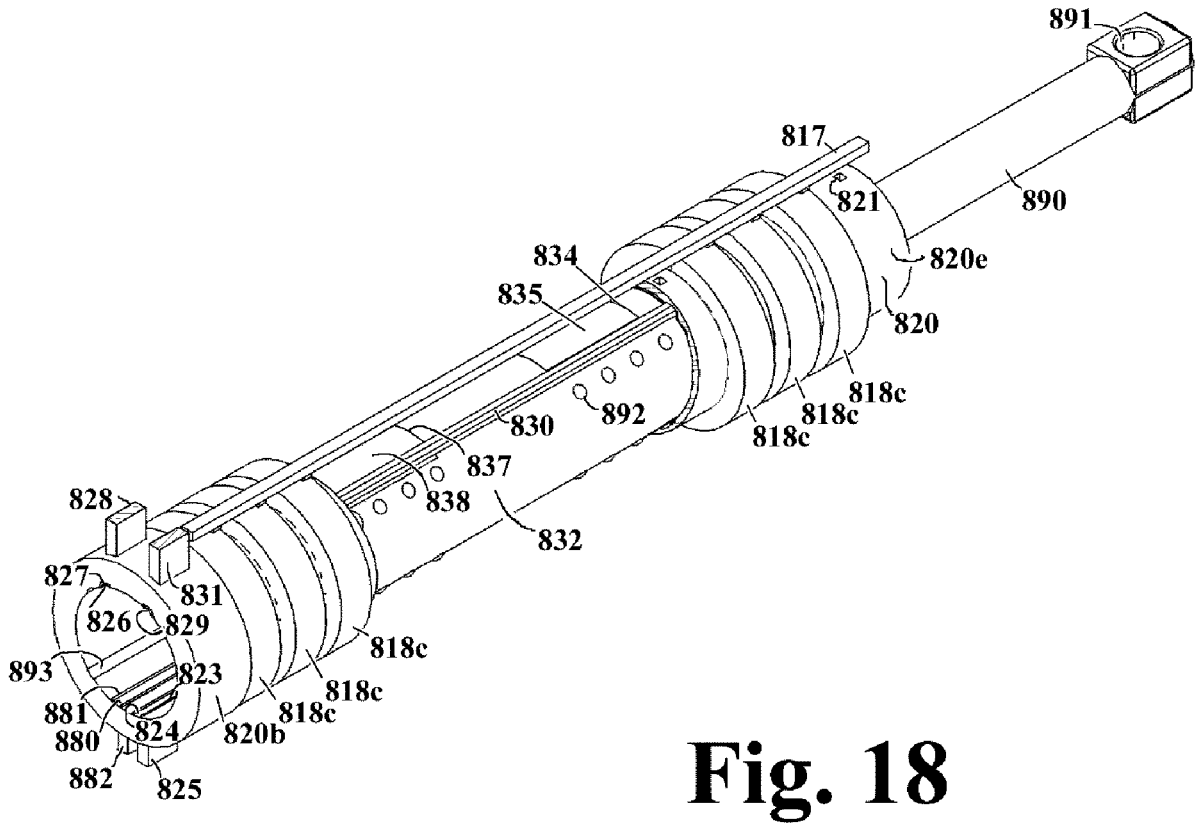
FIG. 18 is an oblique cutaway view of the invention portrayed in FIG. 15 but wherein the armature and barrel have been modified for repetitive low friction use as a bidirectional electromagnetic actuator or motor.

With the wall conductor circuit and its conducting circuit elements separate and isolated from the propulsion bus circuit and its conducting elements, the direction of the powered traverse of an armature in the barrel cavity can be reversed by reversing the power source polarities at the input terminals of either the propulsion bus circuit or the wall conductor circuit permitting use of the armature in the barrel cavity, not as a projectile but as a powered bi-directional actuator piston or motor armature retained in the barrel cavity for many cycles of service. FIGS. 16 through 18 illustrate embodiments of the invention used as a bidirectionally powered actuator or motor.

FIG. 16 is an embodiment of the invention similar to FIG. 13 used as an actuator or motor. The armature 732 has a shaft 790 extending axially from its muzzle end with connection means 791. The shaft 790 is shortened in the drawing by sectioning. The armature propulsion bus 741 includes a coil that is wound clockwise from it breach end surface 742 at power rail 724 barrel cavity surface 723 whereat it has continuous electrical continuity, to surface 740 at the muzzle end of the coil located at power rail 727 whereat it has continuous electrical continuity with the barrel cavity surface 726 of said rail. Barrel power rails 724 and 727 of the armature propulsion bus circuit have connection lugs 725 and 728 to which the isolated power source terminals external the invention connect. The armature circuit in the invention is comprised of lug 725, power rail 724, cavity surface 723 of power rail 724, and its continuous electrical continuity with surface 742 of armature propulsion bus 741, the armature propulsion bus 741 coil-wound clockwise and from breach end to muzzle end, the armature propulsion bus surface 740, the continuous electrical continuity of surface 740 with cavity surface 726 of barrel power rail 727, barrel power rail 727, and said power rail's connection lug 728 at the breach end of the barrel.

When the power lug 725 is connected to the positive output terminal of the isolated power source for the armature circuit -which includes current limiting means- and power lug 728 is connected to the return terminal of said power source, current flow in the armature propulsion 741 bus coil is clockwise. When the power lug 725 is connected to the return terminal of said power source, and the power lug 728 is connected to the positive terminal of said power source, current flow in the armature propulsion bus 741 coil is counter clockwise.

The wall conductor circuit in the invention is comprised of lug 731, power rail 730, barrel cavity 733 surface 729 of said power rail, and its continuous electrical continuity with surface 736 of the armature forward current shunt 734, forward current shunt's surface 735 continuous electrical continuity with wall conductors -the forward wall conductor- via said conductor's contact means 719 at the barrel cavity 733 at said shunts barrel cavity location, the forward wall conductor 718 coil which circumscribes the barrel cavity 733 and the armature 732 therein a number of times, in a counter clockwise direction between its end with contact means 719 and its end at and physically and electrically continuous with barrel bus 717 of the wall conductor assembly 716, the wall conductor assembly 716 barrel bus 717, wall conductors -the aft wall conductor- which, between the wall conductor's physical and electrical continuity at one end with barrel bus 717 and its contact means 719 at the barrel cavity at the armature aft current shunt 737 surface 738 barrel cavity location on its other end, circumscribes the barrel cavity 733 and the armature 732 therein a number of times in a clockwise direction, the aft current shunt whose surface 738 has continuous electrical continuity with aft wall conductor via said conductors contact means 719 at the barrel cavity aft current shunt location, aft current shunt 737, the continuity of aft current shunt 737 with barrel power rail 727 via the continuous electrical continuity of said shunt's surface 739 with the cavity surface 726 of barrel power rail 727, and the connection lug 728 of barrel power rail 727.

When the power lug 731 is connected to the positive output terminal of the isolated power source for the wall conductor circuit and power lug 728 is connected to the return terminal of said power source, current flow in forward wall conductor coil is counter clockwise, in the barrel bus in the breach direction and in aft wall coil is clockwise. With terminal 725 connected to the positive output terminal of the low current power supply for the armature circuit and terminal 728 the said power supply's return terminal current propulsion 741 bus coil is clockwise and the magnetic field of current in the forward wall conductor and aft wall conductor interacts with the current in the propulsion bus creating therein forces with breach directed, cavity axis parallel component; i.e. apparent forces of repulsion between forward wall conductor coil and propulsion bus coil and apparent forces of attraction between aft wall conductor coil and the propulsion bus coil are extant.

When power lug 728 is connected to the positive output terminal of the isolated power source for the wall conductor circuit—and power lug 731 is connected to the return terminal of said power source. The current flow in the aft wall conductor coil is in the counter clockwise direction, the current direction in the barrel bus 717 is towards the muzzle and the current in forward wall conductor coil is in the clockwise direction. The magnetic fields of the currents in the aft wall conductor interacts with the current in the armature propulsion bus 741 creating therein forces with muzzle directed, cavity axis parallel components. The magnetic fields of the currents in forward wall conductor interact with current in the armature propulsion bus 741 creating therein forces with cavity axis parallel, muzzle directed components; i.e. apparent forces of repulsion between aft wall conductor coil and the propulsion bus coil and forces of attraction between forward wall conductor coil and the propulsion bus coil are extant. While lug 728 is positive with reference lug 725, the armature propulsion bus current is ccw and the armature's direction of propulsion indicated above with the given wall conductor circuit polarities are reversed.

FIG. 17 is the armature 732 in FIG. 16, with the armature's shaft extension 790 with connection means 791 foreshortened by section. Elements 792 are roller ball elements which travel in mating cavity axis parallel raceways in the cavity surface 720*i* of the cavity shell 720 wall and maintain low friction alignment of the armature in the barrel cavity. The armature surface at propulsion bus 741 coil is cut away showing the coil and the armature propulsion bus surfaces 740 and 742 at its ends which are at and whereat supplant guides 706 and 707, respectively. Propulsion bus 741 coil end surfaces, 740 and 742 in the barrel cavity have continuous electrical continuity with barrel cavity surface 726 and 723 of barrel power rails 727 and 724, respectively.

FIG. 18 is an actuator or motor version of the embodiment in FIG. 15 showing a section of the device at the breach with the barrel casing sections 811 and 811*a* removed and the barrel cavity shell 820 and wall conductors 818 in their encasements 818*c* sectioned away at the location of armature 832 in the barrel cavity 833. Low friction roller balls 892 in the armature travel in cavity axis parallel raceways 893 in the cavity shell 820 cavity surface, 820*i*. The actuator rod or armature extension 890 on the muzzle end of armature 832 is indicated alone with its connection means 891.

Power rails 827 and 830 with connection lugs 828 and 831, respectively, for connection to an external power source for the wall conductor circuit are indicated along with cavity surface 826 of power rail 827 and cavity surface 829 of power rail 830 of said circuit. Indicated are the forward current shunt 834 and its surface 835 which has continuous electrical continuity with forward wall conductor 818 contact means 819. Forward current shunt 834 surface 836 has continuous electrical continuity with the barrel cavity surface 826 of power rail 827. The aft current shunt 837 is indicated along with its surface 838 which has continuous electrical continuity with aft wall conductor 818 contact means 819. Aft current shunt 837 surface 839 has continuous electrical continuity with cavity surface 829 of barrel power rail 830. Barrel power rail 824 and 881 which supply power to the propulsion bus coil circuit are indicted at the breach end of the barrel cavity 833 along with their barrel cavity surfaces 823 and 880. With the complete separation of the set of power rails in the armature circuit propulsion bus circuit and from the set of power rails in the wall conductor circuit in this actuator or motor embodiment less design sophistication is required in the external power sources for the two said circuits.

FIGS. 19 through 23 are of embodiments and elements thereof wherein the armature propulsion effecting means is comprised of a permanent magnet polarized in the cavity axis direction and with its center in the cavity axis direction mounted in the armature forward of the aft armature current shunt and aft of the forward current shunt and with its central axis coincident the armature axis. The magnet as the armature's propulsion effecting means replaces the armature propulsion effecting means in the preceding embodiments comprised of armature propulsion bus and associated circuit elements including propulsion bus-aft shunt circuit means, power rails, connection lugs, and power source.

Figure 19:
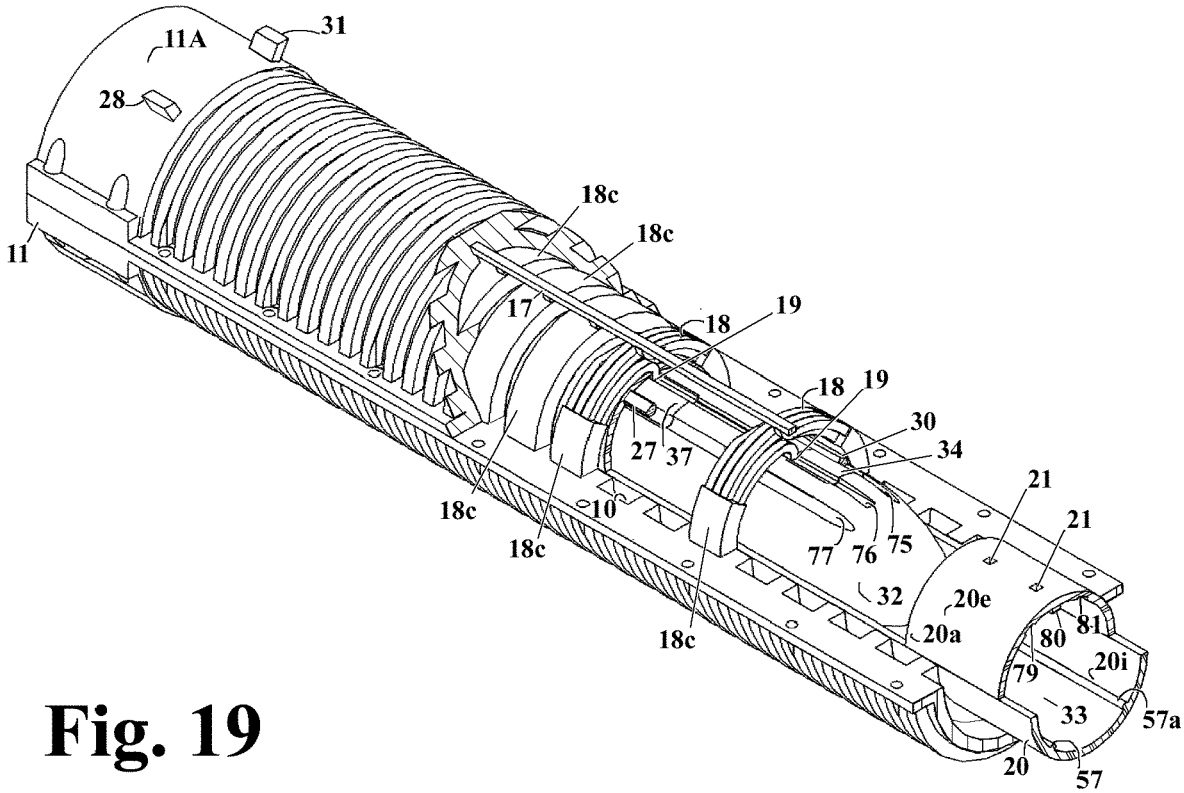
FIG. 19 is an oblique cutaway view of an embodiment of the invention wherein the armature propulsion bus and associated circuitry is replaced by a permanent magnet polarized in the armature axis direction.

FIG. 19 is a breach end section of an electromagnetic propulsion embodiment used to propel armature projectiles 32 with polarized permanent magnets as their propulsion effecting elements. The barrel is comprised of two casing sections 11 and 11*a* which have channeling 10 and 10*a* in which mount the plurality of spaced wall conductors 18 in their individual auxiliary encasements 18*c* distributed from breach to muzzle along the wall conductor assembly 16 barrel bus 17 with which they each have physical and electrical continuity at one end. The inner circumference of wall conductor 18 coils in their encasements 18*c* mount on the outer surface 20*e* of the casing shell 20, and the shell 20 mounts in and is retained by the inner circumference surface of the assembled barrel casing sections 11 and 11*a*. The barrel cavity 33 is enclosed by the barrel cavity shell comprised of two parts 20 and 20*a*. Barrel cavity shell half 20*a* is cut away and the wall conductors removed to show the armature 32 in barrel cavity 33. An openings 21 in the barrel shell half 20*a* is at each wall conductor 18 and extend through guide 80 in the barrel cavity surface 20*i* into the barrel cavity 33. The end of each wall conductor 18 coil with contact means 19 extends through the opening 21 at its cavity shell 20 location to the barrel cavity 33 for continuous electrical continuity therein with armature current shunt surfaces at its cavity location. Continuous electrical continuity between a wall conductor 18 and an armature's forward current shunt 34 is extant when said shunt's surface 35 is at said wall conductor 18 coil contact means 19 barrel cavity 33 location and when so said wall conductor 18 is a forward wall conductor. Continuous electrical continuity between a wall conductor 18 contact means 19 and an armature's aft current shunt 37 is extant when said shunt's surface 38 is at said wall conductor 18 contact means 19 barrel cavity 33 location and when so said wall conductor 18 is an aft wall conductor. The cavity shell 20*a* has channels 79 and 81 its length which are parallel the cavity axis and in which power rails 27 and 30, respectively, are mounted. With an armature projectile 32 in the barrel cavity 33, power rail 27 is in and travels in guide way 77 in the armature's surface and the cavity surface 26 of barrel power rail 27 in armature channel 77 has continuous electrical continuity with the armature aft current shunt 37 surface 39 which whereat supplants channel 77 and power rail 30 is in and travels in guide way 75 in the armature 32 surface and its barrel cavity surface 29 therein has continuous electrical continuity with the armature forward current shunt 34 surface 36 which whereat supplants guide way 75. The armature's forward current shunt 34 has surface 35 at and whereat supplanting guide way 76 and the armature's aft current shunt 37 has surface 38 at and whereat supplanting guide way 76. The armature guide 80 in the cavity inner surface 20*i* through which an openings 21 extends to the barrel cavity at each wall conductor 18 with said conductor's contact means 19 therein, is in and travels in the guide way 76 of an armature 32 in the barrel cavity 33. The wall conductor 18 contact means 19 through guide 80 in armature guide way 76 at the barrel cavity location of the armature's forward and aft armature current shunts, 34 and 37, respectively, have continuous electrical continuity with said shunt's surfaces, 35 and 38, respectively. When an armature 32 is in the barrel cavity 33, shell half 20 partition guides 57 and 57*a*, which are cavity axis parallel and extend the barrel cavity length, are in and travel in partition guide ways 47 and 47*a* to maintain proper orientation of the armature during its traverse of the barrel cavity. At the breach end of the barrel power rails 30 and 27 have connection lugs 31 and 28, respectively.

With an armature in the barrel cavity and the positive terminal of an outside power source connected to connection lug 31, and the return terminal of said power source connected to connection lug 28, the current path in the propulsion device is from power lug 31 through power rail 30 towards the muzzle and therefrom to the armature forward current shunt 34 via the continuous electrical continuity the power rail barrel cavity surface 29 has with surface 39 of forward current shunt 34 in armature guide way 75. The current path continues in the forward current shunt 34 from surface 36 to surface 35 in the armature guide way 76 wherein surface 35 has continuous electrical continuity with the contact means 19 of wall conductors 18, forward wall conductor, at the instant armature forward current shunt barrel cavity 33 location. The current path in forward wall conductor 18 coils, between their end with contact means 19 and their end with physical and electrical continuity the wall conductor assembly 16 barrel bus 17, circumscribes the barrel cavity and armature therein in a ccw direction creating apparent magnetic fields in the forward wall conductor coils with north pole towards the muzzle and south pole towards the breach. The current path in barrel bus 17 is towards the breach and diverges therefrom into wall conductor 18, aft wall conductor, with contact means 19 at and with continuous electrical continuity the instant barrel cavity location of surface 38 of aft current shunt 37. The current path in aft wall conductor 18 coils, between their end with contact means 19 and their end with physical and electrical continuity the wall conductor assembly 16 barrel bus 17, circumscribes the barrel cavity and armature therein in a cw direction creating apparent magnetic fields in the aft wall conductor coils with north pole towards the breach and south pole towards the muzzle. The center of permanent magnet 41 in the armature is located between the forward and aft current shunt with its north pole towards the muzzle and south pole towards the breach. The armature magnet north pole is attracted to the south pole of the forward wall conductor coils propelling the armature towards the barrel cavity 33 muzzle and the armature magnet 41 south pole is at the south pole of the aft wall conductor coils and is thereby repulsed propelling the armature towards the barrel cavity 33 muzzle. The current path continues in aft current shunt from surface 38 to surface 39 in armature guide way 77 wherein it has continuous electrical continuity with surface 26 of the barrel power rail 27. The current path in barrel power rail 27 is in the breach direction to lug 28 connected to the return terminal of the power source.

Figure 20:
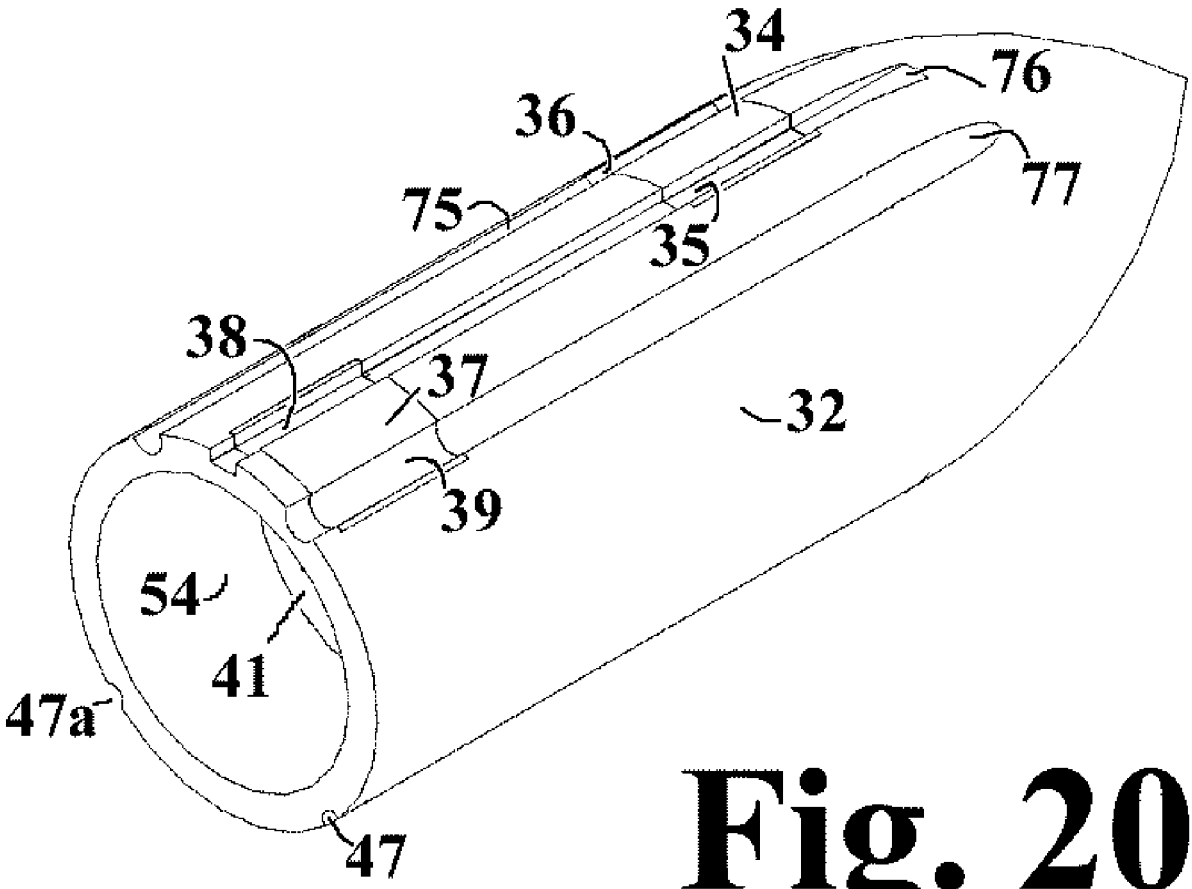
FIG. 20 is an oblique view of an armature for the invention embodiment in FIG. 19.

FIG. 20 is an assembled armature for propulsion in the device in FIG. 19. Channel 54 in the breach end of armature 32 has magnet 41 pressed and retained therein with center between the forward and aft current shunt locations along the length of the armature. Guide way 76 in the armature surface for barrel cavity surface guide 80 and wall conductor 18 contact means 19 therein along with surfaces 35 and 38 therein of forward and aft current shunts, 34 and 37, respectively are indicated in the drawing. The armature surface guide ways 77 and 75 for the barrel power rails 27 and 30, respectively, are shown along with the forward current shunt 34 surface 36 in guide way 75 and aft current shunt 37 surface 39 in guide way 77.

Figure 21:
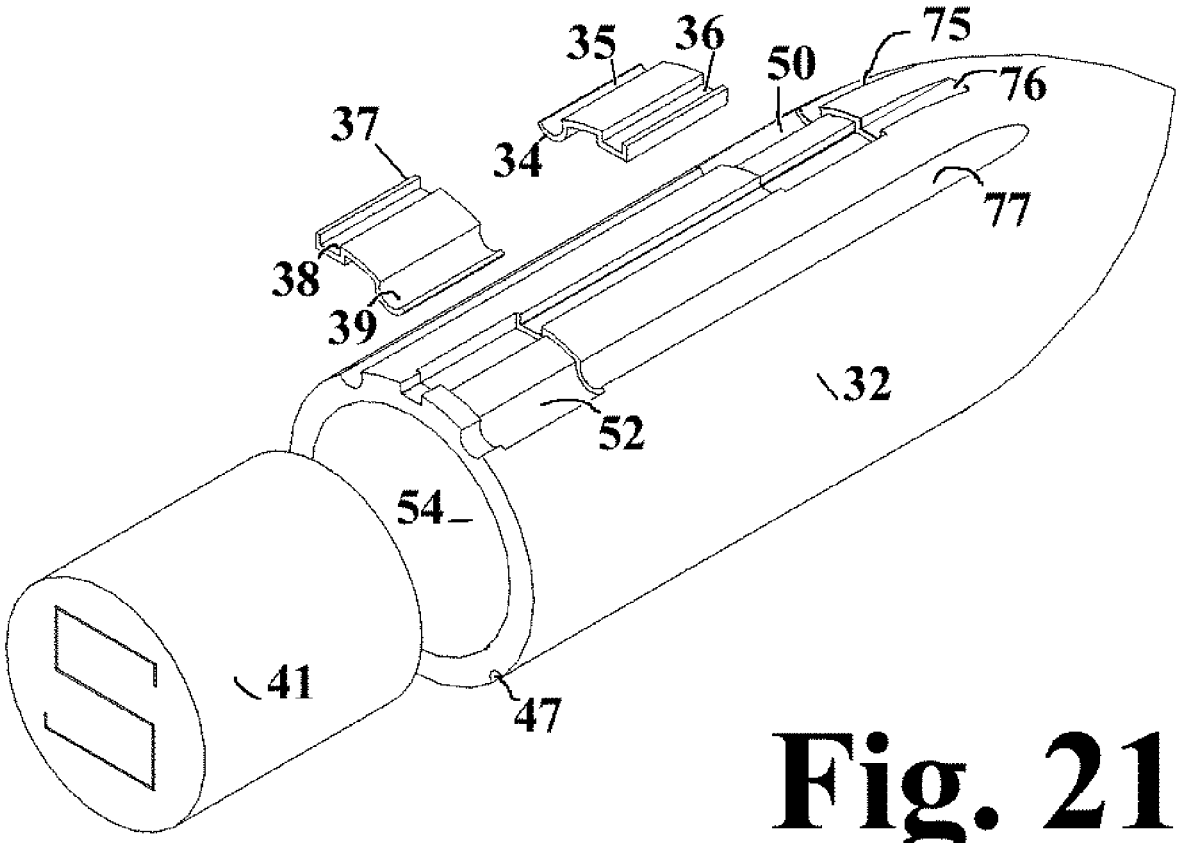
FIG. 21 is an oblique view of the armature in FIG. 20 disassembled.

FIG. 21 is a view of the armature in FIG. 20 disassembled. Shown are the magnet 41 and cylindrical opening 54 in the breach end of armature 32 into which the magnet is pressed and retained. Also shown are forward current shunt 34 and open channel 50 in the armature surface in which it mounts and aft current shunt 37 and open channel 52 in the armature surface in which it mounts.

Figure 22:
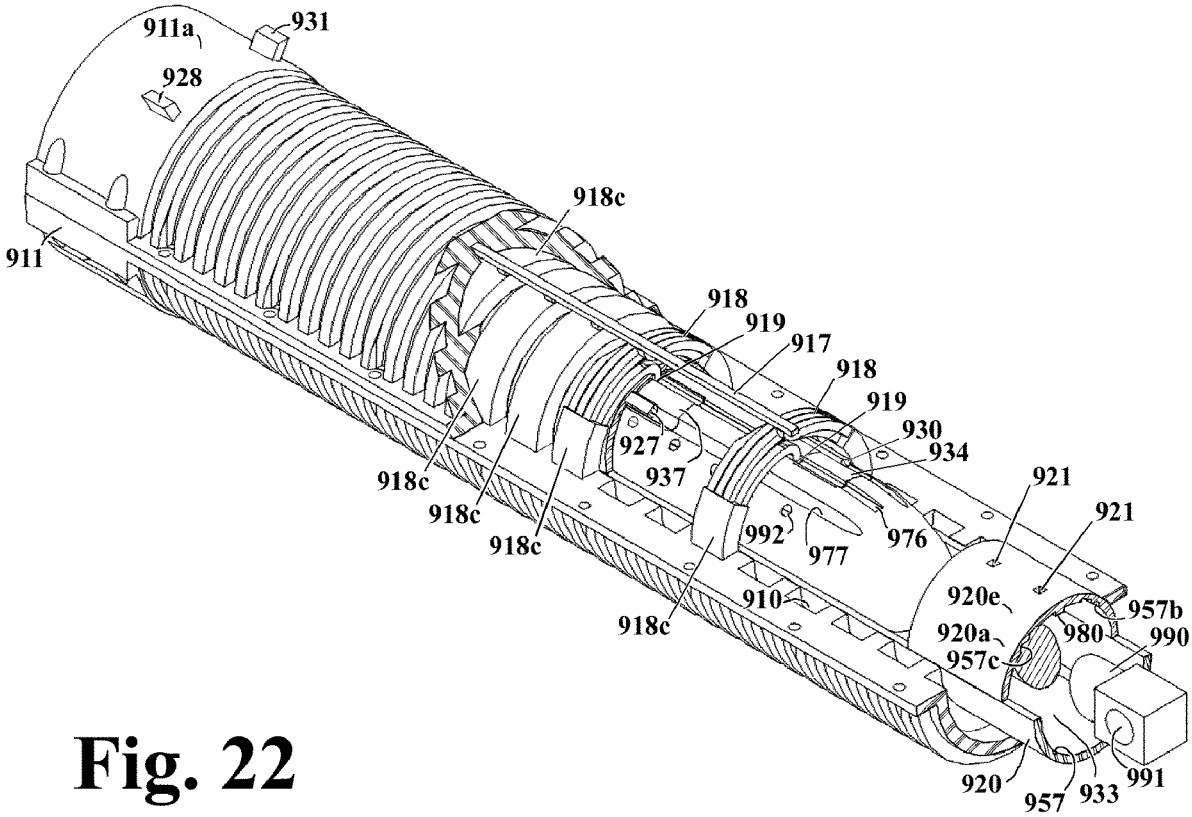
FIG. 22 is an oblique cutaway view of the invention embodiment in FIG. 19 but wherein the armature and barrel have been modified for repetitive low friction use as a bidirectional electromagnetic actuator or motor.

FIG. 22 is an embodiment as in 19 using a permanent magnet in the armature but used as a bidirectional actuator. Armature 932 has four linear arrays of roller balls 992 distributed in the armature surface about and parallel its axis. The armature's roller ball arrays in the barrel cavity travel in bearing raceways 957, 957*a*, 957*b* and 957*c* in the surface 920*i* of barrel cavity shell halves 920 and 920*a* to maintains proper armature orientation with low friction movement in the barrel cavity. The direction of actuator armature 932 propulsion in the barrel cavity is determined by the direction of current in the wall conductor circuit; i.e. the polarities of the outside power supply terminals connected to the connection lugs at the barrel breach. The actuator armature 932 has permanent magnet 41 with north pole oriented towards the muzzle end of the armature and south pole towards the breach end. In the figure, the actuator armature has extension 990 shortened by section with connection means 991.

With barrel power rail lug 931 connected to the positive terminal of the outside power source and power rail lug 928 connected to the negative or return terminal of the outside power supply, the current in forward wall conductor 18 coil is ccw about the barrel cavity 933 and the armature 932 therein and the apparent south pole of forward current shunt coil is towards the breach and current in aft wall conductor coil 918 is cw about the barrel cavity 933 and the armature 932 therein and the apparent south pole of aft wall conductor coil is towards the muzzle. The apparent south pole of aft wall conductor coil is proximal the armature magnet south pole creating forces of repulsion there between which propels the armature towards the barrel cavity muzzle and the apparent south pole of forward wall conductor coil is towards the breach. The apparent south pole of forward wall conductor coil is proximal the north pole of the armature magnet creating forces of attraction there between which also propels the armature towards the barrel cavity muzzle.

With the barrel power rail lug 931 connected to the negative terminal of the outside power source and power lug 928 connected to the positive terminal of the outside power supply, the current in aft wall conductor coil is ccw and the apparent north pole of aft wall conductor coil is towards the muzzle. The apparent north pole of the aft wall conductor coil is proximal the south pole of the armature magnet 941 creating forces of attraction there between which propels the armature towards the barrel cavity breach. The current in forward wall conductor coil is cw and the apparent south pole of the forward wall conductor coil is towards the barrel muzzle and the north pole of the forward current coil is towards toward the barrel breach and proximal the north pole of the armature magnet 942 creating forces of repulsion there between which propel the armature towards the barrel cavity breach.

Figure 23:
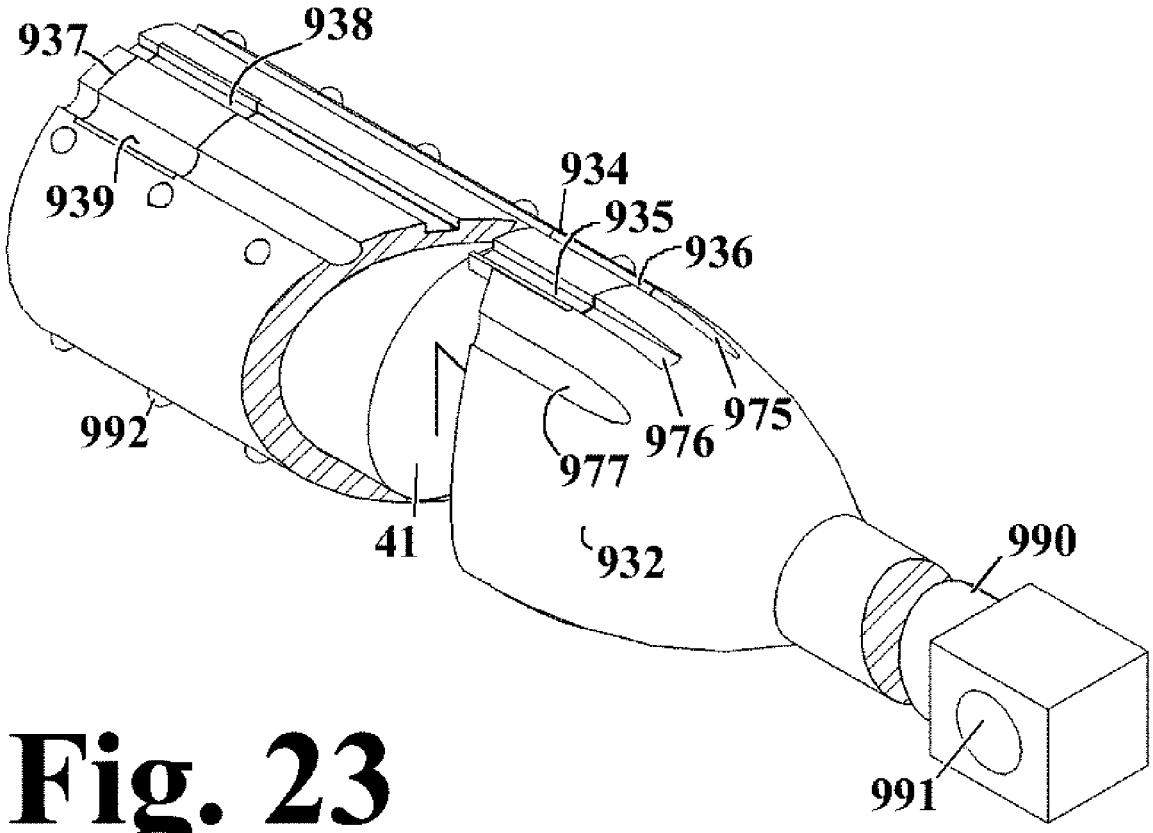
FIG. 23 is an oblique cutaway view of the armature for the invention embodiment in FIG. 22.

FIG. 23 is the armature 932 for the actuator in FIG. 22, with a slice sectioned away from its body to show the permanent magnets location in the armature. The power takeoff shaft 990 with connection means 991 is shown shortened by sectioning.

Figure 24:
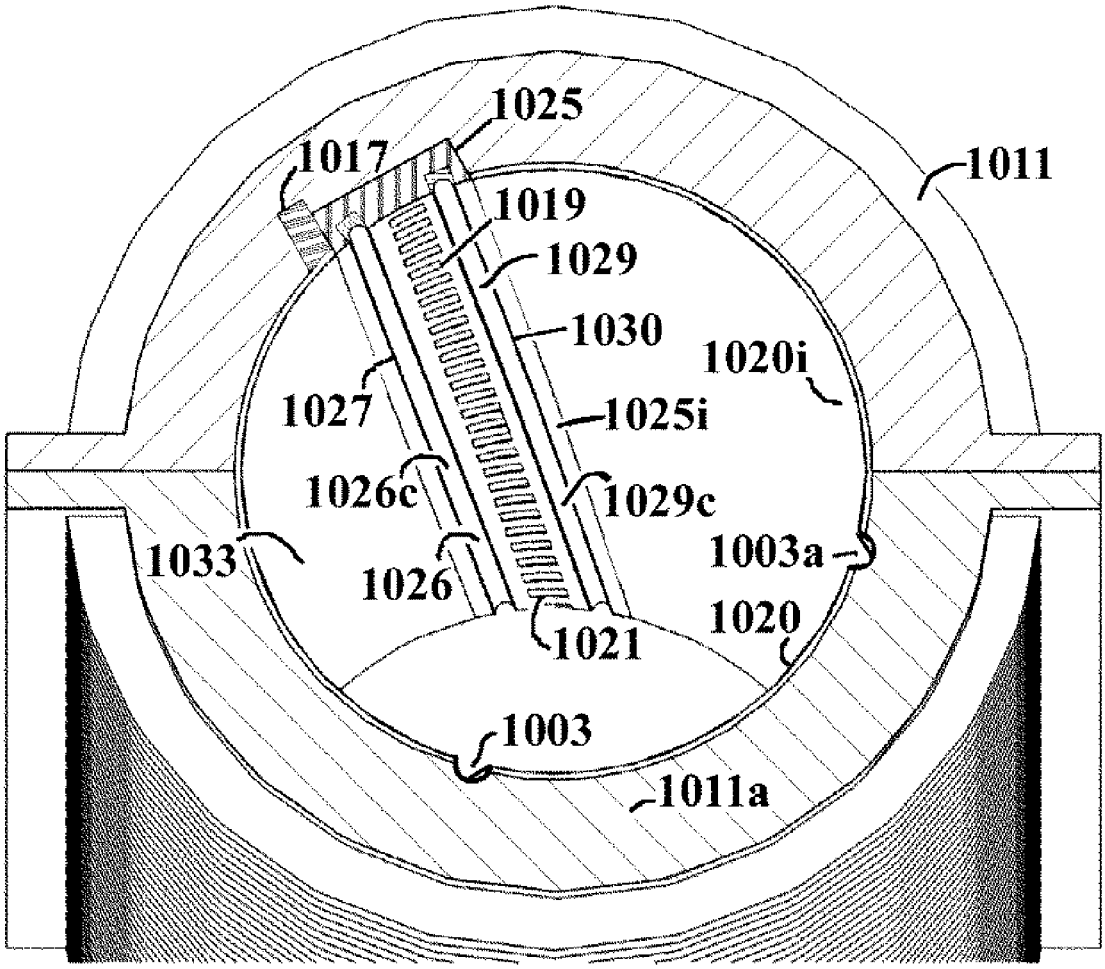
FIG. 24 is a view up into the breach end of a barrel cavity section with twist.

FIG. 24 is a view into the breach end of a section of a barrel that has a cavity with twist. FIG. 24 is similar FIG. 3 but with a cavity 1033 with twist. The armatures for the embodiment in FIG. 24 has a twist identical that of the barrel cavity and may have armature propulsion element comprised of either an energized propulsion bus coil with an armature current bus as the propulsion bus-aft shunt circuit means, or a permanent with polarization parallel the armature's axis.

Although the invention has been described herein with reference to the presently preferred embodiments, a great number of modifications, changes and alterations including alternative configurations of said embodiments are possible without departing from the spirit and scope of the invention as defined in the appended claims and equivalents thereof.

The invention claimed is:

1. Electromagnetic propulsion devices comprising:
- a barrel;
- a cavity therein which extends the length of said barrel and having:
  - a breech end opening at one end and
  - a muzzle end opening at the other barrel end and
  - a central axis which extends from said breech end opening to said muzzle end opening, and
  - a uniform right section profile to said central axis throughout said cavity; and
- a first barrel rail and a second barrel rail and said barrel rails are:
  - power rails, and
  - parallel to one another, and
  - located in said barrel cavity's wall, and
  - electrically insulated from direct electrical continuity with each other, and
- each said barrel power rail has:
  - continuous barrel cavity surface along its length, and
  - connection means to outside said barrel for attachment to a power source; and
- a wall conductor assembly comprised of:
  - a barrel bus that is:
    - located outside said barrel cavity, and
    - electrically insulated from direct electrical continuity with said barrel power rails, and
    - located along the same length of the barrel as said barrel power rails; and
  - a plurality of wall conductors that are:
    - located outside said barrel cavity, and
    - parallel to one another, and
    - oriented orthogonal said barrel cavity axis, and
    - separated from one another, and
    - distributed along the length of said barrel bus, and
  - each said wall conductor of said plurality of wall conductors:
    - is a continuous insulated conductor between its ends, and
    - has electrical continuity at one end with said barrel bus, and
    - includes between its ends a coil that:
      - circumscribes the barrel cavity one or more times, and
      - circumscribes the barrel cavity in the same direction from said barrel bus as all other wall conductor coils of said plurality of wall conductors; and
  - contact means for each wall conductor of said plurality of wail conductors that:
    - is located proximal the end of said wall conductor that is distal said wall conductor's end with said barrel bus continuity, and
    - has electrical continuity with said wall conductor's barrel bus distal end, and
    - extends through a mating opening in the barrel cavity wall and
    - has surface in the barrel cavity; and
- armatures for propulsion through said barrel cavity and each said armature has:
  - a central axis that is, with said armature in said barrel cavity, coincident the central axis of said cavity or close and parallel said axis, and
  - a muzzle end that is, with said armature in said barrel cavity, the armature's end closest to said cavity's muzzle end, and
  - a breech end that is, with said armature in said barrel cavity, the armature's end closest to said cavity's breech end, and
  - all right section profiles to said central axis smaller than said barrel cavity's right section profile, and
  - a permanent magnet that is:
    - polarized in the direction of said armature axis, and
    - located midway between said armature's muzzle and breech ends, and
  - a forward current shunt that:
    - is located in the surface of said armature and near the muzzle end of said armature, and
    - has surface that, with said armature in said barrel cavity, is at and has continuous electrical continuity the cavity surface of said first barrel power rail, and said continuity is sliding electrical continuity with armature movement in the barrel cavity, and
    - has surface that, with said armature in said barrel cavity, is at and has continuous electrical continuity with said contact means of said wall conductor assembly at the instant barrel cavity location of said shunt surface and said continuity is sliding electrical continuity with armature movement in the barrel cavity, and
  - said forward current shunt of an armature in the barrel cavity is electrically insulated from direct electrical continuity with said second barrel power rail, and
- said wall conductor assembly has additionally, with an armature in said barrel cavity, forward wall conductors comprised of:
the group of one or more consecutive wall conductors of said wall conductor assembly whose contact means at any instant have said electrical continuity with said forward current shunt surface at said contact means; and
said forward current shunt of an armature in said barrel cavity,
via said shunt's continuous electrical continuity with said first power rail and said shunt's continuous electrical continuity with said forward wall conductors of said wall conductor assembly,
maintains continuous electrical continuity between said first barrel power rail and said forward wall conductors, and,
with power supplied by an outside power supply to said power rails via said connection means of said rails,
maintains a current path between said first power rail, and said forward wall conductors; and
an aft current shunt that:
is located in the surface of said armature and near the breech end of said armature, and
with said armature in said barrel cavity,
has surface with continuous electrical continuity with the cavity surface of said second barrel power rail and
has surface at and with continuous electrical continuity with said contact means of said wall conductor assembly at the instant barrel cavity location of said shunt surface and said continuity is sliding continuity with armature movement in the barrel cavity, and
said aft current shunt is electrically insulated from direct electrical continuity with said first barrel power rail; and
said wall conductor assembly has additionally, with said armature in said barrel cavity,
aft wall conductors comprised of:
the group of one or more consecutive wall conductors of said wall conductor assembly whose contact means at any instant have said electrical continuity with said aft current shunt surface at said contact means; and
said aft current shunt of an armature in said barrel cavity,
via said continuous electrical continuity with said second power rail and said continuous electrical continuity with said aft wail conductors of said wall conductor assembly,
maintains continuous electrical continuity between said second power rail and said aft wall conductors, and
with power supplied by an outside power supply to said power rails via said connection means of said rails,
maintains a current path between said power rail and said aft wall conductors; and
said barrel bus of said wall conductor assembly, with an armature in said barrel cavity,
provides continuous electrical continuity between said forward wall conductors and said aft wall conductors of said wall conductor assembly and
with power supplied by an outside power supply to said power rails,
provides a current path between said forward wall conductors and said aft wall conductors;
and wherein, with:
an armature in the barrel cavity and
power supplied to said power rail's connection means by an outside source, and
the polarity of said barrel power rails with reference to each other so that:
the magnetic fields of the current in said forward wall conductors interact with the armature's magnet creating forces of attraction on said magnet, and
the magnetic fields of the current in said aft wall conductors interact with the armature's magnet creating forces of repulsion on said magnet, and
said forces of attraction and repulsion on the armature's magnet have cavity axis parallel, muzzle directed components which propel the armature through the barrel cavity from breech to muzzle.

2. Electromagnetic propulsion devices as claimed in claim 1 used as a reversible electric motors wherein:
one of said armatures is retained in the barrel cavity for bidirectional movement therein; and
said armature has additionally power take-off means; and
the direction of said armature's barrel cavity traverse is reversed by reversing the polarities of said barrel power rails with reference to each other so that:
the magnetic fields of the current in said forward wall conductors interact with the armature's magnet creating forces of repulsion on said magnet, and
the magnetic fields of the current in said aft wall conductors interact with the armature's magnet creating forces of attraction on said magnet, and
said forces of attraction and repulsion on the armature's magnet have cavity axis parallel, breech directed components which propel the armature through the barrel cavity in the muzzle to breech direction.

3. Electromagnetic propulsion devices comprising:
a barrel; and
a cavity therein which extends the length of said barrel and having:
a breech end opening at one end and
a muzzle end opening at the other barrel end and
a central axis which extends from said breech end opening to said muzzle end opening and
a uniform right section profile to said central axis throughout said cavity; and
two pairs of barrel rails not both the same and said barrel rails are:
power rails, and
parallel to one another, and
located in said barrel cavity's wall, and
located along the same length of the barrels and
electrically insulated from direct electrical continuity with each other, and
each said barrel power rail has:
continuous barrel cavity surface along its length and
power connection means to outside said barrel for attachment to an outside power source; and
a wall conductor assembly comprised of:
a barrel bus that is:
located outside said barrel cavity, and
electrically insulated from direct electrical continuity with said barrel power rails, and
located along the same length of the barrel as said power rails; and
a plurality of wall conductors that are:
located outside said barrel cavity, and
parallel to one another, and
oriented orthogonal said barrel cavity axis, and
separated from one another, and
distributed along the length of said barrel bus, and each wall conductor of said plurality of wall conductors:

is a continuous insulated conductor between its ends, and has electrical continuity at one end with said barrel bus, and includes between its ends a coil that:

circumscribes the barrel cavity one or more times, and circumscribes the barrel cavity in the same direction from said barrel bus as all other wall conductor coils of said plurality of wall conductors; and contact means for each wall conductor of said plurality of wall conductors that:

is located proximal the end of said wall conductor that is distal said wall conductor's end with said barrel bus continuity, and has electrical continuity with said wall conductor's barrel bus distal end, and extends through a mating opening in the barrel cavity wall and has surface in the barrel cavity; and armatures for propulsion through said barrel cavity and each said armature has:

a central axis that is, with said armature in said barrel cavity, coincident the central axis of said cavity or very close and parallel said axis, and a muzzle end that is, with said armature in said barrel cavity, the armature's end closest said cavity's muzzle end, and a breech end that is, with said armature in said barrel cavity, the armature's end closest said cavity's breech end, and all right section profiles to said axis smaller than said barrel cavity's right section profile, and a portion of said profiles like said barrel cavity's right section profile but slightly undersized thereof; and a propulsion bus that includes between its ends a coil which circumscribes the armature axis one or more times, and, that is:

a continuous insulated conductor between its ends, and located midway between the armature's muzzle and breech ends, and oriented orthogonal said armature's central axis, and located in said armature where said cavity's right section profile and said armature's right section profiles are similar, and located within said armature, in, at or proximal said armature's surface, that in said barrel cavity, is proximal said cavity's surface, and said propulsion bus, with said armature in said barrel cavity, has:

at one end, surface with continuous electrical continuity with the cavity surface of one of said barrel power rails that is proximal said propulsion bus end and said electrical continuity is continuous sliding electrical continuity with movement of said armature in the barrel cavity, and at its other end, surface with continuous electrical continuity with the cavity surface of a second of said barrel power rails that is proximal said other end and said electrical continuity is continuous sliding electrical continuity with movement of said armature in said barrel cavity; and a forward current shunt that:

is located in said armature's surface between said propulsion bus and said armature's muzzle end and, has surface that, with said armature in said barrel cavity, is at and has continuous electrical continuity with the cavity surface of one of said barrel power rails, and said continuity is sliding electrical continuity with armature movement in the barrel cavity, and has surface that, with said armature in said barrel cavity, is at and has continuous electrical continuity with said contact means of said wall conductor assembly at the instant barrel cavity location of said shunt surface and said continuity is sliding electrical continuity with armature movement in the barrel cavity, and said forward current shunt of an armature in the barrel cavity is electrically insulated from direct electrical continuity with the remaining barrel power rails; and said wall conductor assembly has additionally, with an armature in said barrel cavity, forward wail conductors comprised of:

the group of one or more consecutive wall conductors of said wall conductor assembly whose contact means at any instant have said electrical continuity with said forward current shunt surface at said contact means; and said forward current shunt of an armature in said barrel cavity, via said shunt's continuous electrical continuity with said power rail and said shunt's continuous electrical continuity with said forward wall conductors of said wall conductor assembly, maintains continuous electrical continuity between said barrel power rail and said forward wall conductors, and, with power supplied by an outside power supply to said power rails, maintains a current path between said barrel power rail, and said forward wall conductors;

each said armatures also has an aft current shunt that:

is located in the armature's surface between the propulsion bus and the breech end of said armature, and with said armature in said barrel cavity, has surface that is at and has continuous electrical continuity with the cavity surface of a barrel power rail that:

does not have direct electrical continuity with said forward current shunt, and does not have direct electrical continuity with the propulsion bus when said propulsion bus and said forward current shunt have direct electrical continuity with the cavity surface of the same barrel power rail, and has surface that is at and has continuous electrical continuity with said contact means of said wall conductor assembly at the instant barrel cavity location of said shunt surface and said continuity is sliding electrical continuity with armature movement in the barrel cavity, and said aft current shunt of an armature in the barrel cavity is electrically insulated from direct electrical continuity with the other said barrel power rails; and said wall conductor assembly has additionally, with an armature in said barrel cavity, aft wall conductors comprised of:

the group of one or more consecutive wall conductors of said wall conductor assembly whose contact means at any instant have said electrical continuity with said aft current shunt surface at said contact means; and said aft current shunt of an armature in the barrel cavity, via said shunt's continuous electrical continuity with said barrel power rail and said shunt's continuous electrical continuity with said aft wall conductors of said wall conductor assembly, maintains continuous electrical continuity between said barrel power rail and said aft wall conductors, and, with power supplied by an outside power supply to said power rails, maintains a current path between said barrel power rail, and said aft wall conductors; and said barrel bus of said wall conductor assembly, with an armature in said barrel cavity, provides continuous electrical continuity between said forward wall conductors and said aft wall conductors of said wall conductor assembly and with power supplied by an outside power supply to said power rails, provides a current path between said forward wall conductors and said aft wall conductors; and wherein, with an armature in said barrel cavity, and with power supplied by an outside power source to:

said connection means of the power rail with said electrical continuity with said forward current shunt, and said connection means of the power rail with said electrical continuity with said aft current shunt, and with power supplied by an outside power source to:

said connection means of the power rail with said electrical continuity with one end of said propulsion bus, and said connection means of the power rail with continuous electrical continuity with the other end of said propulsion bus, and the polarity of said connections arranged so that:

the magnetic fields of current in said forward walls conductors interact with the current in said propulsion bus creating forces in said propulsion bus with cavity axis parallel, muzzle directed components, and the magnetic fields of current in said aft wall conductors interact with the current in said propulsion bus creating forces in said propulsion bus with cavity axis parallel, muzzle directed components, and said cavity axis parallel, muzzle directed force components, propel the armature through the barrel cavity from breech to muzzle.

4. Electromagnetic propulsion devices as claimed in claim 3 wherein said barrel cavity has a twist so that:

consecutive right sections at constant axial increments through said barrel cavity have a constant rate of angular rotation about said cavity's axis; and armatures for use in said barrel cavity have a twist so that:

consecutive right sections at constant axial increments through each said armature has the same constant rate of angular rotation about said armatures s axis as said cavity's and said twist imparts rotation to said armatures during their barrel cavity traverse.

5. Electromagnetic propulsion devices as claimed in claim 3 used as a reversible electric motors wherein:

one of said armatures is retained for reversible movement in said barrel cavity, and said armature has additionally a power take-off means, and wherein the direction of said armature's barrel cavity traverse is reversed by reversing the polarities with respect to each other of:

said power rail with continuous electrical continuity with said forward current shunt and said power rail with continuous electrical continuity with said aft current shunt, or of said power rail with continuous electrical continuity with one end of said propulsion bus and said power rail with continuous electrical continuity with the other end of said propulsion bus, so that:

the magnetic fields of current in said forward wail conductors interact with said armature's propulsion bus current creating forces in said propulsion bus with cavity axis parallel, breech directed components, and the magnetic fields of current in said aft wall conductors interact with said armature's propulsion bus current creating forces in said propulsion bus with cavity axis parallel, breech directed components, and said cavity axis parallel, breech directed force components propel the armature through the barrel cavity in a muzzle to breech direction.

6. Electromagnetic propulsion devices as claimed in claim 5 wherein each said barrel cavity has a twist so that:

consecutive right sections at constant axial increments through said barrel have a constant rate of angular rotation about said cavity's axis; and said armatures for use in said barrel cavity have a twist so that:

consecutive right sections at constant axial increments through said armatures have the same constant rate of angular rotation about said armature's axis and said twist imparts rotation to said armatures during their barrel cavity traverse.

7. Electromagnetic propulsion devices as claimed in claim 3 wherein said two pairs of barrel power rails not both the same, is comprised of four separate barrel power rails and one power rail of the first pair of power rails has continuous electrical continuity with said forward current shunt of an armature in said barrel cavity and the second power rail of the first pair of power rails has continuous electrical continuity with said aft current shunt of an armature in said barrel cavity, and one power rail of the second pair of power rails has continuous electrical continuity with one end of said propulsion bus of an armature in said barrel cavity, and the second power rail of the second pair of power rails has continuous electrical continuity with the other end of said propulsion bus of an armature in said barrel cavity.

8. Electromagnetic propulsion devices as claimed in claim 7 wherein said barrel cavity has a twist so that:

consecutive right sections taken at constant axial increments through the barrel have a constant rate of angular rotation about the cavity axis; and armatures for use in said barrel cavity have a twist so that:

consecutive right sections taken at constant axial increments through said armatures have the same constant rate of angular rotation about the armature axis as said barrel and said twist imparts rotation to said armatures during their barrel cavity traverse.

9. Electromagnetic propulsion devices as claimed in claim 7, used as a reversible electric motor wherein:

one of said armatures is retained for reversible movement in said barrel cavity, and said armature has additionally power take-off means, and wherein the direction of the armature's barrel cavity traverse is reversed by reversing the power rail polarities with reference to each other in one of said two pairs of power rails so that:

the magnetic fields of current in said forward wall conductors interact with the armatures s propulsion bus current creating forces in the propulsion bus with cavity axis parallel, breech directed components, and the magnetic fields of current in said aft wall conductors interact with the armature's propulsion bus current creating forces in the propulsion bus with cavity axis parallel, breech directed components, and said cavity axis parallel, breech directed force components propel said armature in said barrel cavity in the muzzle towards breech direction.

10. Electromagnetic propulsion devices as claimed in claim 9 wherein the barrel cavity has a twist so that:

consecutive right sections through the barrel have a constant rate of angular rotation about the cavity axis per unit axis distance; and armatures for use in said barrel cavity have a twist so that:

consecutive right sections through said armatures have the same constant rate of angular rotation about the armature axis per unit axis distance; and said twist imparts rotation to said armature during their barrel cavity traverse.

11. Electromagnetic propulsion devices comprising:

a barrel;

a cavity therein which extends the length of said barrel and having:

a breech end opening at one end and a muzzle end opening at the other barrel end and a central axis which extends from said breech end opening to said muzzle end opening and a uniform right section profile to said central axis throughout said cavity; and two barrel rails which are:

power rails, and parallel to, to one another and located in said barrel cavity's wall, and electrically insulated from direct electrical continuity with each other, and each said power rail has:

continuous barrel cavity surface along its length and connection means to outside said barrel for attachment to a power source; and a wail conductor assembly comprised of:

a barrel bus that is:

located outside of said barrel cavity, and electrically insulated from direct electrical continuity with said barrel power rails, and located along the same length of the barrel as said power rails; and a plurality of wall conductors that are:

located outside of said barrel cavity, and oriented orthogonal said barrel cavity axis, and parallel to one another, and separated from one another, and distributed along the length of said barrel bus, and each wall conductor of said wall conductor plurality:

is a continuous insulated conductor between its ends, and has electrical continuity at one end with said barrel bus, and includes between its ends a coil that:

circumscribes the barrel cavity one or more times and circumscribes the barrel cavity in the same direction from said continuity with said barrel bus as all other wall conductor coils of said plurality of wall conductors; and contact means for each wall conductor of said plurality of wall conductor that:

is located proximal the end of said wall conductor that is distal said wall conductor's end with said barrel bus continuity, and has continuous electrical continuity with said wall conductor's barrel bus distal end, and extends through a mating opening in the barrel cavity wall and has surface in the barrel cavity; and armatures for propulsion through said barrel cavity and each said armature has:

a central axis that is, with said armature in said barrel cavity, coincident the central axis of said cavity or very close and parallel the cavity central axis, and a muzzle end that is, with said armature in said barrel cavity, the armature's end closest the cavity's muzzle end, and a breech end that is, with said armature in said barrel cavity, the armature's end closest the cavity's breech end, and all right section profiles to said axis smaller than said barrel cavity's right section profile, and a portion of said profiles like said barrel cavity's right section profile but slightly undersized thereof; and a propulsion bus that is:

a continuous insulated conductor between its ends, and located midway between said armature's muzzle and breech ends, and oriented orthogonal said armature's central axis, and located in said armature where said cavity's right section profile and said armature's right section profiles are similar, and located within said armature, in, at or proximal said armature's surface that in said barrel cavity is proximal said cavity's surface, and that includes between its ends a coil which circumscribes said armature axis one or more times, and that has, with said armature in said barrel cavity, surface at one end with continuous electrical continuity with said cavity surface of one of said power rails and with armature movement in said barrel cavity said electrical continuity is continuous sliding electrical continuity and continuous electrical continuity at its other end with propulsion bus-aft shunt circuit means; and a forward current shunt that:

is located in said armature's surface between said propulsion bus and said armature's muzzle end, and, with said armature in said barrel cavity, is proximal the second of said barrel power rails and has surface with continuous electrical continuity with the cavity surface of said power rail and with armature movement in said barrel cavity said electrical continuity is continuous sliding electrical continuity and is insulated from direct electrical continuity with the first said power rail, and has surface at and with continuous electrical continuity with said contact means of said wall conductor assembly at the instant barrel cavity location of said shunt surface and said continuity is sliding electrical continuity with armature movement in the barrel cavity; and said wall conductor assembly has additionally, with an armature in said barrel cavity, forward wall conductors comprised of:

the group of one or more consecutive wall conductors of said wall conductor assembly whose contact means at any instant have said electrical continuity with said forward current shunt surface at said contact means; and said forward current shunt of an armature in said barrel cavity, via said shunt's continuous electrical continuity with said power rail and said shunt's continuous electrical continuity with said forward wall conductors of said wall conductor assembly, maintains continuous electrical continuity between said barrel power rail and said forward wall conductors, and, with power supplied by an outside power supply to said power rails, maintains a current path between said barrel power rail, and said forward wall conductors; and each said armature also has an aft current shunt that:

is located in the armature's surface between said propulsion bus and said armature's breech end, and, with said armature in said barrel cavity, has continuous electrical continuity with propulsion bus-aft shunt circuit means, and has surface at and with continuous electrical continuity with said contact means of said wall conductor assembly at the instant barrel cavity location of said shunt surface and said continuity is sliding electrical continuity with armature movement in the barrel cavity, and said aft current shunt of an armature in the barrel cavity is electrically insulated from direct electrical continuity with said barrel power rails; and said wall conductor assembly has additionally, with an armature in said barrel cavity, aft wall conductors comprised of:

the group of one or more consecutive wall conductors of said wail conductor assembly whose contact means at any instant have said electrical continuity with said aft current shunt surface at said contact means; and said aft current shunt of an armature in said barrel cavity, via said shunt's continuous electrical continuity with said propulsion bus-aft shunt circuit means and said shunt's continuous electrical continuity with said aft wall conductors of said wall conductor assembly, maintains continuous electrical continuity between said propulsion bus-aft shunt circuit means and said aft wall conductors, and, with power supplied by an outside power supply to said power rails, maintains a current path between said propulsion bus-aft shunt circuit means, and said aft wall conductors; and said barrel bus of said wall conductor assembly, with an armature in said barrel cavity, provides continuous electrical continuity between said forward wall conductors and said aft wall conductors of said wall conductor assembly and with power supplied by an outside power supply to said power rails, provides a current path between said forward wall conductors and said aft wall conductors; and said propulsion bus-aft shunt circuit means is comprised:

an electric current bus in said armature that is located:

proximal said current shunts therein, and between and connecting the end of said propulsion bus distal said propulsion bus's end with said power rail continuity and said aft current shunt; and wherein with power supplied to the power rails by an outside power supply so that:

the magnetic fields of current in said forward wall conductors interact with the current in said propulsion bus creating forces in said propulsion bus with cavity axis parallel, muzzle directed components, and the magnetic fields current in said aft wall conductors interact with the current in said propulsion bus creating forces in said propulsion bus with cavity axis parallel, muzzle directed components, and said cavity axis parallel, muzzle directed force components, propel the armature through the barrel cavity from breech to muzzle.

12. Electromagnetic propulsion devices as claimed in claim 11 wherein said barrel cavity has a twist so that consecutive right sections through the barrel have a constant rate of angular rotation per unit cavity axis distance about said cavity axis; and said armatures for use in said barrel cavity have a twist so that consecutive right sections through said armatures have the same constant rate of angular rotation per unit axis distance about the armature axis; and said twist imparts rotation to said armatures during their traverse from said barrel cavity's breech to muzzle.

13. Electromagnetic propulsion devices as claimed in claim 11 but wherein said propulsion bus-aft shunt circuit means is comprised:

a third barrel rail that:

is located in said barrel wall, and has continuous barrel cavity surface along its length, and is electrically isolated from said barrel power rails, is parallel said barrel power rails, and is located along the same barrel cavity length as said power rails; and additional surface on said propulsion bus that is:

proximal said bus's end that is distal said bus's end with power rail continuity, and that, with said armature in said barrel cavity, is at and has continuous electrical continuity with the barrel cavity surface of said third rail and said continuity is sliding electrical continuity with armature movement in the barrel cavity; and additional surface on said aft current shunt that, with said armature in said barrel cavity, is at and has continuous electrical continuity with the barrel cavity surface of said third barrel rail and said continuity is sliding electrical continuity with armature movement in the barrel cavity; and said propulsion bus-aft shunt circuit means, with said armature in said barrel cavity, maintains continuous electrical continuity between said propulsion bus and said aft current shunt and maintains a current path between said propulsion bus and said aft current shunt, with power supplied by an outside power supply to said power rails.

14. An electromagnetic propulsion device as claimed in claim 13 wherein the barrel cavity has a twist so that consecutive right sections through the barrel have a constant rate of angular rotation about the cavity axis per unit cavity distance; and armatures for use in said barrel cavity have a twist so that consecutive right sections through said armatures have the same constant angular rate rotation about the armature axis per unit axis distance, and said twist imparts rotation to said armature during their barrel cavity traverse.

* * * * *